US008235494B2

(12) United States Patent
Kaiho et al.

(10) Patent No.: US 8,235,494 B2
(45) Date of Patent: Aug. 7, 2012

(54) IMAGE FORMING APPARATUS AND EJECTION LIQUID CIRCULATING METHOD

(75) Inventors: Satoshi Kaiho, Yokohama (JP); Masaki Hiroki, Yokohama (JP); Atsushi Kubota, Shizuoka-ken (JP); Kazuhiko Ohtsu, Mishima (JP); Takashi Kado, Izunokuni (JP); Nobuaki Takahashi, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 378 days.

(21) Appl. No.: 12/707,810

(22) Filed: Feb. 18, 2010

(65) Prior Publication Data

US 2011/0199418 A1 Aug. 18, 2011

(51) Int. Cl.
*B41J 29/38* (2006.01)

(52) U.S. Cl. ..... 347/17

(58) Field of Classification Search ..... 347/17, 347/19, 84, 85, 90
See application file for complete search history.

(56) References Cited

U.S. PATENT DOCUMENTS 7,883,170 B2 * 2/2011 Toyoda et al. ..... 347/17
2006/0215000 A1 * 9/2006 Kachi ..... 347/85

FOREIGN PATENT DOCUMENTS

JP 09-104120 4/1997
JP 2006-159811 6/2006

* cited by examiner

*Primary Examiner* — An Do
(74) *Attorney, Agent, or Firm* — Turocy & Watson, LLP

(57) ABSTRACT

The image forming apparatus includes an upstream side chamber arranged further on an upstream side with respect to an ink flowing direction than a head in a circulating path and configured to temporarily store the ejection liquid that should be supplied to the head through the circulating path, a downstream side chamber arranged further on a downstream side than the head and further on the upstream side than the upstream side chamber in the circulating path and configured to temporarily store the ejection liquid collected from the head, and a pressure-difference adjusting mechanism configured to form a first pressure state in which the pressure in the downstream side chamber is lower than the pressure in the upstream side chamber and the head and a second pressure state in which the pressure in the upstream side chamber is lower than the pressure in the downstream side chamber.

20 Claims, 57 Drawing Sheets

IMAGE FORMING APPARATUS AND EJECTION LIQUID CIRCULATING METHOD

TECHNICAL FIELD

This specification relates to an image forming technique employing an ink jet system for ejecting ejection liquid such as ink from a head and forming an image on a recording medium.

BACKGROUND

In the past, in an image forming apparatus of an ink jet system for performing printing with a head configured to eject ink, as recovery means for eliminating air bubbles and foreign matters from the periphery of nozzles of the head, there is known a technique for collecting the ink not ejected by the head and remaining in the head and circulating and supplying the ink to the head again (see, for example, JP-A-09-104120 and JP-A-2006-159811).

In the related art, a configuration for directly pressing the ink with a pump to circulate and supply the ink to the head is disclosed.

However, when the configuration for directly pressing the ink with the pump is adopted, it is likely that pulsation of pressure generated because of a mechanism of the pump is directly transmitted to the head and affects ink ejection performance of the ink in the head.

SUMMARY

In order to solve the above problem, according to an aspect of the invention, there is provided an image forming apparatus which includes: a head configured to eject supplied ejection liquid to a recording medium; a circulating path configured to collect the ejection liquid remaining in the head and circulate and supply the ejection liquid to the head again; an upstream side chamber arranged further on an upstream side with respect to a flowing direction of ink than the head in the circulating path and configured to temporarily store the ejection liquid that should be supplied to the head through the circulating path; a downstream side chamber arranged further on a downstream side than the head and further on the upstream side than the upstream side chamber in the circulating path and configured to temporarily store the ejection liquid collected from the head; and a pressure-difference adjusting mechanism configured to form a first pressure state in which the pressure in the downstream side chamber is lower than the pressure in the upstream side chamber and a second pressure state in which the pressure in the upstream side chamber is lower than the pressure in the downstream side chamber.

In addition, according to another aspect of the invention, there is provided an ejection liquid circulating method in an image forming apparatus for temporarily storing ejection liquid that should be supplied to a head through a circulating path and temporarily storing the ejection liquid collected from the head in a downstream side chamber arranged on a clown stream side than the head in the circulating path and further on an upstream side than an upstream side chamber, the head being configured to eject supplied ejection liquid to a recording medium, the circulating path being configured to collect the ejection liquid remaining in the head and circulate and supply the ejection liquid to the head again, and the upstream side chamber being arranged further on the upstream side with respect to an ink flowing direction than the head in the circulating path, the method including: forming a first pressure state in which the pressure in the downstream side chamber is lower than the pressure in the upstream side chamber; and forming a second pressure state in which the pressure in the upstream side chamber is lower than the pressure in the downstream side chamber.

DETAILED DESCRIPTION

An embodiment of the present invention is explained below with reference to the accompanying drawings.

Figure 1:
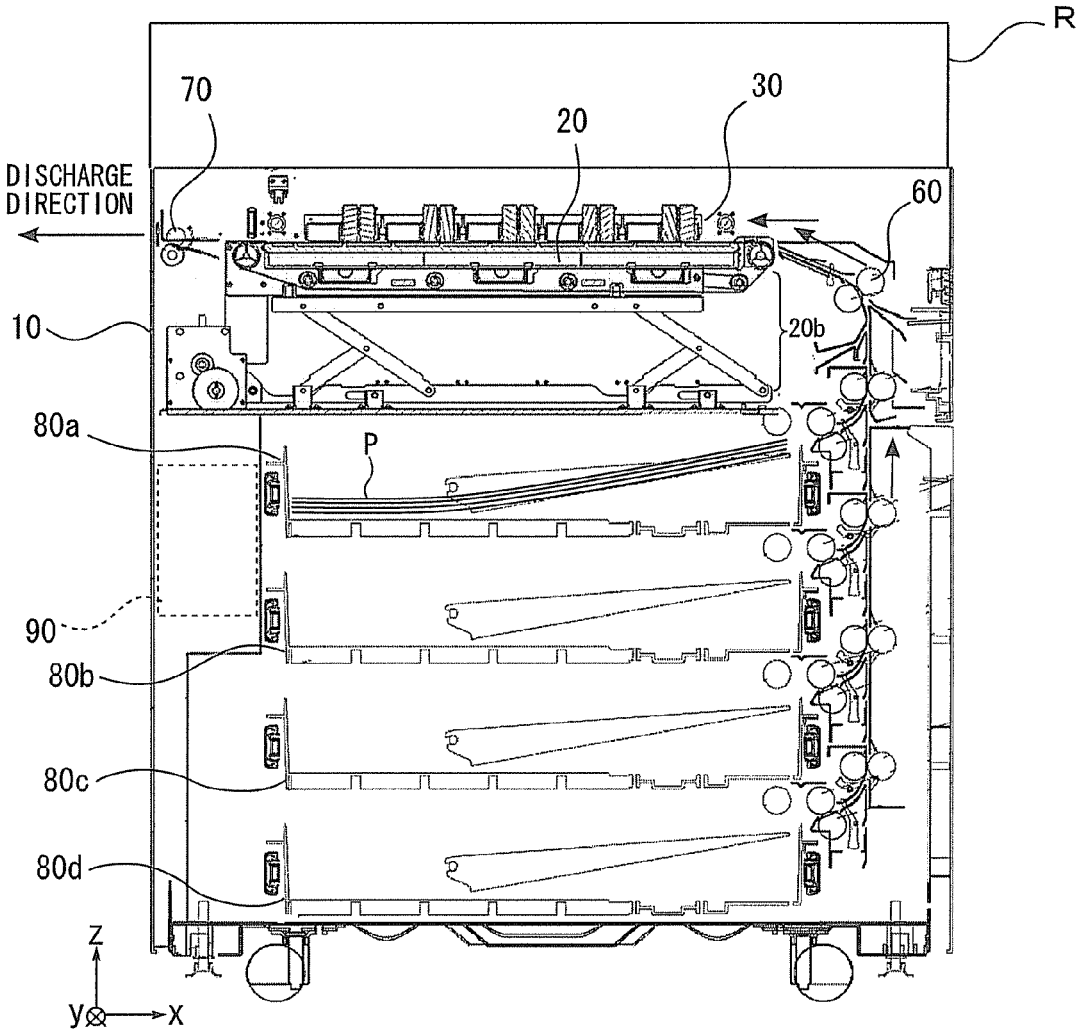
FIG. 1 is a longitudinal sectional view of the entire configuration of an image forming apparatus according to an embodiment of the present invention.
Figure 2:
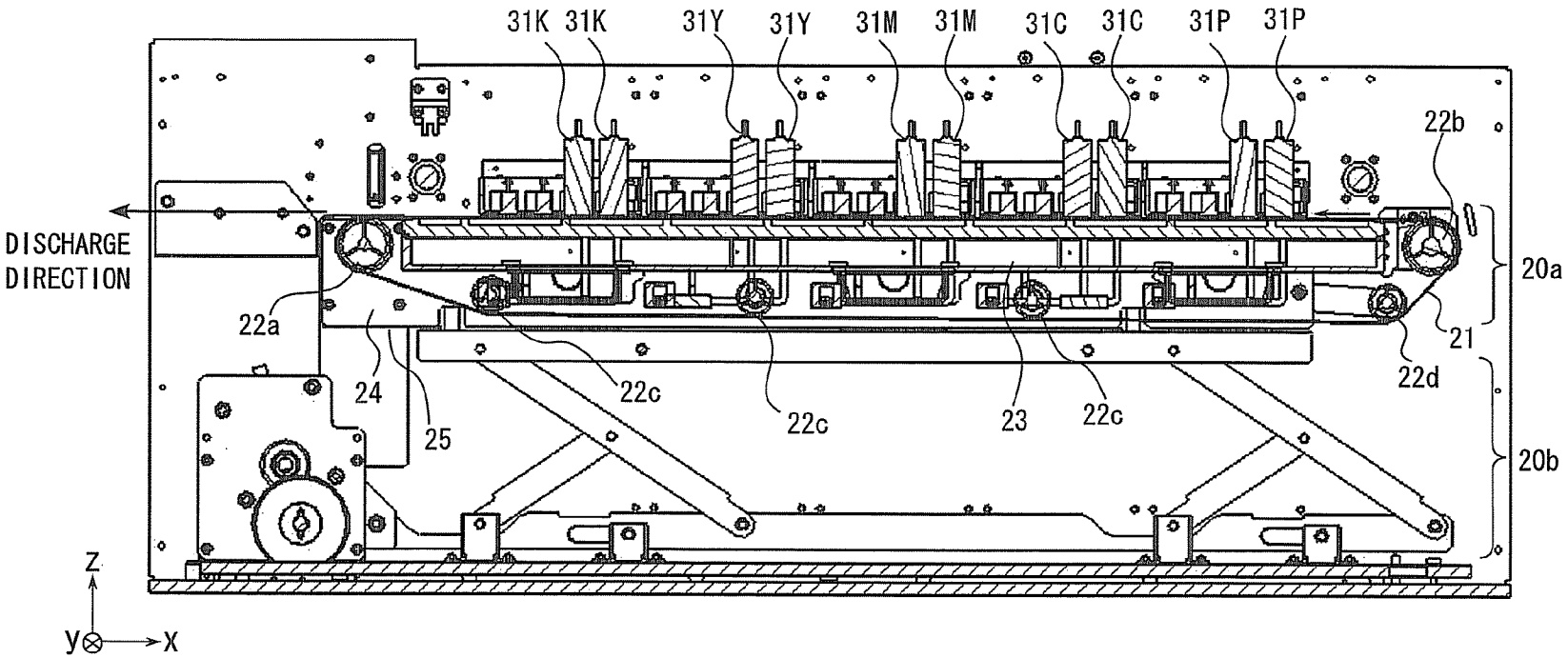
FIG. 2 is a schematic longitudinal sectional view of the internal configuration of the image forming apparatus according to the embodiment.
Figure 3:
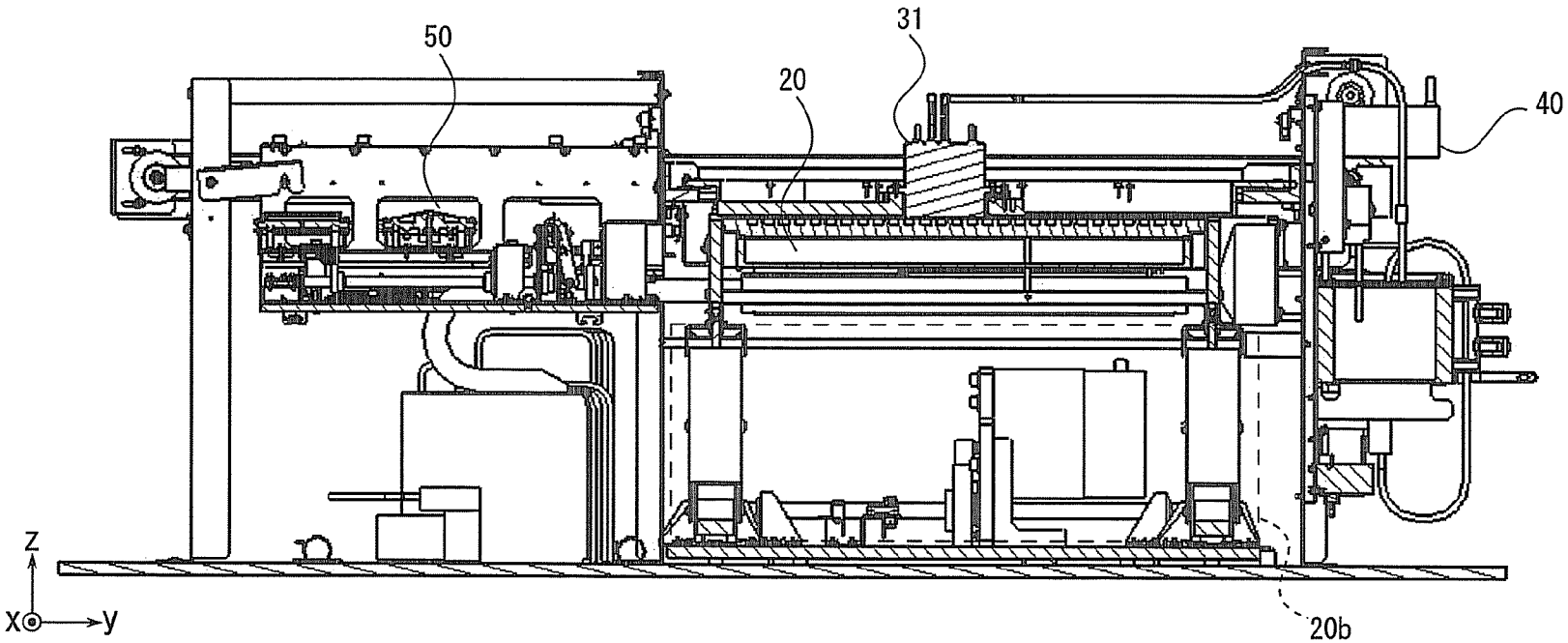
FIG. 3 is a schematic longitudinal sectional view of the internal configuration of the image forming apparatus according to the embodiment.
Figure 4:
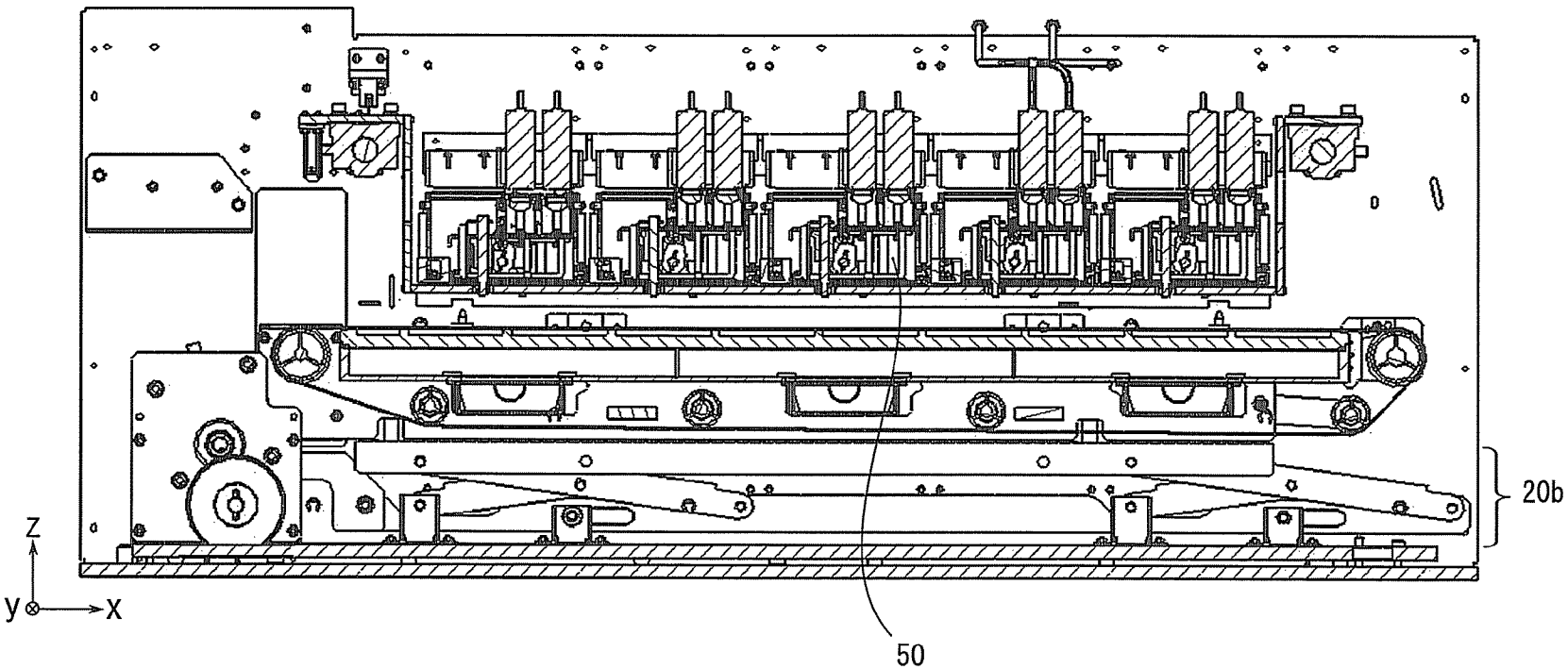
FIG. 4 is a schematic longitudinal sectional view of the internal configuration of the image forming apparatus according to the embodiment.
Figure 5:
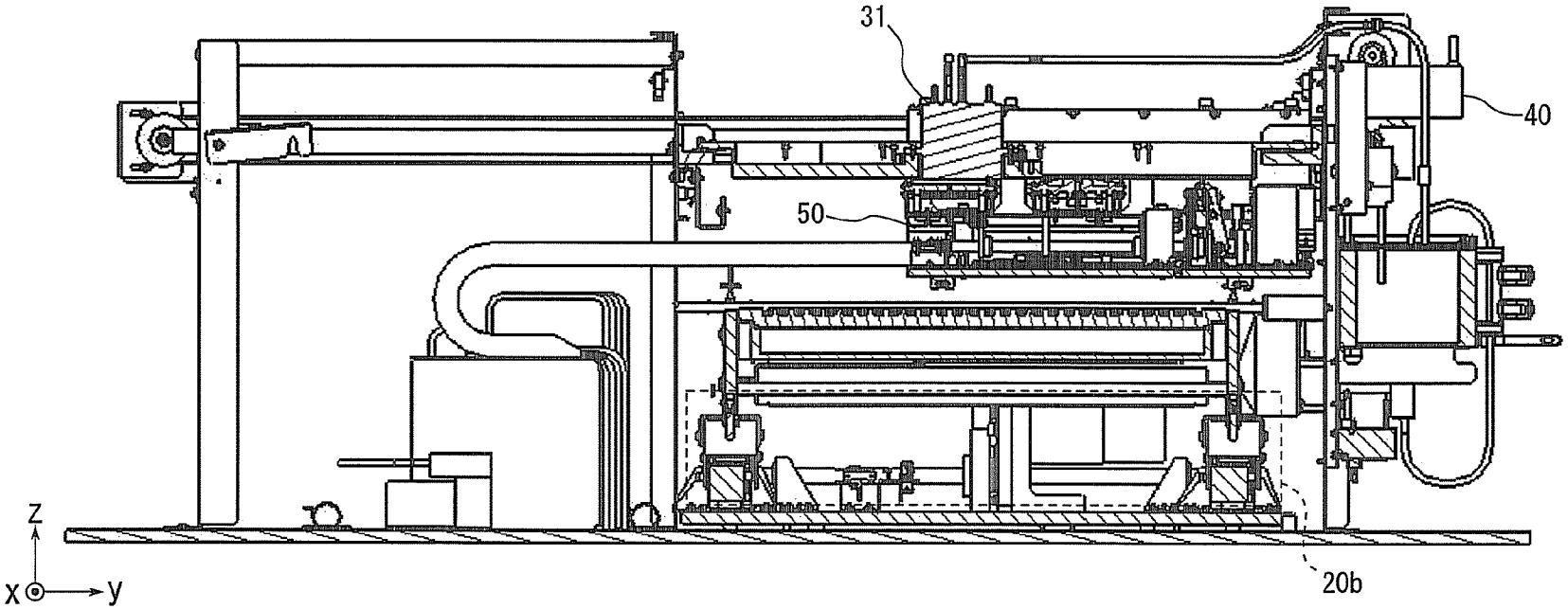
FIG. 5 is a schematic longitudinal sectional view of the internal configuration of the image forming apparatus according to the embodiment.

FIG. 1 is a longitudinal sectional view of the entire configuration of an image forming apparatus (MFP: Multi Function Peripheral) according to an embodiment of the present invention. FIGS. 2 to 5 are schematic longitudinal sectional views of the internal configuration of the image forming apparatus according to this embodiment. FIGS. 3 and 5 are diagrams of the inside of the apparatus viewed from the right side on the paper surface (a recording medium conveying direction) in FIG. 1.

An image forming apparatus 1 includes a housing 10 configured to house components of the image forming apparatus 1, a media conveying unit 20, a head mounting unit 30, an ink supplying unit 40, a maintenance unit 50, a media feeding unit 60 configured to feed a recording medium P to the media conveying unit 20, a media discharging unit 70 configured to discharge the recording medium P, media storing units 80*a* to 80*d* configured to store recording media P, and a control unit 90 (equivalent to a pressure control unit, a conveyance control unit, a maintenance-necessity determining unit, an attraction control unit, a retraction control unit, an information acquiring unit, etc.).

The control unit 90 plays a role of performing various kinds of processing in the image forming apparatus 1 and also has a role of realizing various functions by executing computer programs. These computer programs are carried out the action of the imaging forming apparatus by a processor which does not show. Memories included in the control unit 90 can include a RAM (Random Access Memory), a ROM (Read Only Memory), a DRAM (Dynamic Random Access Memory), an SRAM (Static Random Access Memory), a VRAM (Video RAM), and so on. The memories have a role of storing various kinds of information and computer programs used in the image forming apparatus 1.

Details of the configuration of the components are explained below.

First, the configuration of the media conveying unit 20 is explained with reference to FIGS. 2 to 15.

As shown in FIGS. 2 to 7, the media conveying unit 20 includes a conveying unit 20*a* configured to have a function of conveying the recording medium P and a moving unit 20*b* configured to bring the conveying unit 20*a* into contact with and separate the conveying unit 20*a* from the head mounting unit 30. The conveying unit 20*a* is explained with reference to FIGS. 6 to 12. The conveying unit 20*a* includes a conveyor belt 21 configured to bear and convey the recording medium P, a driving roller 22*a*, a driven roller 22*b*, driven rollers 22*c*, and a tension roller 22*d* around which the conveyor belt 21 is wound and suspended, a duct 23 configured to attract the recording medium P to the conveyor belt 21 via the conveyor belt 21, and a driving unit 24 configured to drive the driving roller 22*a*. The driven roller 22*b* has the same size as the driving roller 22*a* and is arranged in a position opposite to the driving roller 22*a* with respect to the recording media conveying direction.

Figure 9:
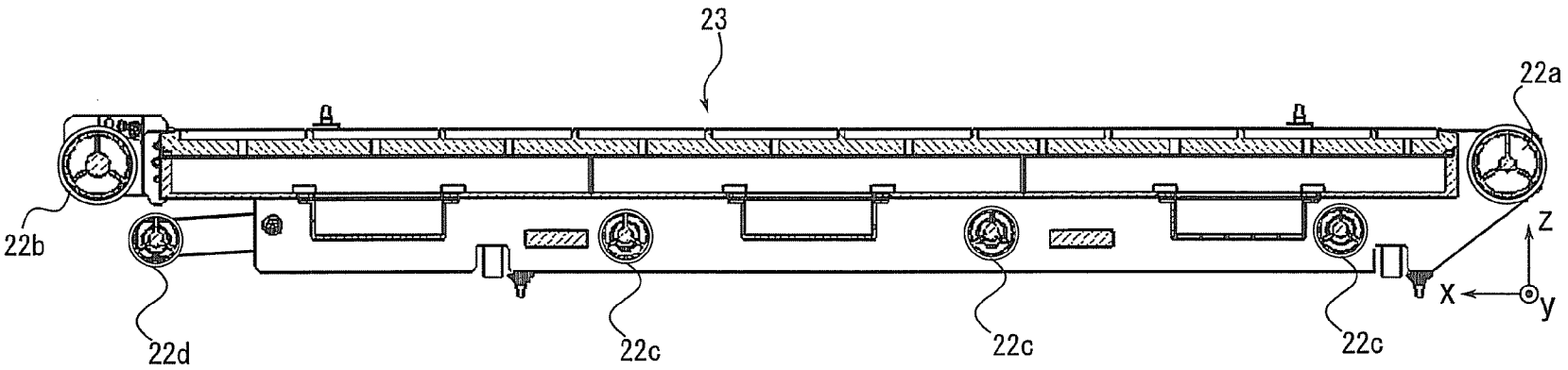
FIG. 9 is a longitudinal sectional view for explaining the configuration of the media conveying unit 20.
Figure 10:
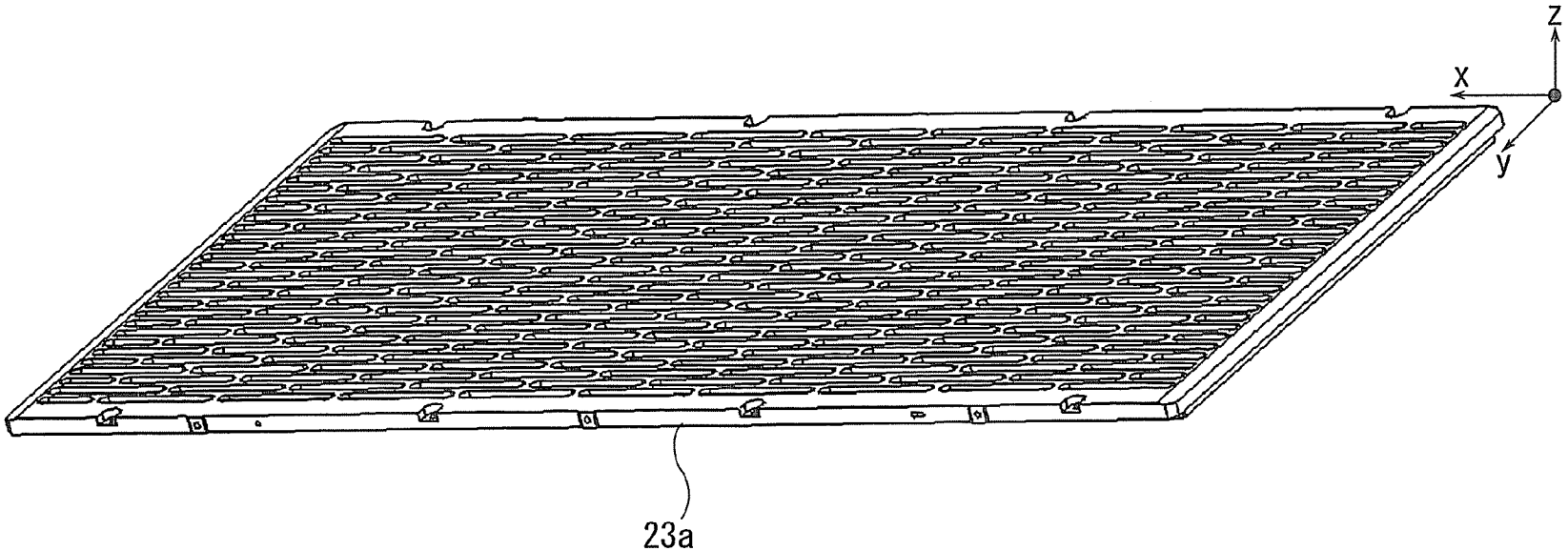
FIG. 10 is a diagram for explaining the configuration of a top plate 23*a* included in the media conveying unit 20.
Figure 11:
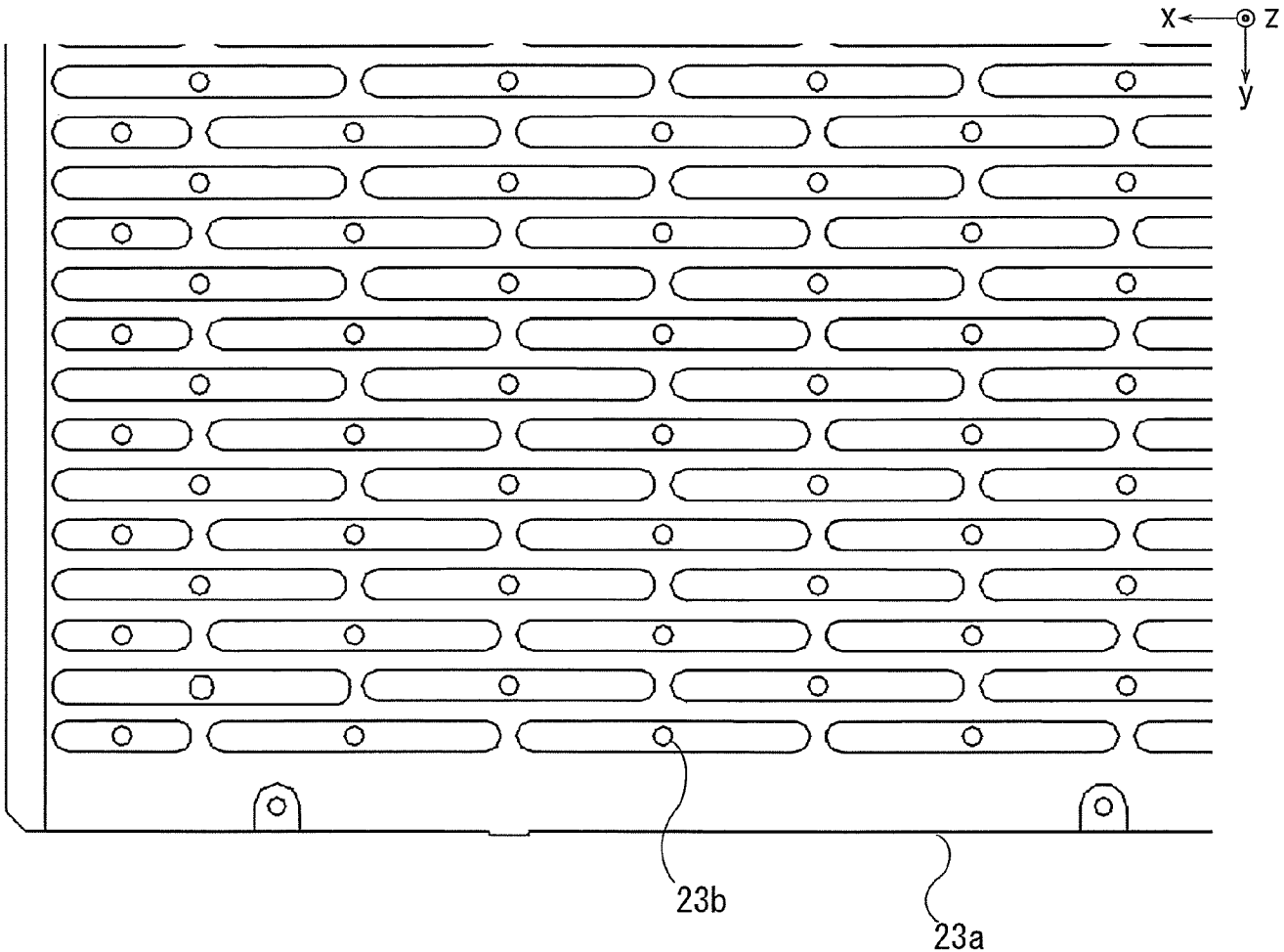
FIG. 11 is a diagram for explaining the configuration of the top plate 23*a* included in the media conveying unit 20.

The conveyor belt 21 is driven to rotate by the action of the driving roller 22*a* driven to rotate by the driving unit 24. The driven roller 22*b* and the driven rollers 22*c* are driven to rotate in association with the rotating action of the driving roller 22*a* (FIG. 9). The conveyor belt 21 is applied with appropriate tension by the action of the tension roller 22*d*.

The conveyor belt 21, the driving roller 22*a*, the driven roller 22*b*, the driven rollers 22*c*, the tension roller 22*d*, the duct 23, and the driving unit 24 are housed in the housing 25.

Figure 7:
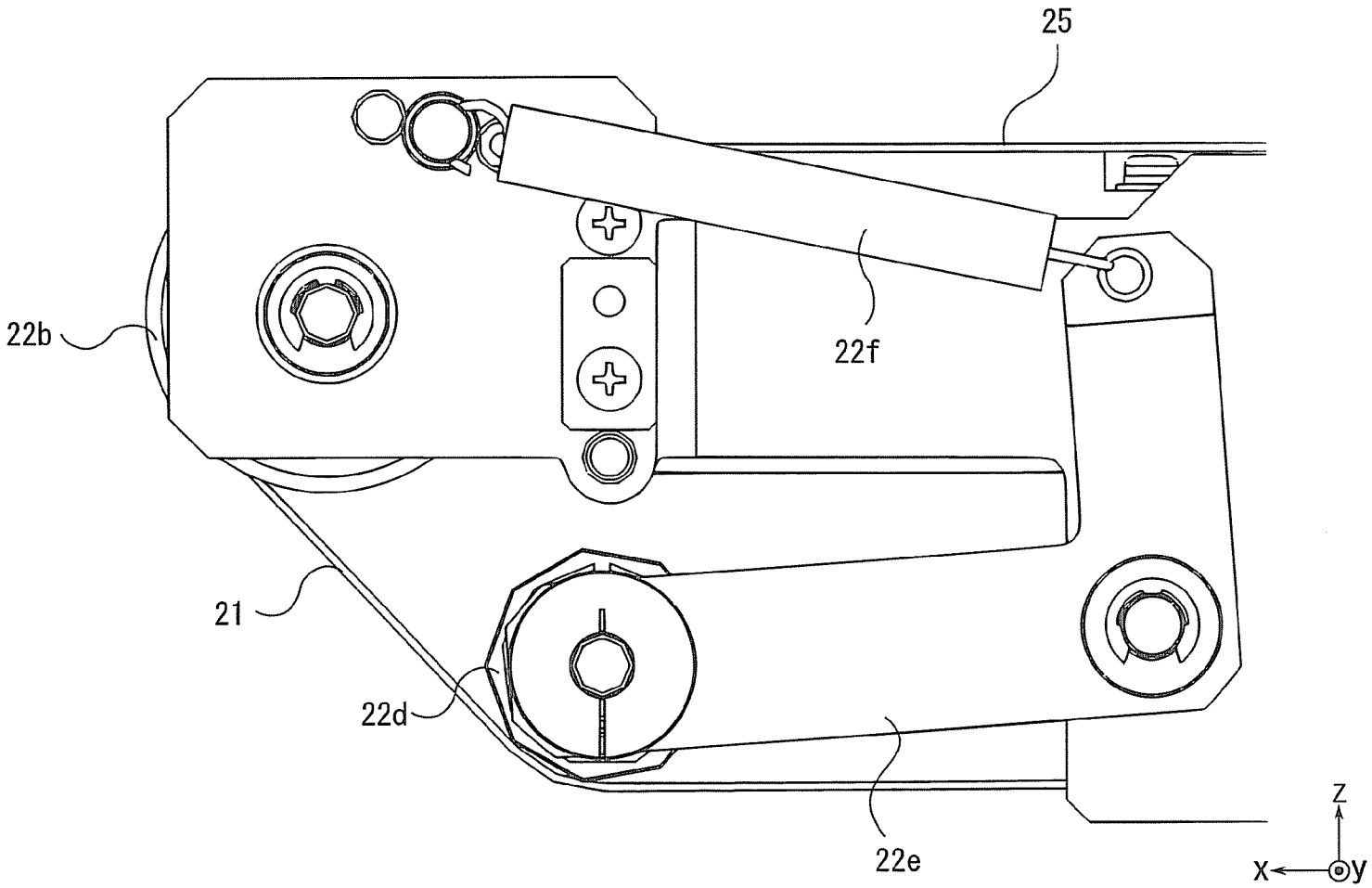
FIG. 7 is a diagram for explaining the configuration of the media conveying unit 20.

The housing 25 includes a tensioner 22*e*, which is configured to support the tension roller 22*d*, and a tension spring 22*f* to apply appropriate tension to the conveyor belt 21 (FIG. 7).

Figure 8:
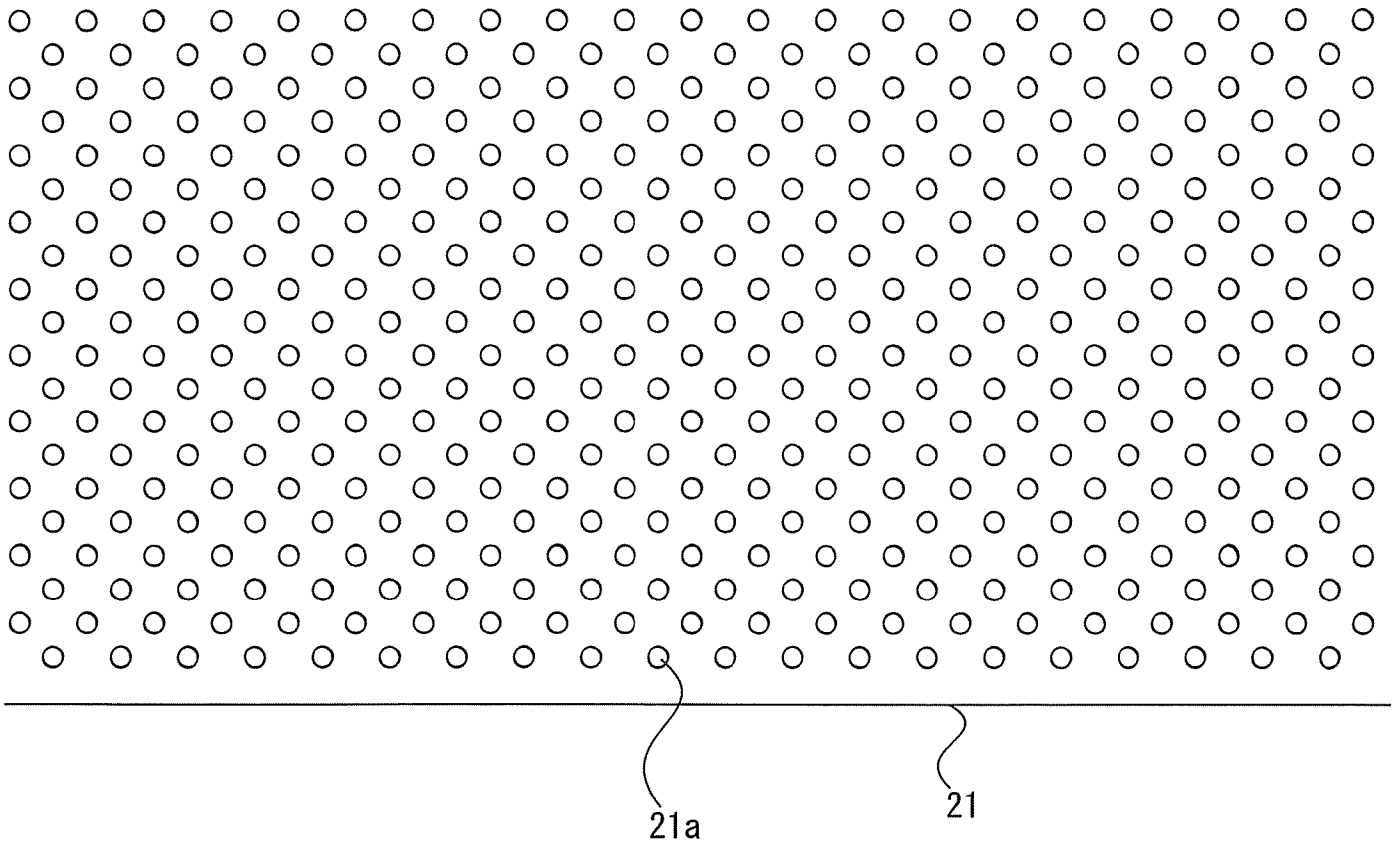
FIG. 8 is a diagram for explaining the configuration of a conveyor belt in the media conveying unit 20.

The conveyor belt 21 is an endless belt formed by laminating rubber on fiber. Holes 21*a* are formed over the entire surface thereof (FIG. 8).

Figure 6:
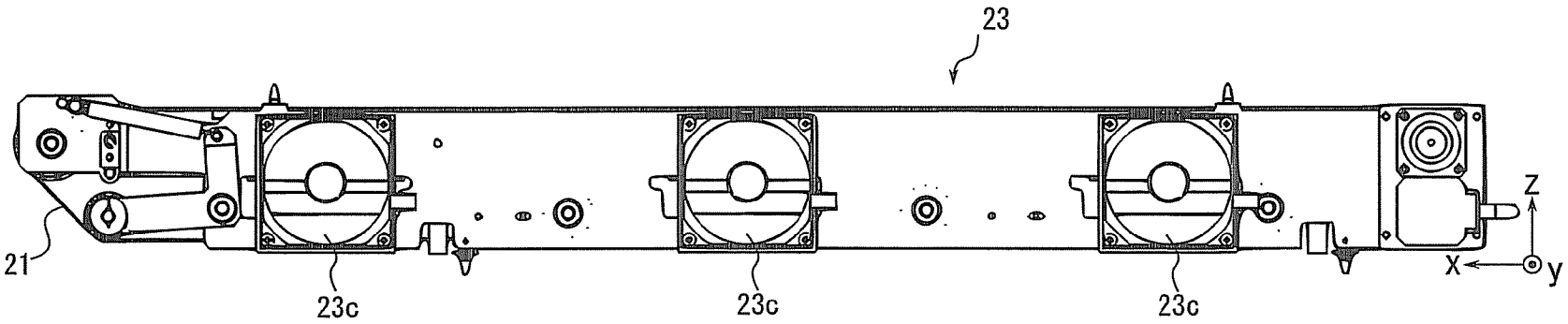
FIG. 6 is a diagram for explaining the configuration of a media conveying unit 20.
Figure 12:
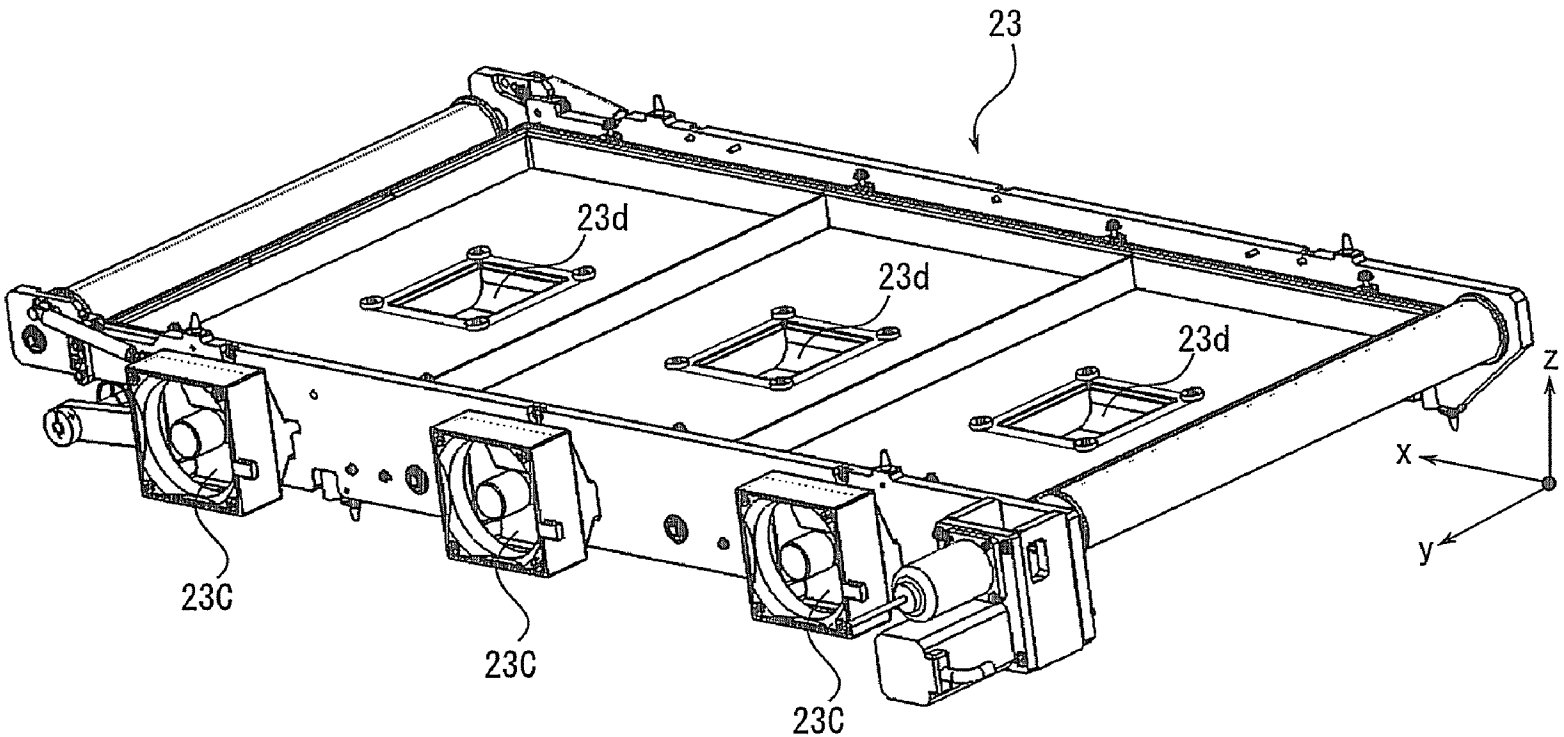
FIG. 12 is a diagram for explaining the configuration of an absorbing duct included in the media conveying unit 20.

The duct unit 23 includes a top plate 23*a* in which a large number of holes 23*b* are formed (FIGS. 9 to 11) and an attraction fan 23*c* (FIGS. 6 and 12).

The driving roller 22*a* is driven to rotate by the driving unit 24 and rotates the conveyor belt 21 in a desired direction. A position where the conveyor belt 21 forms a media conveying surface is specified by the top plate 23*a* of the duct unit 23 (FIG. 9).

Attraction force generated by the attraction fan 23*c* (FIGS. 6 and 12) attracts the recording medium P to the media conveying surface of the conveyor belt 21 through the holes 21*a* of the duct 23*d*, the top plate 23*a* and the conveyor belt 21. With such structure, the recording medium P is conveyed at desired speed following the traveling of the conveyor belt 21.

Figure 13:
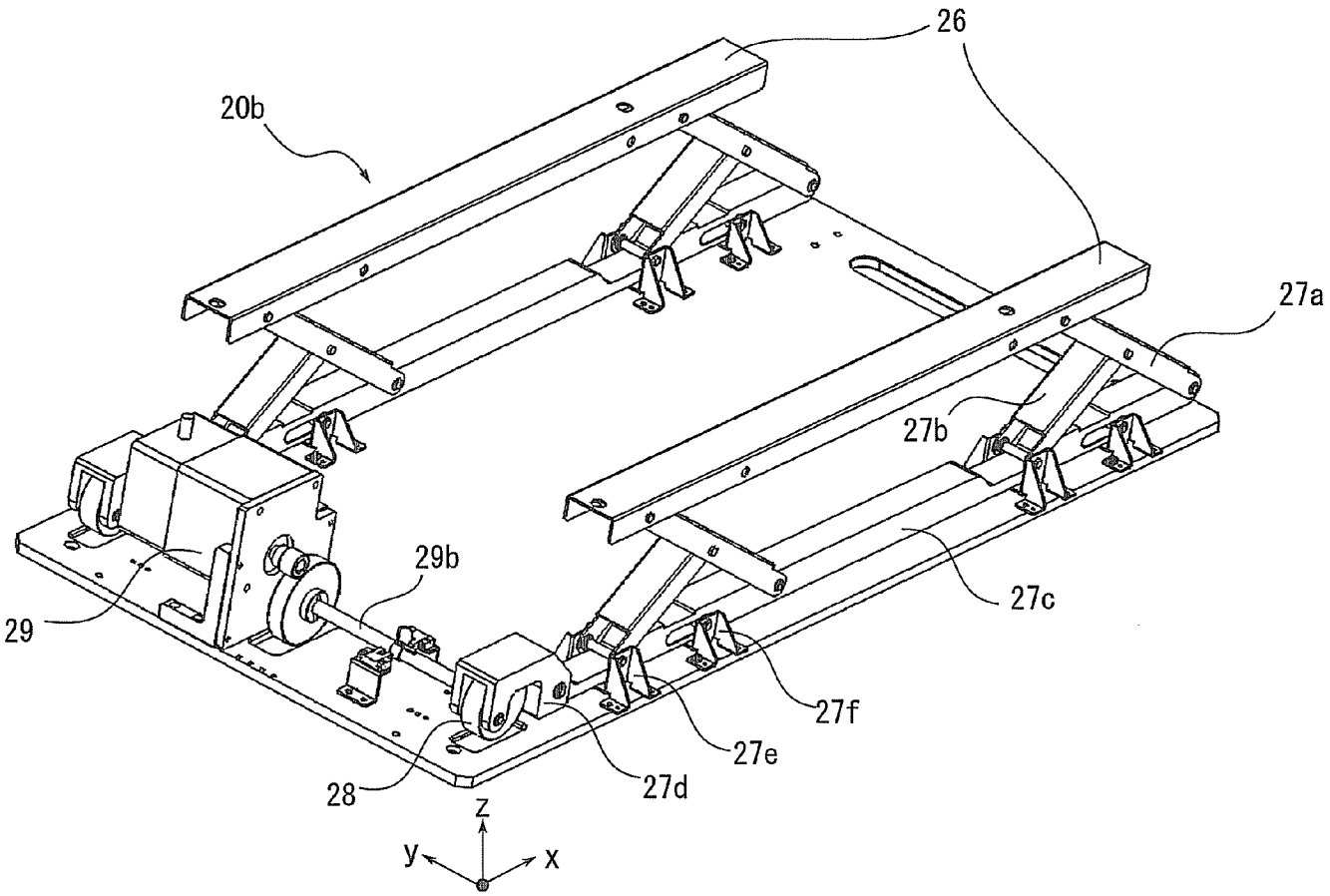
FIG. 13 is a diagram for explaining the configuration of a moving unit of the media conveying unit 20.
Figure 14:
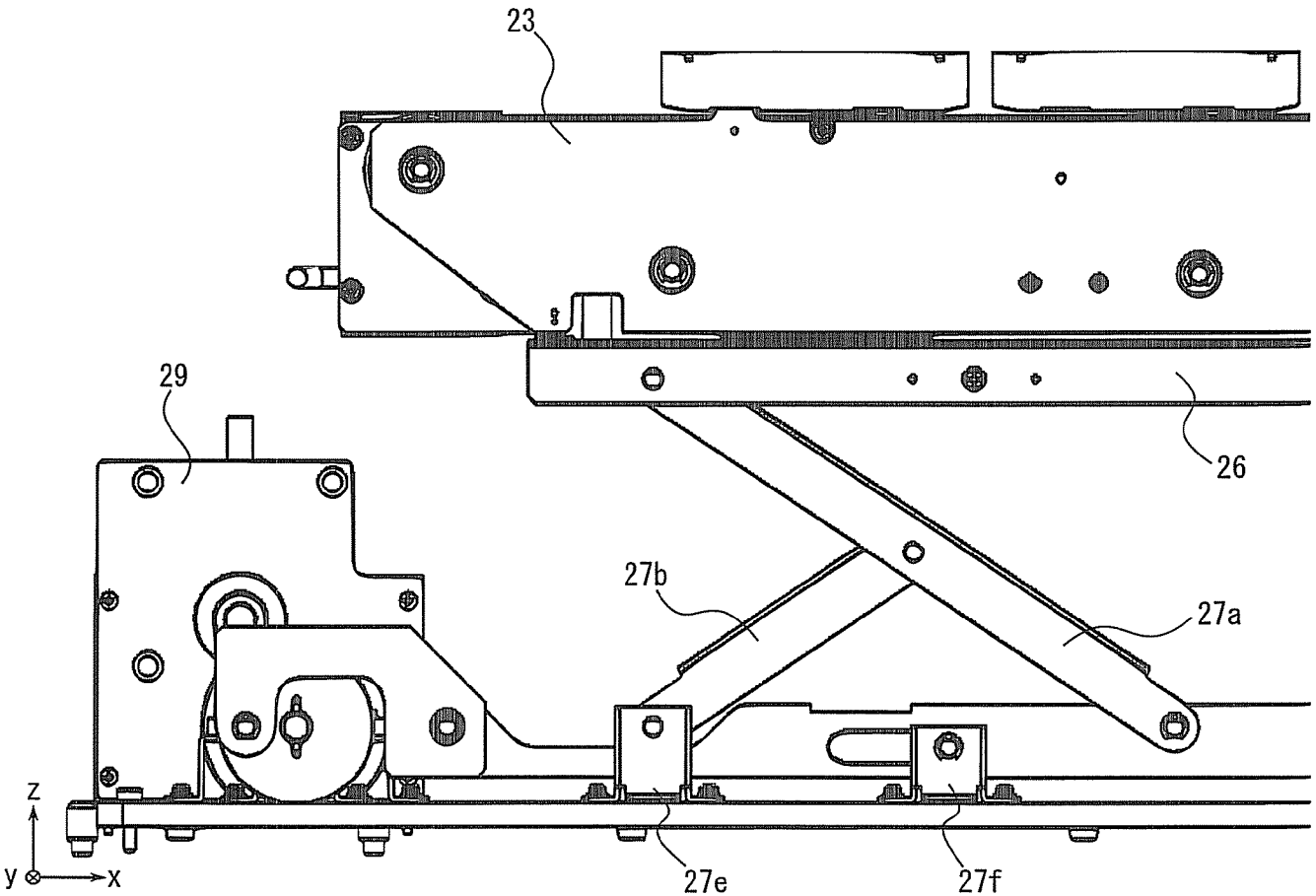
FIG. 14 is a diagram for explaining the configuration of the moving unit of the media conveying unit 20.
Figure 15:
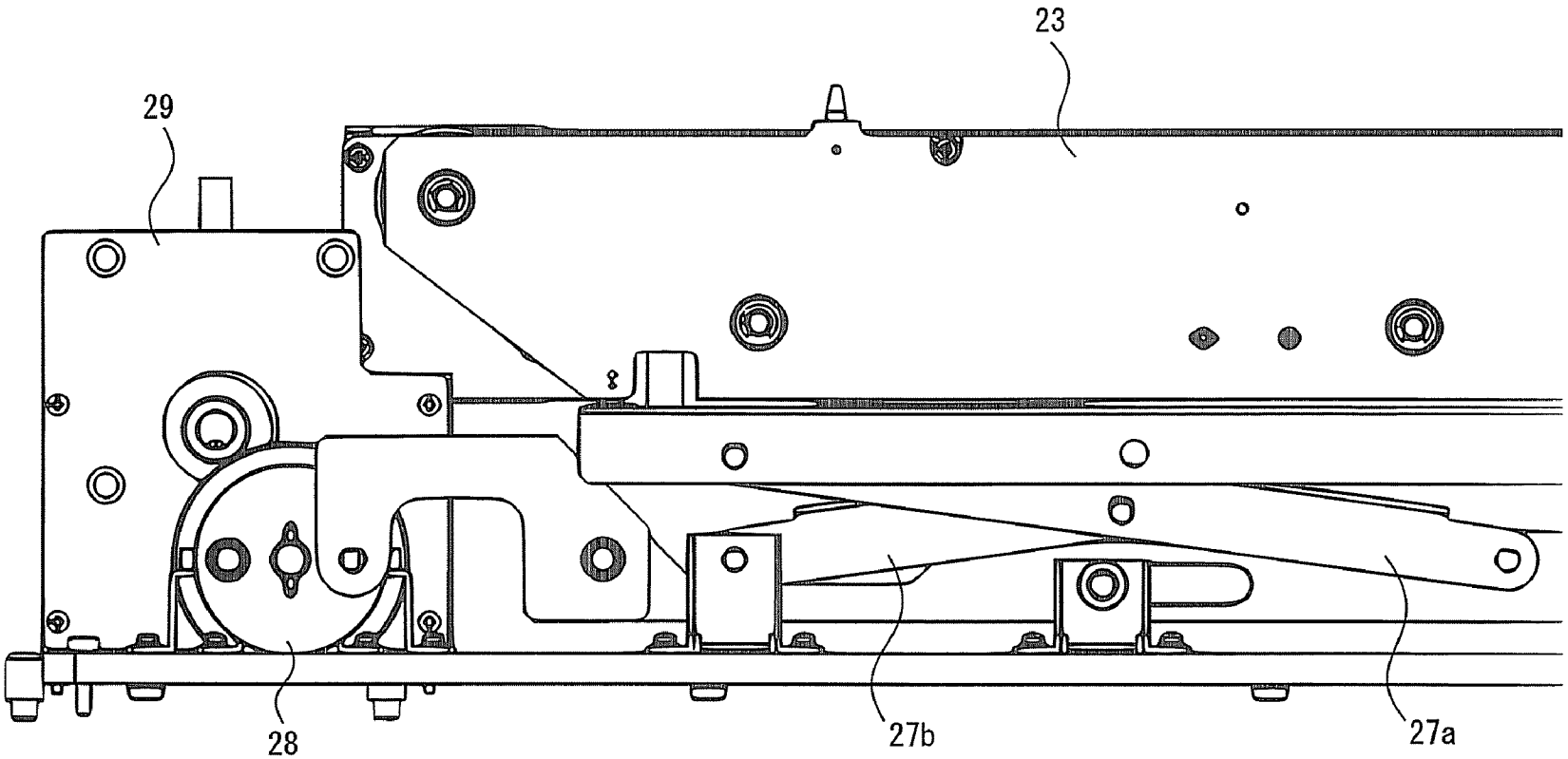
FIG. 15 is a diagram for explaining the configuration of the moving unit of the media conveying unit 20.

The moving unit 20*b* is explained with reference to FIGS. 2 and 13 to 15. The moving unit 20*b* includes a supporting unit 26 configured to support the conveying unit 20*a*, a link mechanism configured to elevate the supporting unit 2*b* (including an elevating link long arm 27*a*, an elevating link short arm 27*b*, an elevating link 27*c*, and an elevating sub-link 27*d*), a link support stand 27*e*, a link guide 27*f*, a link driving cam 28 configured to drive the link mechanism, and a driving unit 29 configured to actuate the link driving cam 28 (FIGS. 13 to 15).

The configuration of the head mounting unit 30 is explained below with reference to FIGS. 2 and 16 to 19.

Figure 16:
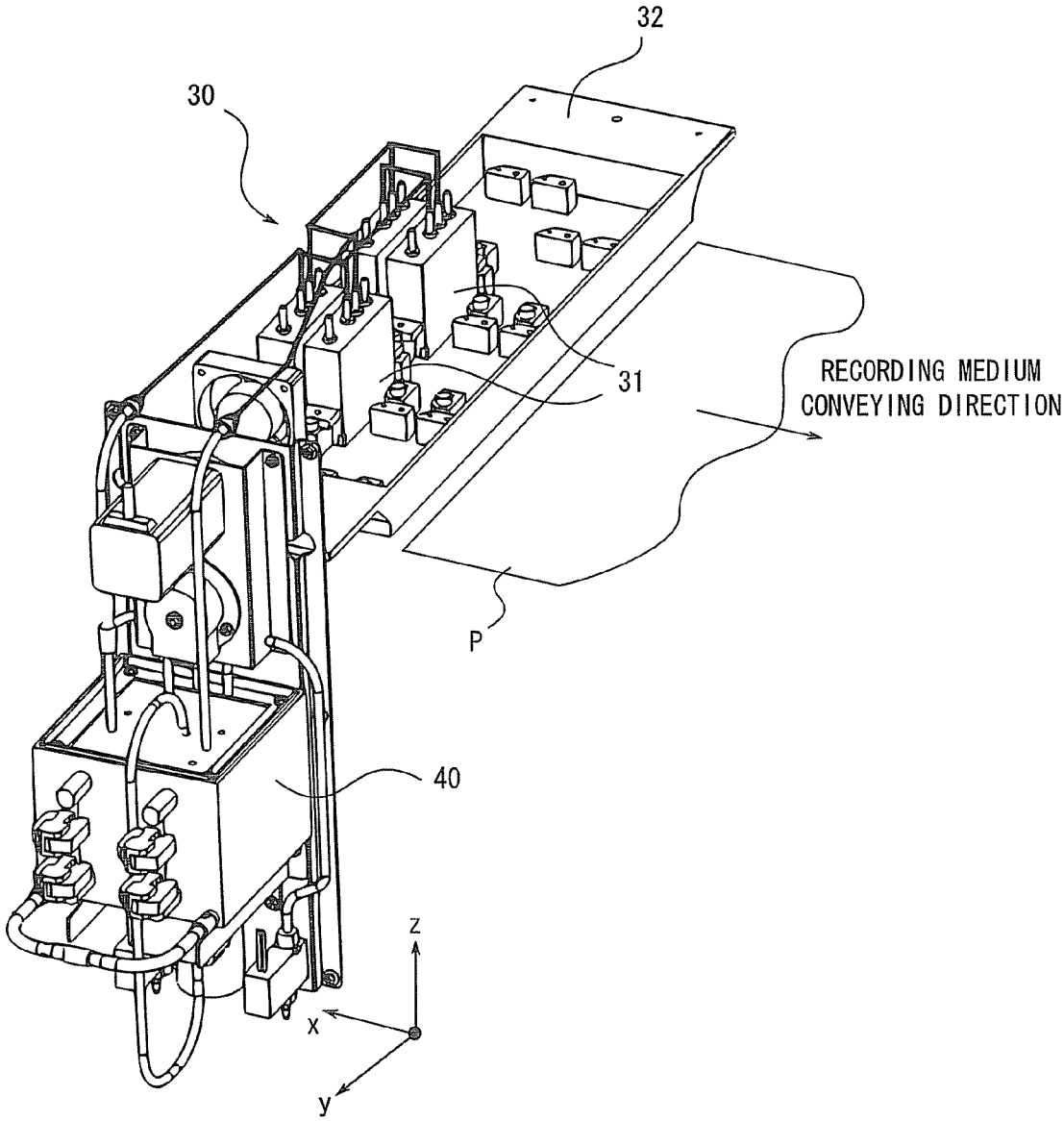
FIG. 16 is a diagram for explaining the configuration of a head mounting unit 30.
Figure 17:
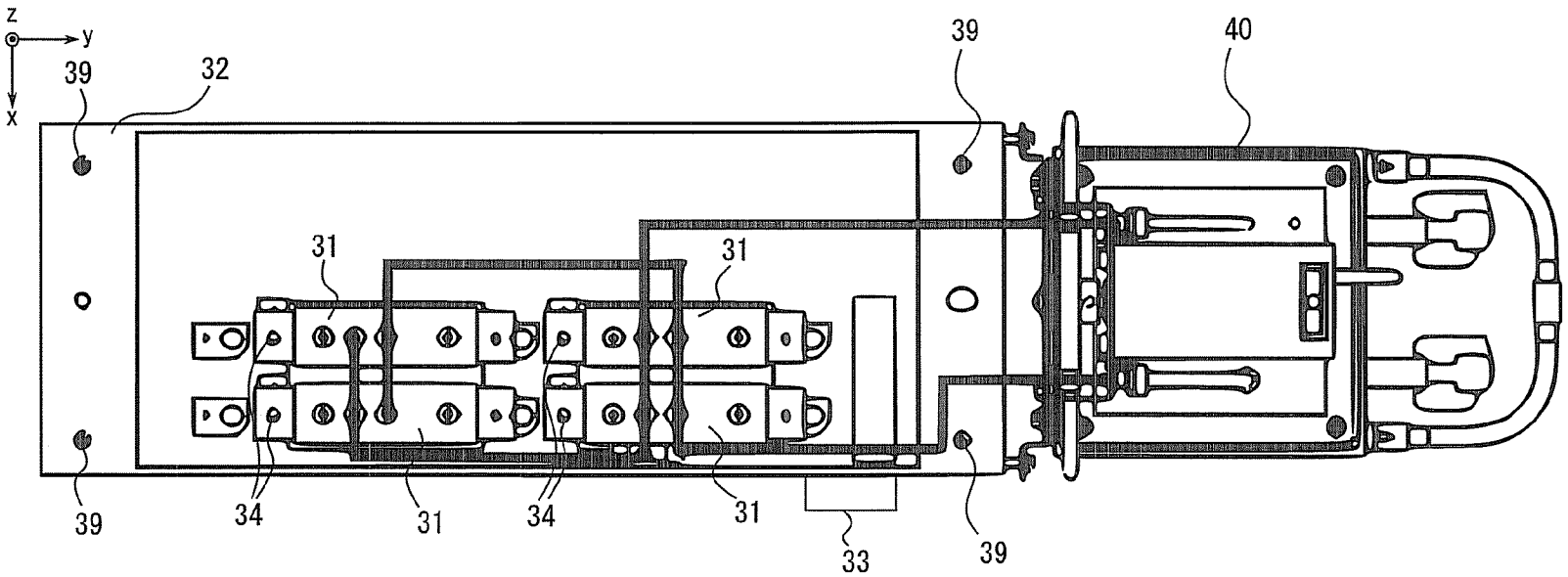
FIG. 17 is a diagram for explaining the configuration of the head mounting unit 30.
Figure 18:
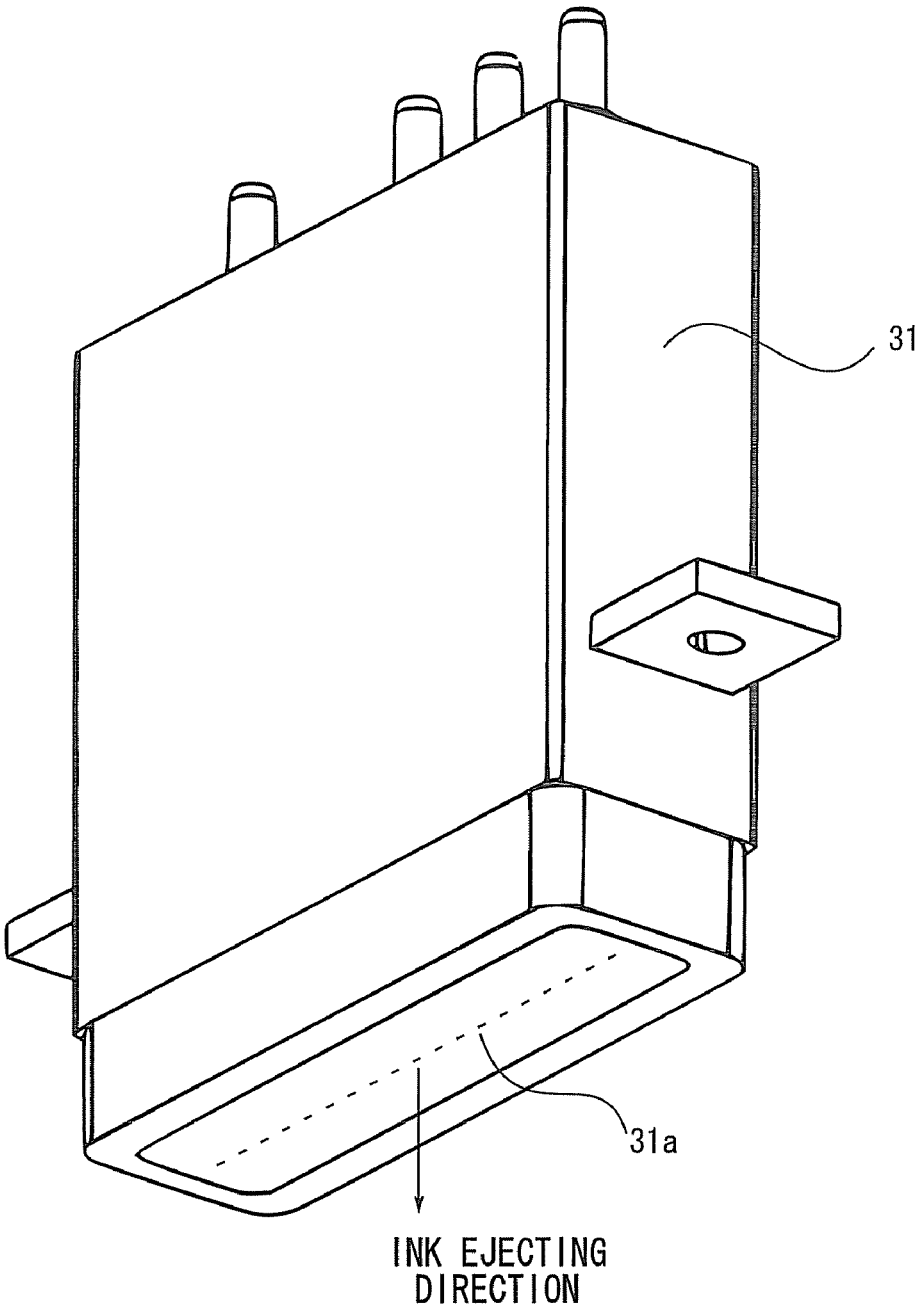
FIG. 18 is a perspective view of details around nozzles of a head 31.

Plural heads (arranged in order of a head 31P (for pretreatment liquid), a head 31C (for cyan), a head 31M (for magenta), a head 31Y (for yellow), and a head 31K (for black) from an upstream side) configured to eject inks (equivalent to ejection liquids) of colors different from one another are mounted on the head mounting unit 30 located above the media conveying unit 20. In FIGS. 16 and 17, only one head is shown because the heads 31P, 31C, 31M, 31Y and 31K have the same structure and is represented as head 31.

The head mounting unit 30 includes one or plural heads 31, a necessary number of which depends on an image forming range, resolution, the number of colors, and the like, a head base 32 configured to fix the head(s) 31, and a sensor 33 configured to detect the recording medium P (FIGS. 16 and 17). One ink supplying unit 40 is provided for one head base 32. The head 31 includes a nozzle unit 31*a* opposed to the media conveying surface of the conveyor belt 21 and having formed therein plural nozzle holes for ink ejection (FIG. 18) and an ejecting mechanism configured to cause the nozzle unit 31*a* to eject ink. The head 31 causes droplets as ink compositions to fly from fine head nozzles to the recording medium P conveyed by the conveying unit 20*a* and forms an image on the recording medium P. The head mounting unit 30 is guided by a not-shown linear guide or the like to be capable of moving integrally with the maintenance unit 50 in a direction orthogonal to the conveying direction of the recording medium P.

If the head mounting unit 30 is mounted with plural heads, the respective heads are fixed to the head base 32 by screws 34, in which spring washers are built, such that adjusted relative positions among the heads can be maintained. When a plurality of the head bases 32 are arranged, to adjust relative positions among the head bases 32, the respective head bases 32 are fixed to an image forming apparatus main body by the spring washers 34 in the same manner as when the relative positions among the heads are adjusted. Details of a method of adjusting the relative positions among the heads are explained later.

Figure 19:
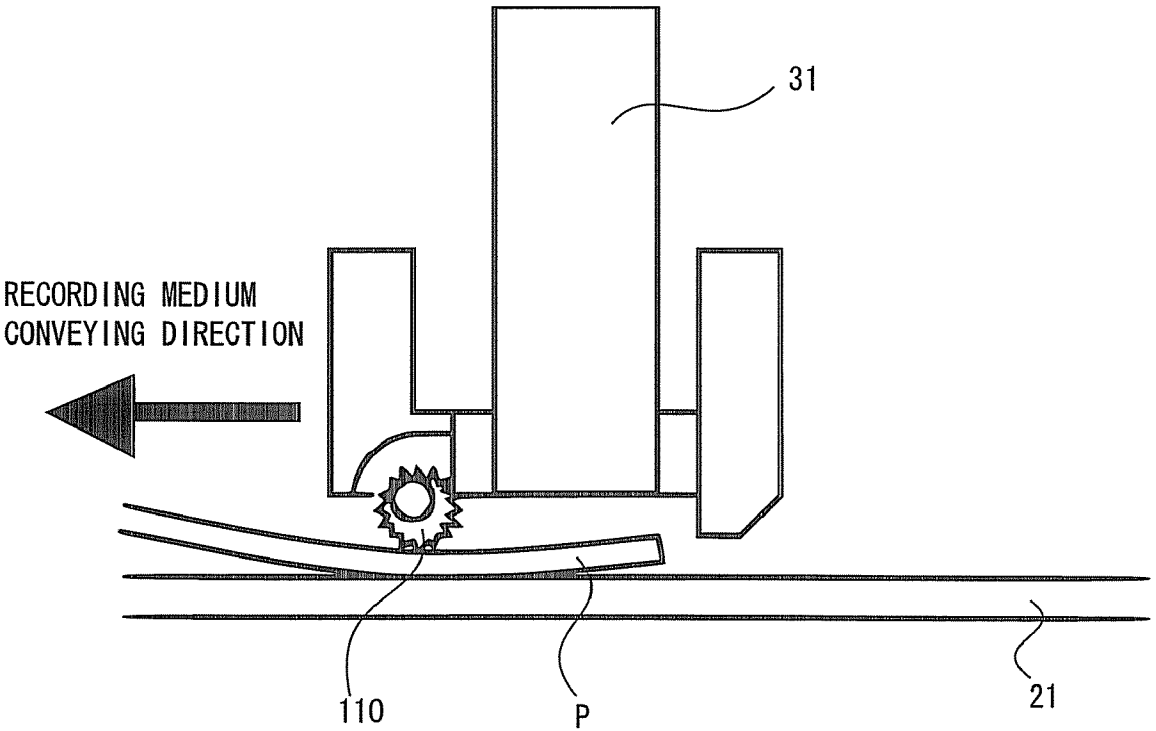
FIG. 19 is a diagram of an arrangement example of a star wheel provided near the head 31.

On a side opposed to the recording medium P of the head base 32, as shown in FIG. 19, a star wheel 110 rotatable in parallel to the conveying direction of the recording medium P is provided near a downstream side of the head 31 in the conveying direction of the recording medium P. To prevent abrasion of and damage to the media conveying unit 20, the star wheel 110 is arranged in a position where the star wheel 110 does not come into contact with the media conveying unit 20. The recording medium P conveyed by the media conveying unit 20 is prevented from colliding with the head 31 by providing the star wheel 110 in this way.

In the image forming apparatus according to this embodiment, as an example, a "piezo type" is adopted as the ink ejecting mechanism for the head 31. In the head 31 that performs ink ejection with the "piezo type", an ink channel is formed by a piezo element having a piezoelectric effect and a peripheral wall. An electric current is fed to the piezo element, whereby the piezo element is deformed and ink is ejected from the nozzle unit 31*a* according to a pumping action based on the deformation. Naturally, a so-called "thermal type" can also be adopted as another ink ejection type. In the "thermal type", ink is heated and film-boiled by a heater provided in an ink channel. A pressure change is caused in the ink by growth or contraction of air bubbles due to the film boiling. The ink is ejected from the nozzle unit 31*a* by the pressure change, whereby an ink image is formed on the recording medium P.

The ink supplying unit 40 configured to supply ink to the head 31 is explained below with reference to FIGS. 20 to 23.

Figure 20:
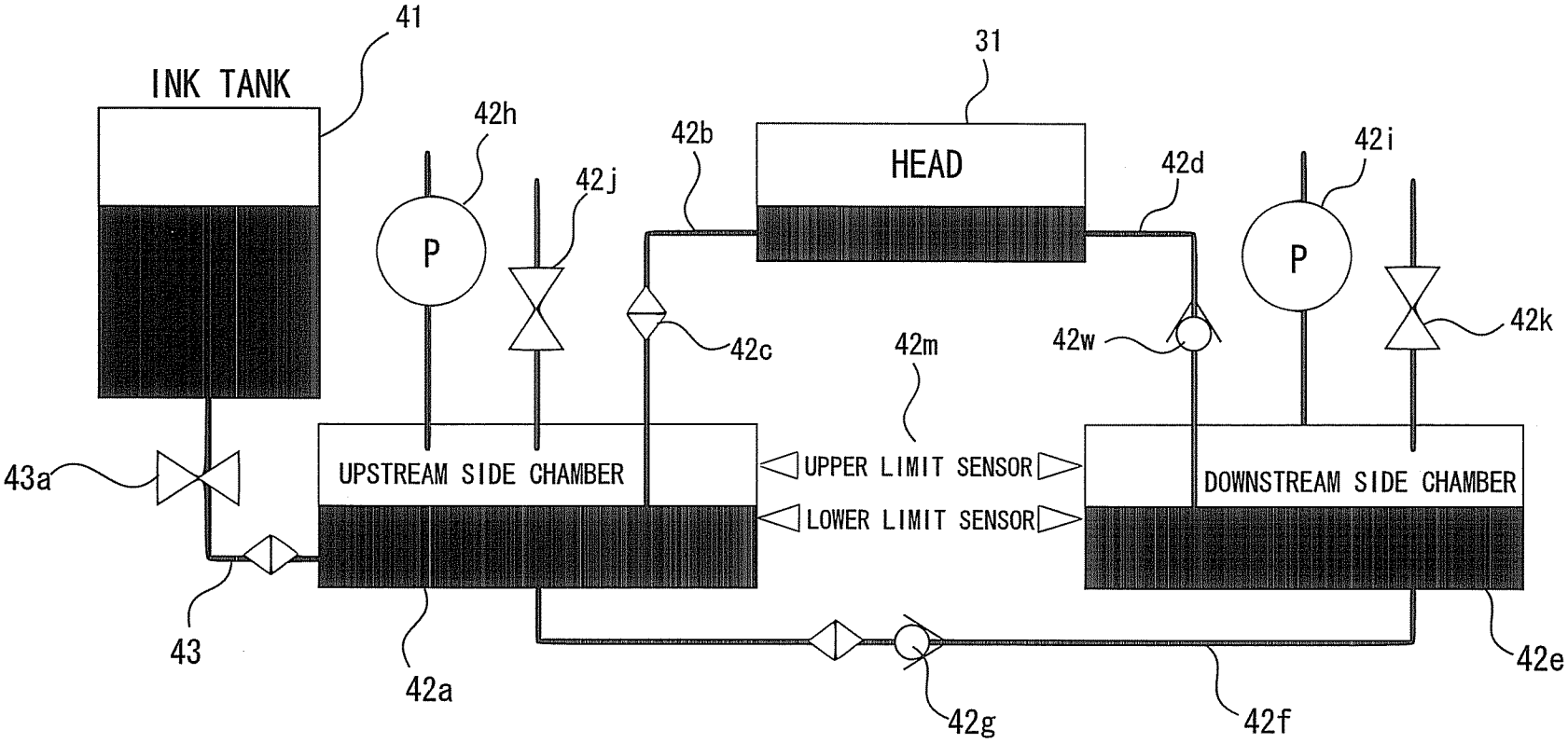
FIG. 20 is a diagram for explaining an ink supplying system configured to supply ink to the head 31.

FIG. 20 is a diagram of an ink supplying block in the image forming apparatus according to the embodiment. The ink supplying unit 40 includes an ink tank 41 configured to store ink, a supplying unit 42 (including an upstream side chamber 42*a*, an upstream-side conveyance tube 42*b*, a filter 42*c*, a downstream-side conveyance tube 42*d*, a downstream side chamber 42*e*, a return conveyance tube 42*f*, a one-way valve 42*g*, an upstream side pump 42*h*, a downstream side pump 42*i*, an upstream-side atmosphere relief valve 42*j*, a downstream-side atmosphere relief valve 42*k*, a sensor 42*m*, and a one-way valve 42*w* explained later) configured to receive the supply of the ink from the ink tank 41 and supply the ink to the head 31, and a lead-in unit 43 configured to lead in the ink from the ink tank 41. The lead-in unit 43 is made of a tube or a member equivalent to the tube. A valve 43*a* that can be opened and closed at will is provided in a channel of the lead-in unit 43. The upstream side and the downstream side are defined with reference to a flowing direction of the ink. The upstream side may be defined as front and the downstream side may be defined as rear.

The upstream side chamber 42*a* temporarily stores the ink, which is supplied from the ink tank 41 to the head 31 (ejection liquid that should be supplied to the head 31), before the ink is supplied to the head 31.

The filter 42*c* is provided in the front conveyance tube 42*b* between the upstream side chamber 42*a* and the head 31 (between the upstream side chamber 42*a* and the head 31 in a circulating path). The filter 42*c* has a function of a backflow suppressing mechanism for allowing a flow from the upstream side chamber 42*a* to the head 31 and suppressing a flow from the head 31 to the upstream side chamber 42*a*.

The downstream-side conveyance tube 42*d* conveys, through the head 31, the ink discharged from the head 31.

The downstream side chamber 42*e* (a rear chamber) temporarily stores the ink discharged from the head 31.

The return conveyance tube 42*f* returns the ink from the downstream side chamber 42*e* to the upstream side chamber 42*a*.

The one-way valve 42*g* is provided in the return conveyance tube 42*f* (between the rear chamber 42*e* and the upstream side chamber 42*a* in the circulating path) and has a role of an "inter-chamber-backflow preventing mechanism".

The one-way valve 42*w* is provided in the rear conveyance tube 42*d* (between the head 31 and the downstream side chamber 42*e* in the circulating path) and has a role of a "head-downstream side-backflow preventing mechanism" for preventing a backflow of the ink from the downstream side chamber 42*e* side to the head 31.

The upstream side pump 42*h* (equivalent to an upstream-side positive-pressure applying unit) applies positive pressure into the upstream side chamber 42*a* and performs operation for forcibly feeding the ink into the head 31 such as purge.

The downstream side pump 42*i* (equivalent to the downstream-side positive-pressure applying unit and a downstream-side negative-pressure applying unit) compresses and decompresses the downstream side chamber 42*e*.

The upstream side atmosphere relief valve 42*j* has a role of switching a state in which the upstream side chamber 42*a* is opened to the atmospheric pressure and a state in which the upstream side chamber 42*a* is shielded from the atmosphere.

The upstream-side atmosphere relief valve 42*k* has a role of switching a state in which the downstream side chamber 42*e* is opened to the atmospheric pressure and a state in which the downstream side chamber 42*e* is shielded from the atmosphere.

The sensor 42*m* includes an upper limit sensor and a lower limit sensor configured to detect liquid surfaces of inks in the upstream side chamber 42*a* and the downstream side chamber 42*e*.

In this embodiment, as an example, functions of the downstream-side positive-pressure applying unit and the downstream-side negative-pressure applying unit are realized by the single downstream side pump 42*i*. However, pumps respectively corresponding to the downstream-side positive-pressure applying unit and the downstream-side negative-pressure applying unit may be separately provided.

The upstream-side conveyance tube 42*b*, the downstream-side conveyance tube 42*d*, and the return conveyance tube 42*f* configure the "circulating path", collect ejection liquid not ejected and remaining in the head 31, and circulate and supply the ejection liquid to the head 31 again.

In this embodiment, as an example, a tube pump is adopted as the pump. However, the pump is not always limited to this and various kinds of pumps such as a diaphragm pump can also be adopted. An open end of a chamber of the pump is prevented from touching the liquid surface.

In this embodiment, as an example, an optical sensor employing an infrared ray is adopted as the sensor 42*m*. However, sensors employing other systems (a mechanical system by float, etc.) may be adopted as long as the liquid surface can be detected.

The configuration of the maintenance unit 50 is explained below with reference to FIGS. 24 to 29.

The maintenance unit 50 includes a maintenance main body unit 51 configured to perform actual maintenance and a maintenance driving unit 52 configured to move the entire maintenance main body unit 51.

The maintenance unit 50 performs, as maintenance operation, "purge operation" for forcibly ejecting ink from the head 31, "suction operation" for sucking the purged ink, "wipe operation" for wiping the vicinity of the nozzles of the head 31 where the ink is sucked, and "cap operation" for closing the vicinity of the nozzles to prevent drying of the nozzles of the head 31 cleaned by the purge operation, the suction operation, and the wipe operation.

Figure 25:
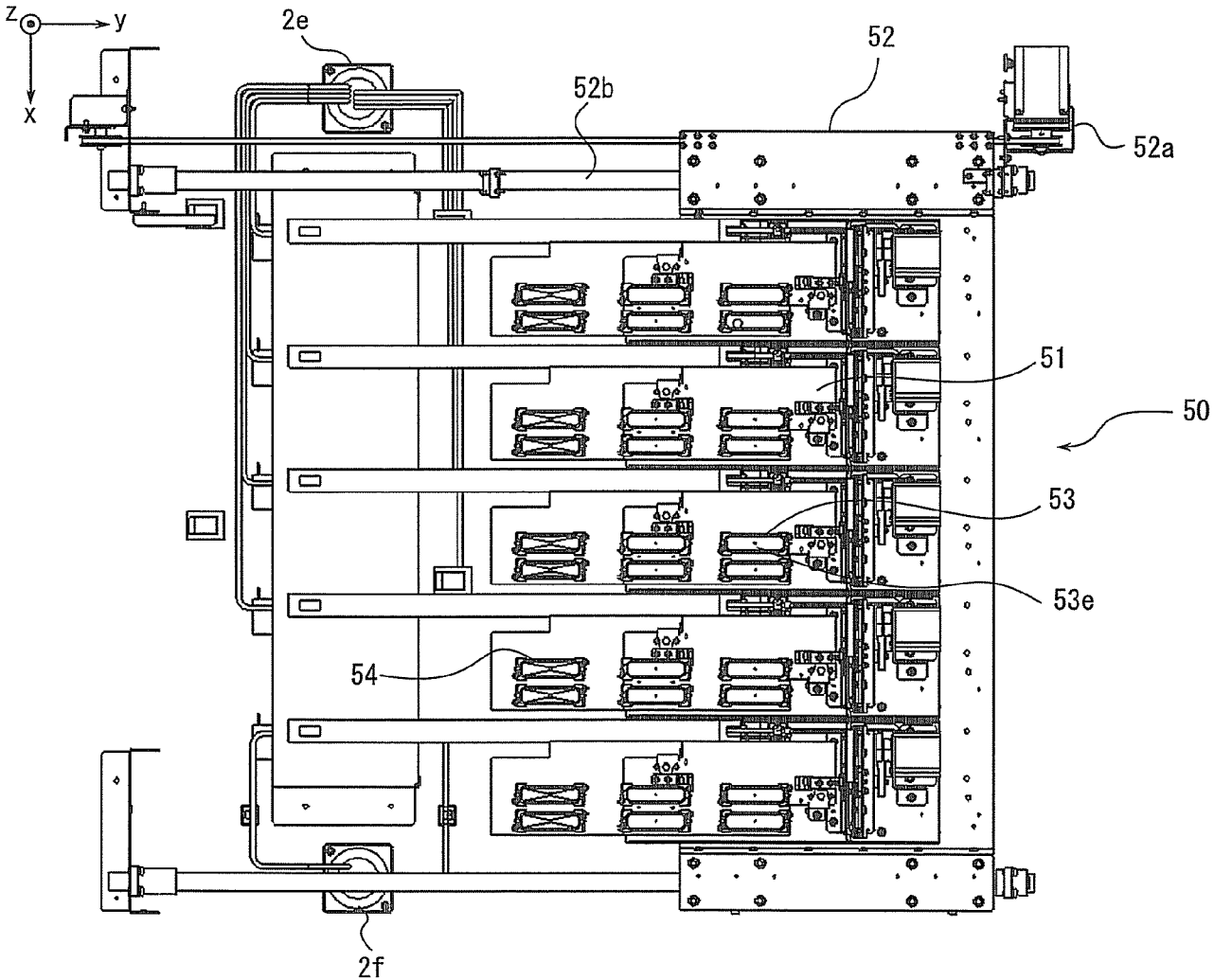
FIG. 25 is a diagram for explaining the configuration of the maintenance unit 50.
Figure 26:
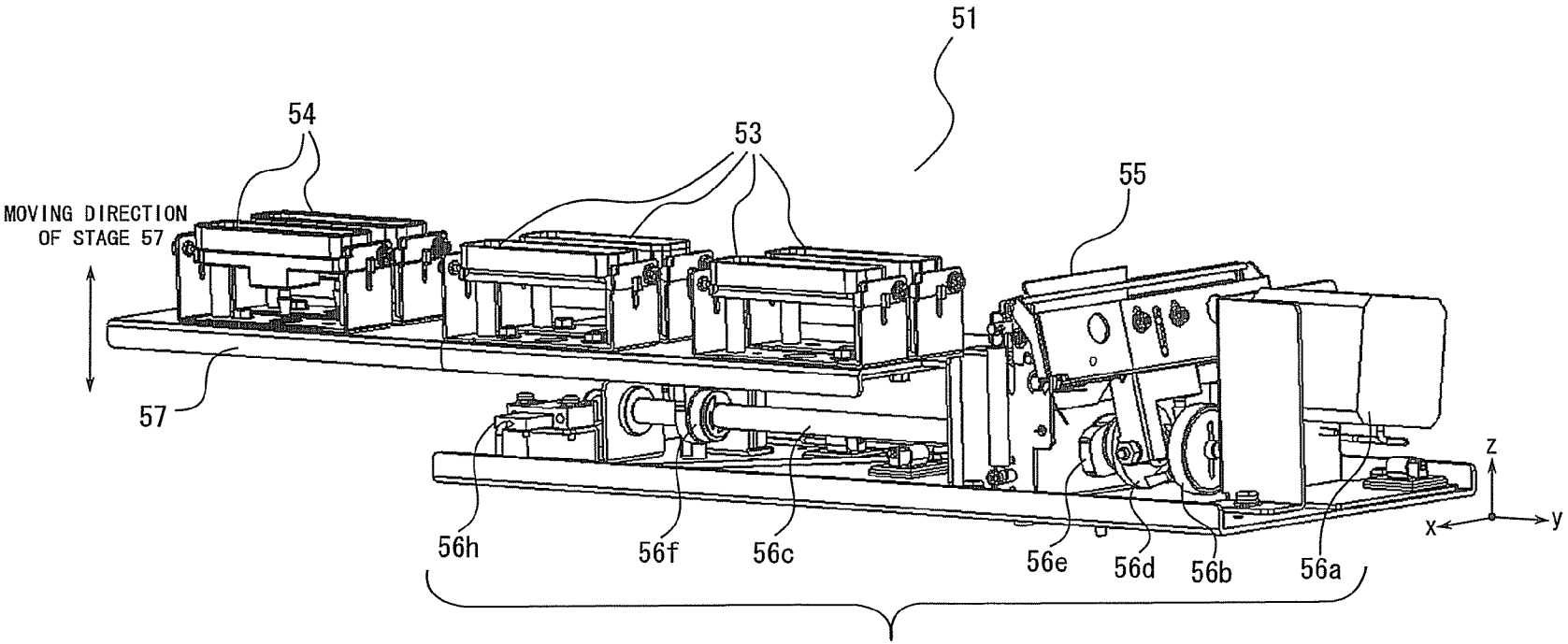
FIG. 26 is a diagram for explaining the configuration of the maintenance unit 50.
Figure 27:
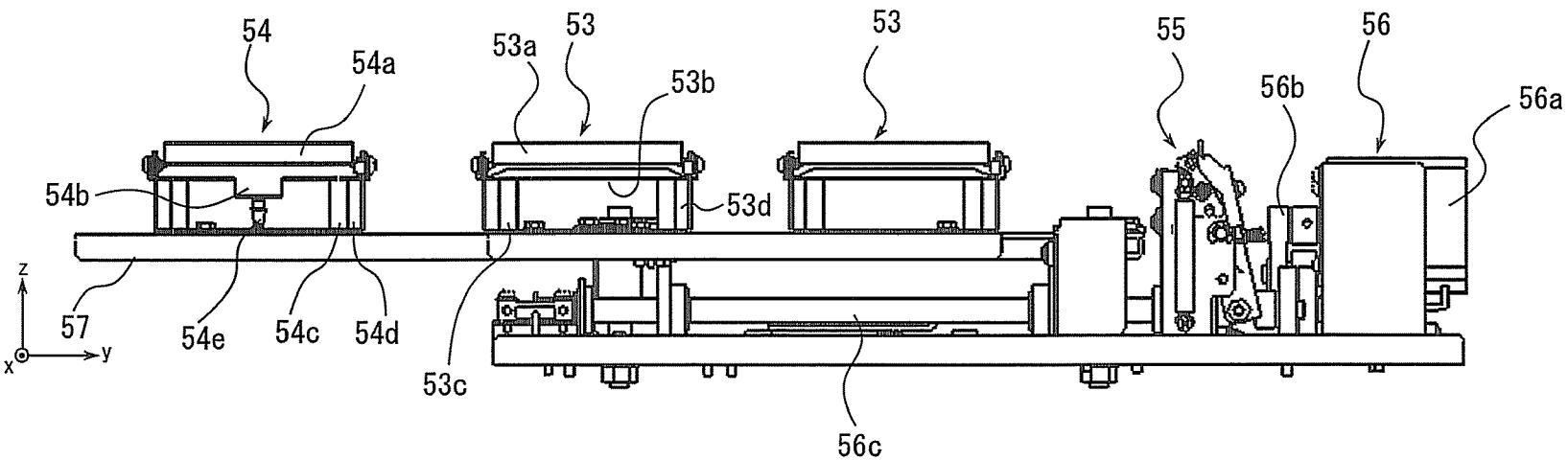
FIG. 27 is a diagram for explaining the configuration of the maintenance unit 50.
Figure 28:
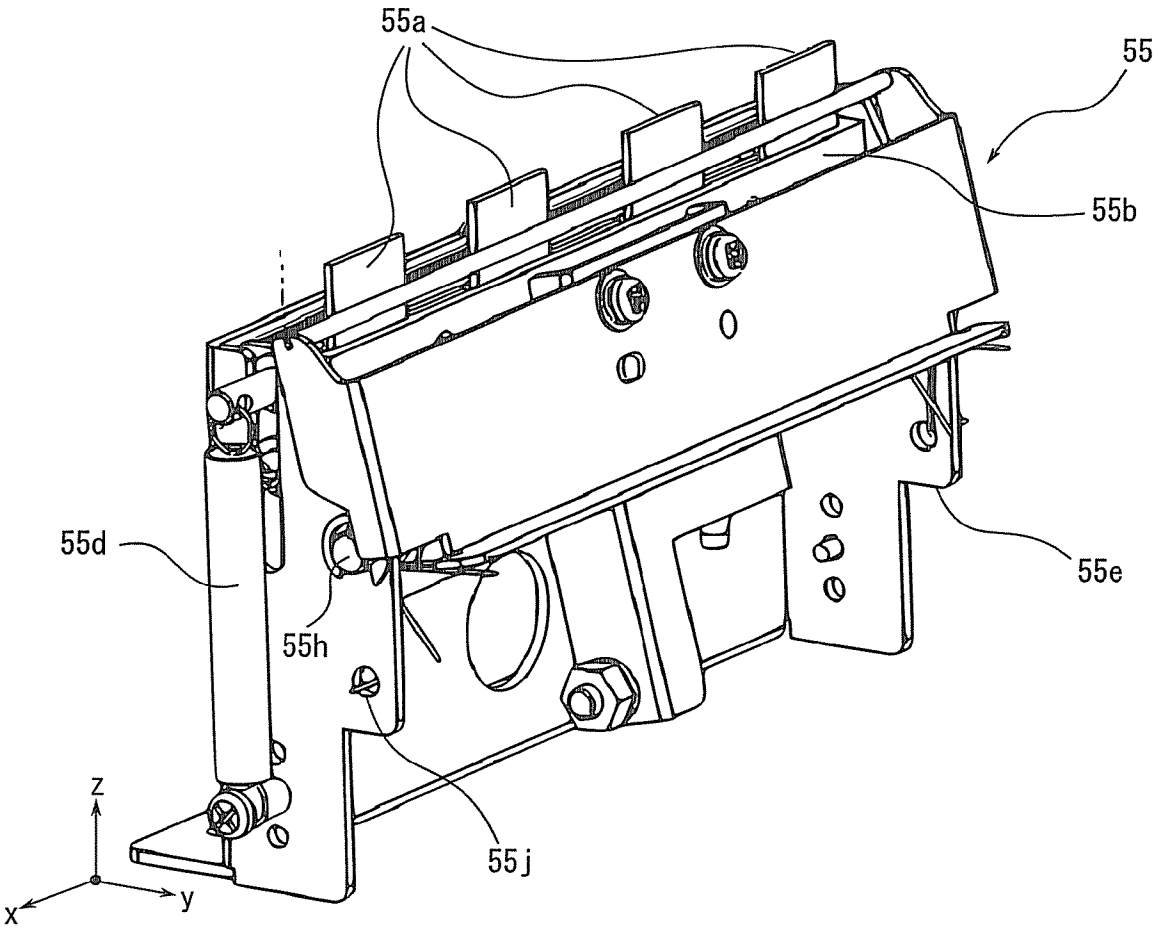
FIG. 28 is a diagram for explaining the configuration of a wipe unit.
Figure 29:
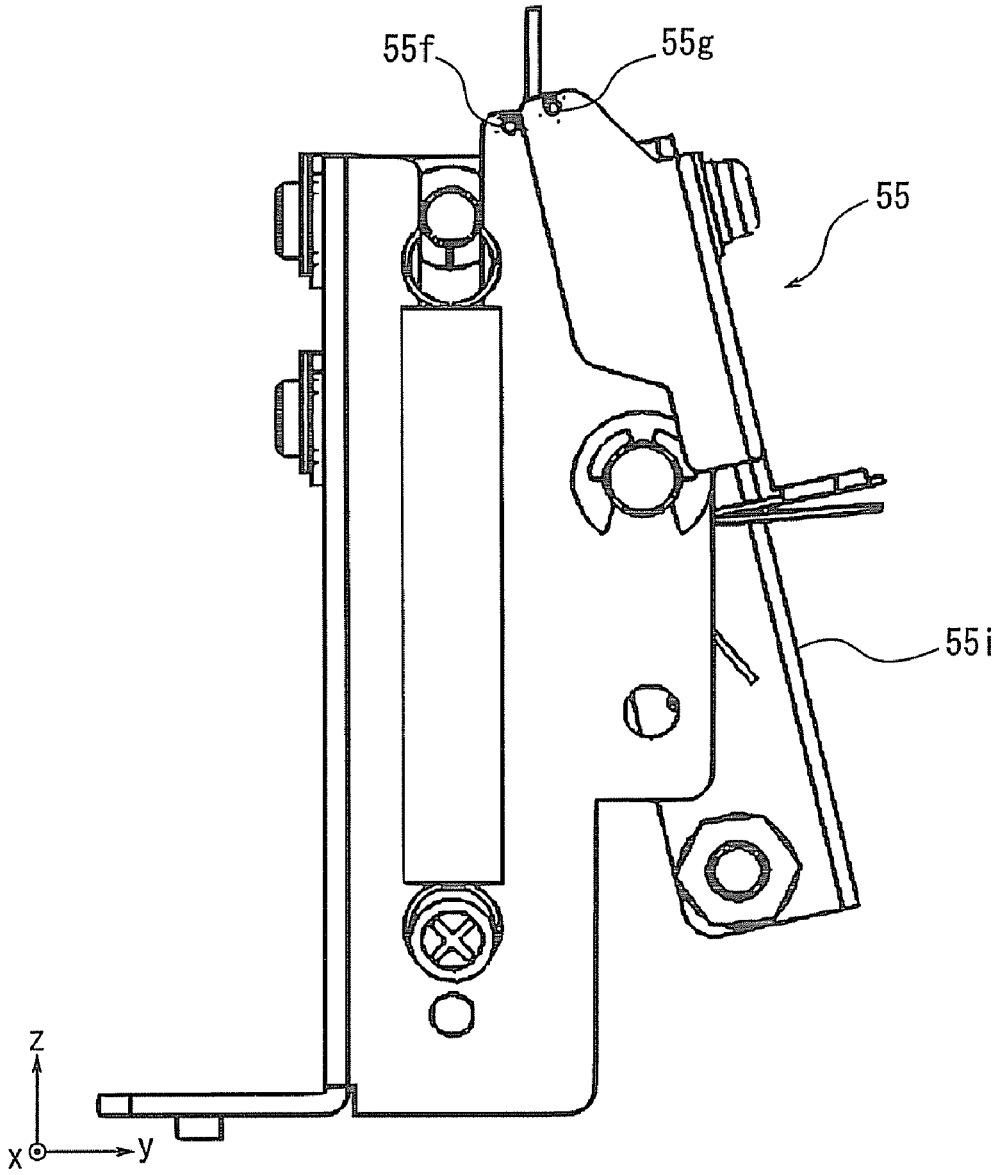
FIG. 29 is a diagram for explaining the configuration of the wipe unit.

The maintenance main body unit 51 includes a cap unit 53 configured to close the head 31, a suction unit 54 configured to suck ink purged by the head 31, a wipe unit 55 configured to wipe away the ink adhering to the head 31 after the purging, and a cam mechanism unit 56 configured to actuate the units. The cap unit 53 and the suction unit 54 are arranged on the same stage 57 and integrally perform up to down motion (FIGS. 25 and 26).

The configuration of the maintenance main body unit 51 is explained in detail below with reference to FIGS. 26 to 29.

The cap unit 53 includes a rubber unit 53*a* set in contact with the head 31, a main body unit 53*b* configured to fix the rubber unit 53*a*, a spring unit 53*c* configured to press the rubber unit 53*a* and the main body unit 53*b* against the head 31 with appropriate pressing force, and a supporting unit 53*d* configured to slide the cap unit 53 up and down.

In the main body unit 53*b*, an atmosphere communication hole unit for causing the outside air and the inside of the cap unit 53 to communicate with each other is formed in a capping state in which the nozzles of the head 31 are closed. The atmosphere communication hole unit is provided for the purpose of preventing, in a state in which nozzle surfaces of the head 31 are capped by the cap unit 53, a deficiency in which, for example, the pressure in the cap unit 53 changes because of a temperature change or the like and meniscuses held by small negative pressure on gas-liquid interfaces of orifices of the nozzles of the head 31 are broken.

The suction unit 54 includes a rubber unit (a lip unit) 54*a* set in contact with the head 31, a main body unit 54*b* configured to fix the rubber unit 54*a*, a spring unit 54*c* configured to press the rubber unit 54*a* and the main body unit 54*b* against the head 31 with appropriate pressing force, a supporting unit 54*d* configured to slide the suction unit 54 up and down, and a tube 54*e* configured to suck ink.

The suction unit 54 can also be realized by providing a suction function in the cap unit 53 of a capping mechanism for protecting an ink ejecting unit. With such a configuration, the cap unit 53 and the suction unit 54 are integrally formed. The nozzle surfaces of the head 31 can also be capped by the cap unit 53 that realizes a part of the suction function.

The wipe unit 55 includes blades 55*a* arranged in each of head rows and configured to wipe away ink, a block 55*b* configured to move up and down integrally with the blades 55*a*, a fixing plate 55*c* configured to fix the blades 55*a*, a spring 55*d* configured to always apply force downward, a supporting unit 55*e* configured to slide the wipe unit 55 in the up to down direction, a fixed shaft 55*f* and a movable shaft 55*g* configured to rub the wiped-away ink, a movable unit 55*i* configured to support the movable shaft 55*g* and perform rotational motion around a fulcrum shaft 55*h*, and a spring 55*j* configured to apply force to the movable unit 55*i* in a direction in which the movable unit 55*i* retracts to the opposite side of the blades 55*a*.

The cam mechanism unit 56 (equivalent to the contact and separation mechanism) includes a driving source motor 56*a*, a deceleration mechanism unit 56*b*, a shaft 56*c* configured to integrally rotate cams, a solid cam 56*d* configured to actuate the movable unit 55*i* of the wipe unit 55, a plane cam 56*e* configured to move the blades 55*a* of the wipe unit 55 up and down, a plane cam 56*f* configured to move a stage 57 up and down, and a sensor 56*g* and a sensor 56*h* configured to perform position detection for the cams. Specifically, the cams 56*d*, 56*e*, and 56*f* cause the blades 55*a* to perform cleaning operation, wipe operation, and cap (suction) operation. The suction operation is equivalent to sucking operation.

Figure 24:
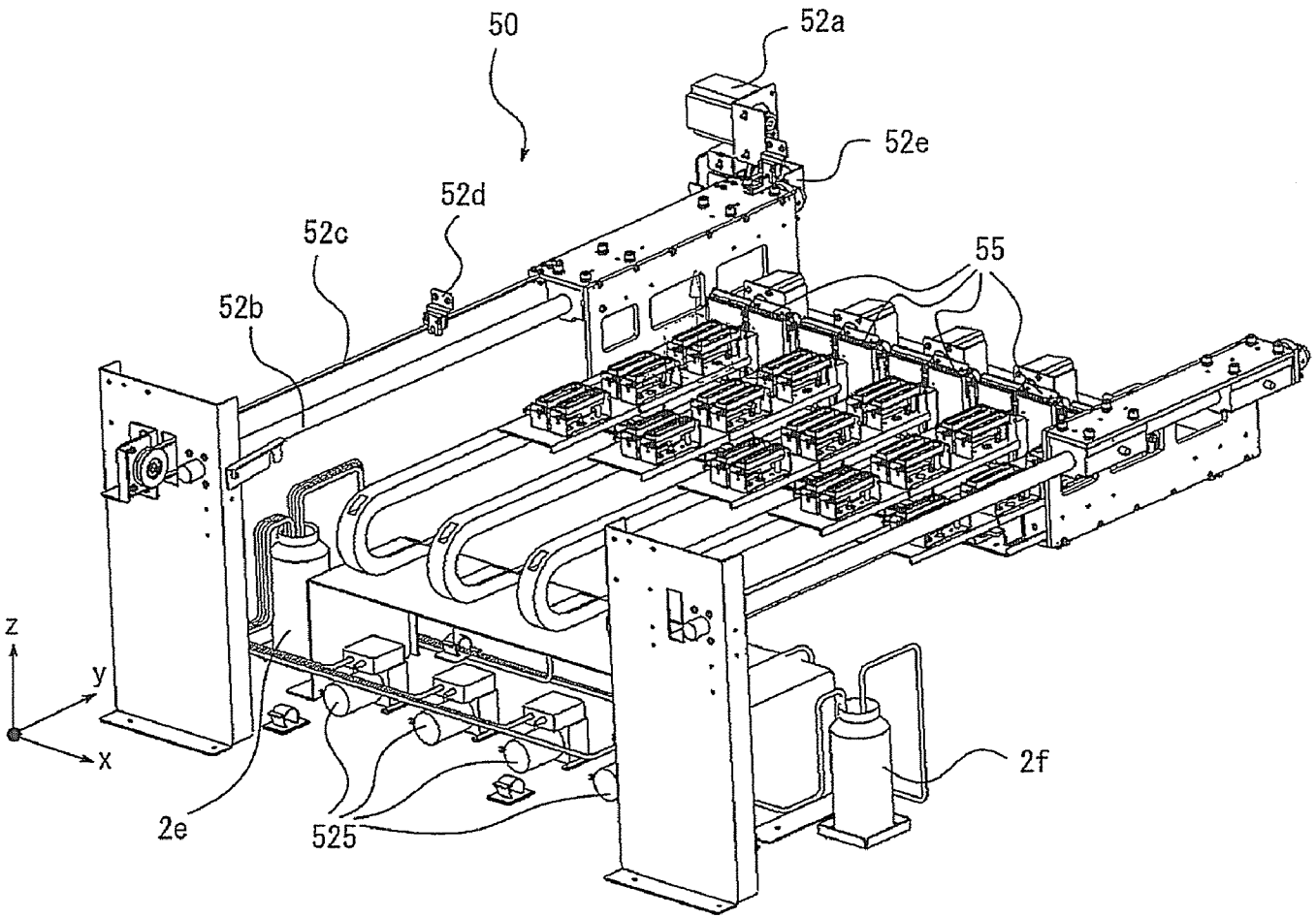
FIG. 24 is a diagram for explaining the configuration of a maintenance unit 50.

The maintenance driving unit 52 includes a driving source motor 52*a*, a linear shaft 52*b* configured to suspend the entire maintenance main body unit 51, a driving belt 52*c* configured to move the maintenance main body unit 51, a position detection sensor 52*d*, and a position detection sensor 52*e* (FIGS. 24 and 25). The maintenance, unit 50 further includes a suction pump 52*f*, a waste ink tank 2*e* configured to store waste ink, and a waste pretreatment liquid tank 2*f* configured to store waste pretreatment liquid.

The overall operation in the image forming apparatus according to the embodiment is schematically explained below.

When the control unit 90 issues a print instruction based on image data stored in a storage area of the image forming apparatus or image data acquired from an external apparatus by the image forming apparatus, the maintenance unit 50 retracts from an ejection surface of the head 31. After the maintenance unit 50 retracts, the media conveying unit 20 is moved to an image forming position by the moving unit 20*b*. Thereafter, sheet-like recording media P are picked up one by one from any one of the media storing units 80*a* to 80*d* and fed to the media conveying unit 20 through the media feeding unit 60 (equivalent to registration rollers). The recording medium P to be fed to the media conveying unit 20 is passed to the media conveying unit 20 with adjustment of conveyance timing and skew correction applied thereto in the media feeding unit 60.

When the recording media P reaches the media conveying unit 20, the recording medium P is attracted to the conveyor belt 21 (see FIGS. 7 and 8) of the media conveying unit 20 by an action of negative pressure. The recording medium P attracted to the conveyor belt 21 is conveyed in an arrow direction below the heads 31P to 31K according to the movement of the belt surface of the conveyor belt 21 while keeping a fixed space between the recording medium P and the heads 31P to 31K. The sensor 33 of the head mounting unit 30 detects the passage of the recording medium P and transmits a detection signal to the control unit 90.

When predetermined time elapses from the reception of the detection signal, the control unit 90 determines that the recording medium P reaches a predetermined position with respect to the head 31 and drives the head 31 with a control signal. The driven head 31 ejects ink and forms an image in a desired position on the recording medium P. The recording medium P having the image formed thereon is further conveyed by the conveyor belt 21, passes the media discharge unit 70, and is discharged to the outside of the apparatus.

When the image formation processing ends, the media conveying unit 20 is retracted from the front of the head 31 by the moving unit 20*b*. After the retraction of the media conveying unit 20, the maintenance unit 50 performs, on the basis of a predetermined sequence, maintenance for maintaining ink ejection performance of the head 31. After the maintenance ends, the nozzle surfaces 31*a* of the head 31 are closed by the maintenance unit 50 and waits for a print instruction.

The operation of the moving unit 20*b* is explained blow. The driving unit 29 is driven to rotate in a predetermined direction according to an operation signal emitted from the control unit 90. The cam driving shaft 29*b* and the link driving cam 28 rotate. The elevating sub-link 27*d* moves following the rotation of the link driving cam 28. However, since movement in the vertical direction is limited by the link guide 27*f*, the elevating link 27*c* horizontally moves. The fulcrum of the elevating link long arm 27*a* also horizontally moves following the horizontal movement of the elevating link 27*c*. At this point, the conveying unit 20*a* moves in the vertical direction together with the supporting unit 26 according to an action of the elevating link long arm 27*a* and the elevating link short arm 27*b*. With such a configuration, the conveyor belt 21 of the conveying unit 20*a* comes into contact with and separates from the head mounting unit 30 (FIGS. 2 to 5, 14, and 15).

Figure 21:
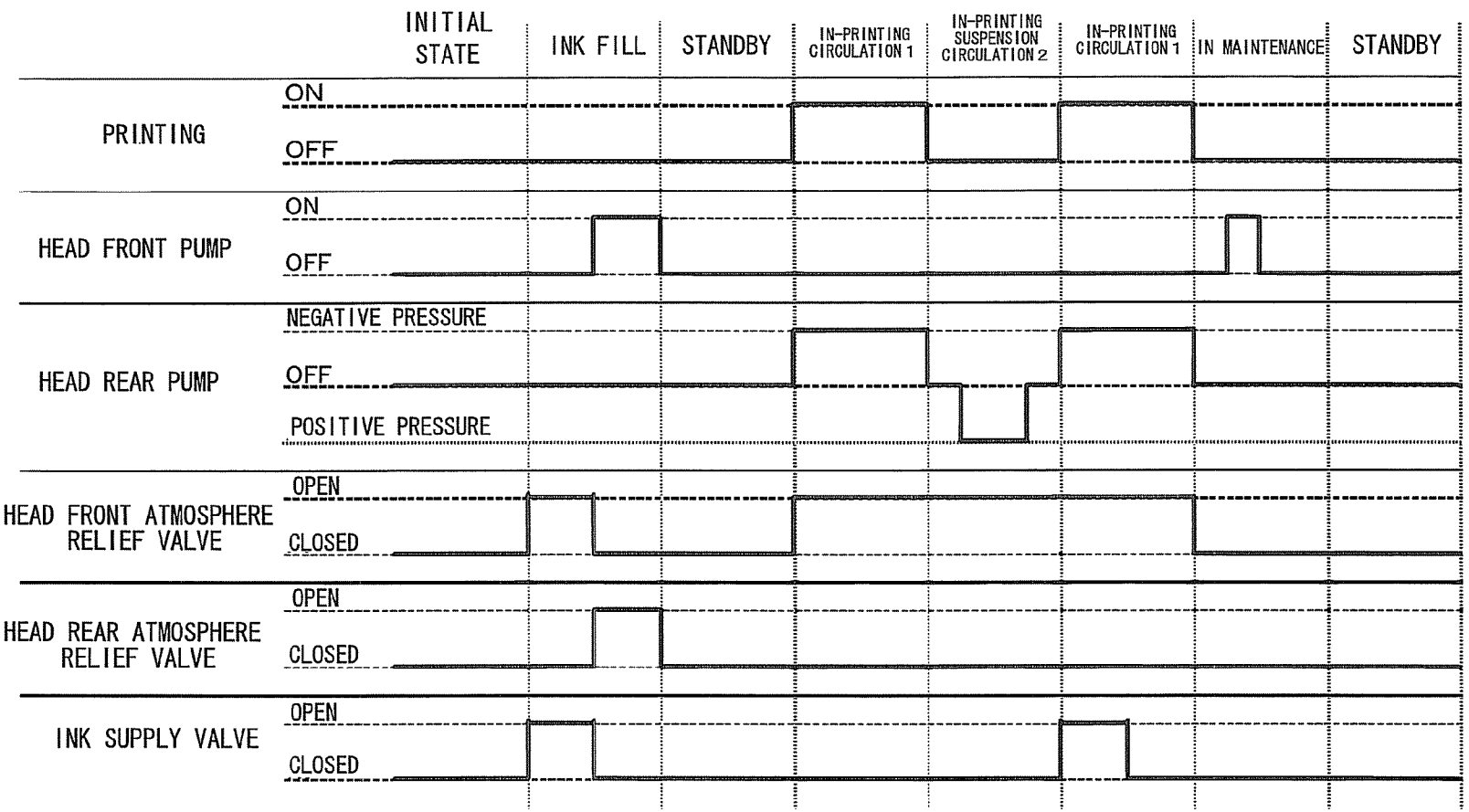
FIG. 21 is a diagram for explaining the ink supplying system configured to supply ink to the head 31.
Figure 22:
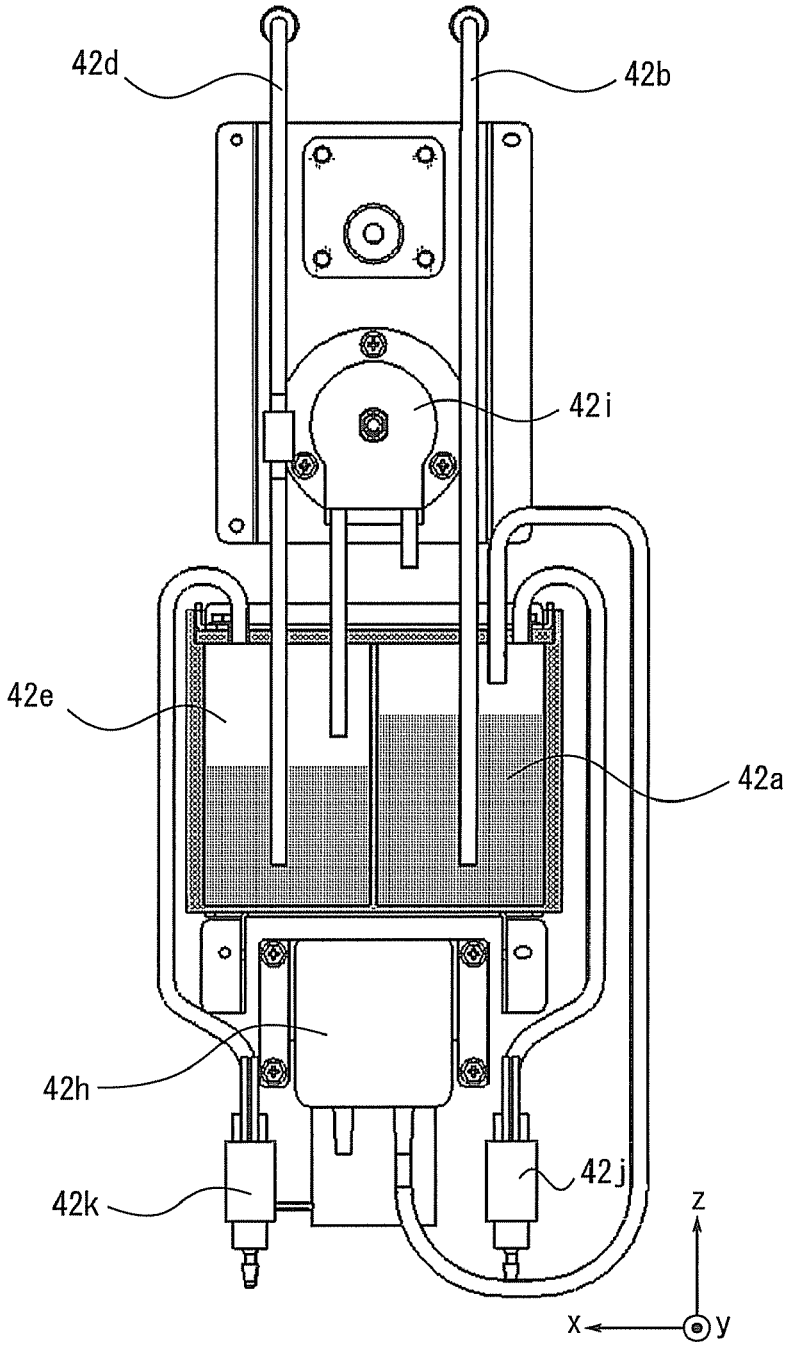
FIG. 22 is a diagram for explaining the ink supplying system configured to supply ink to the head 31.
Figure 23:
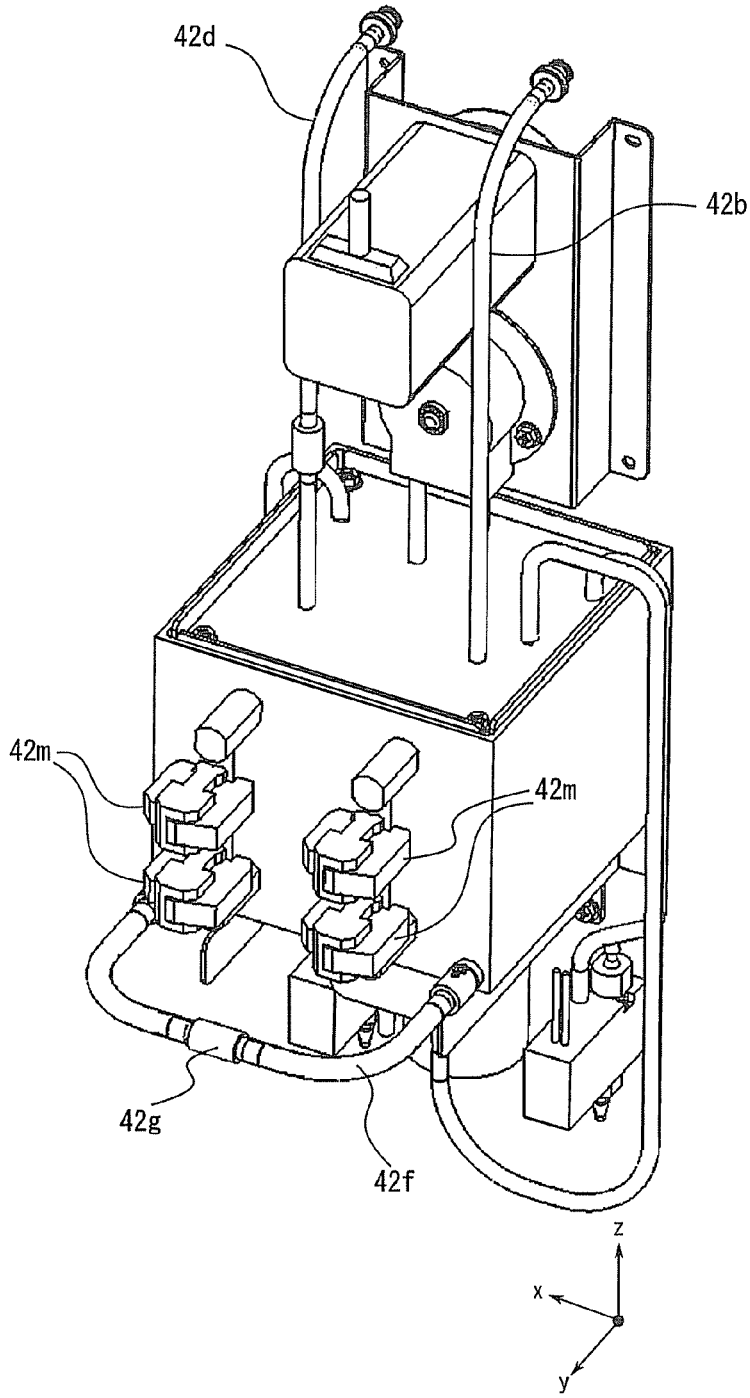
FIG. 23 is a diagram for explaining the ink supplying system configured to supply ink to the head 31.

The operation of an ink supplying system in the image forming apparatus according to this embodiment is explained below. FIG. 21 is a timing chart of the operation of the ink supplying system in this embodiment.

First, dunk ink filling, to supply ink to the ink supplying system, the control unit 90 (the pressure control unit) opens the upstream-side atmosphere relief valve 42*j* to set the pressure in the upstream side chamber 42*a* to the atmospheric pressure. At this point, when the ink supply valve 43*a* is opened, the pressure in the ink tank 41 becomes equal to the atmospheric pressure through an atmosphere communication port. Therefore, the ink is supplied from the ink tank 41 to the upstream side chamber 42*a* according to a water head difference between the ink in the ink tank 41 and the ink in the upstream side chamber 42*a*.

When the sensor 42*m* detects that an amount of ink in the upstream side chamber 42*a* reaches a proper amount, the control unit 90 (the pressure control unit) opens the downstream-side atmosphere relief valve 42K. The ink may be discharged to the outside of the upstream side chamber 42*a* by not only keeping the downstream-side atmosphere relief valve 42K opened but also by actuating the downstream side pump 42*i* to suck the ink to the downstream side chamber 42*e* side. It is also possible to, instead of causing only the downstream side pump 42*i* to suck the ink to the downstream side chamber 42*e* side, actuate the downstream side pump 42*i* to suck the ink to the downstream side chamber 42*e* side and actuate the upstream side pump 42*h* to apply positive pressure into the upstream side chamber 42*a*.

The one-way valve 42*g* is provided between the upstream side chamber 42*a* and the downstream side chamber 42*e*. The ink does not flow from the upstream side chamber 42*a* to the downstream side chamber 42*e* and, on the other hand, the ink always passes the head 31. Therefore, the ink is filled in the head 31.

At this stage, since the downstream-side atmosphere relief valve 42*k* is opened, the ink that finishes passing the head 31 flows into the downstream side chamber 42*e*. When the sensor 42*m* detects that an amount of ink in the downstream side chamber 42*e* reaches a proper amount, the control unit 90 (the pressure control unit) stops the upstream side pump 42*h* and the downstream side pump 42*i*. The initial filling of the ink is completed and the control unit 90 puts itself on standby.

When print operation is started, the control unit 90 (the pressure control unit) opens the upstream-side atmosphere relief valve 42*j*, causes the downstream side pump 42*i* to generate negative pressure in the downstream side chamber 42*e*, and causes the ink to flow from the upstream side chamber 42*a* into the downstream side chamber 42*e* through the head 31. Since the upstream-side atmosphere relief valve 42*j* is opened, negative pressure in the head 31 is properly kept and does not substantially affect printing performance in the head 31. The control unit 90 turns on print control at this timing.

When fine dust or air bubbles intrude into the head 31, since the dust or the air bubbles are washed away to the outside of the head 31 by the ink that flows through the head 31, even if print omission due to the dust or the air bubbles temporarily occurs, the head 31 recovers from the print omission soon.

When the amount of ink in the downstream side chamber 42*e* exceeds the proper amount, the control unit 90 suspends the print operation and sets the pressure in the downstream side chamber 42*e* to positive pressure with the downstream side pump 42*i*. Separately, the control unit 90 may close the upstream-side atmosphere relief valve 42*j* and actuate the upstream side pump 42*h* to set the pressure in the upstream side chamber 42*a* to negative pressure. The downstream side pump 42*i* temporarily stops, the upstream-side atmosphere relief valve 42*j* is closed, and the downstream-side atmosphere relief valve 42*k* is opened. The upstream side pump 42*h* (equivalent to an upstream-side negative-pressure applying unit) operates to discharge the air in the upstream side chamber 42*a*. Consequently, the negative pressure in the upstream side chamber 42*a* rises and the ink in the downstream side chamber 42*e* returns to the upstream side chamber 42*a* through return conveyance tube 42*f* and the one-way valve 42*g*. Naturally, it is also possible to cause the ink in the rear chamber 42*e* to return to the upstream side chamber 42*a* by setting the pressure in the downstream side chamber 42*e* to positive pressure with the downstream side pump 42*i*.

In this embodiment, the one-way valve 42*w* (a head-downstream-side-backflow preventing mechanism) is arranged further on the downstream side than the head 31 and further on the upstream side than the downstream side chamber 42*e* in the circulating path.

In this embodiment, as an example, one-way valves are adopted as the "head-downstream-side-backflow preventing mechanism" and the "inter-chamber-backflow preventing mechanism". However, the present invention is not limited to this. Any configuration may be adopted as long as a flow in a desired direction can be formed at desired timing as a result. A pinch cock or the like can also be adopted. As a configuration for reducing a backflow of ejection liquid (a backflow suppressing mechanism), channel resistance of a filter may be used. Consequently, while flow sin both directions are allowed, a sudden flow is not caused even when sudden pressure is applied in any one of the directions. As a result, there is an effect that a backflow is gently suppressed.

Under a situation in which the upstream-side atmosphere relief valve 42*j* and the downstream-side atmosphere relief valve 42*k* are opened, the negative pressure in the head 31 depends on a water head difference between the ink in the head 31 and the ink in the upstream side chamber 42*a*. Therefore, the negative pressure does not affect printing. When the sensor 42*m* detects that the amount of ink in the downstream side chamber 42*e* is the proper amount, the upstream side pump 42*h* and the downstream side pump 42*i* stop. At this point, if the amount of ink in the upstream side chamber 42*a* is insufficient, the ink is supplied as appropriate from the ink tank 41. The ink supply from the ink tank 41 is performed by using the water head difference. Therefore, the upstream-side atmosphere relief valve 42*j* needs to be opened and the downstream-side atmosphere relief valve 42*k* needs to be closed. However, to secure long circulation time, it is desirable that an amount of ink in the upstream side chamber 42*a* is large and an amount of ink in the downstream side chamber 42*e* is small.

Therefore, in the ink supply operation explained above, the control unit 90 causes the pumps to perform ink supply in synchronization with the movement of the ink from the downstream side chamber 42*e* to the upstream side chamber 42*a*. Thereafter, the control unit 90 repeats this operation and performs ink circulation.

It is also conceivable to supply the ink to the head 31 by setting the pressure in the upstream side chamber 42*a* to positive pressure with the upstream side pump 42*h*. When the ink is pressed into the head 31 by the positive pressure, the pressure in the head 31 changes to the positive pressure and the ink flows out from the nozzles of the head 31. Therefore, in this embodiment, the downstream side pump 42*i* is provided at least further on the downstream side than the head 31 and the ink remaining in the head 31 is drawn into the downstream side chamber 42*e* by the negative pressure and collected.

In this way, a "first pressure state" in which the pressure in the downstream side chamber 42*e* is lower than the pressure in the upstream side chamber 42*a* and a "second pressure state" in which the pressure in the upstream side chamber 42*a* is lower than the pressure in the downstream side chamber 42*e* are selectively switched by the upstream side pump 42*h*, the downstream side pump 42*i*, the upstream-side atmosphere relief valve 42*j*, the downstream-side atmosphere relief valve 42*k*, the one-way valve 42*g*, and the one-way valve 42*w* equivalent to the pressure-difference adjusting mechanism, whereby ink circulating operation is realized.

Consequently, the ink can be circulated according to a procedure of relieving the pressure in the upstream side chamber 42*a* to the atmosphere with the upstream-side atmosphere relief valve 42*j*, setting the pressure in the downstream side chamber 42*e* to negative pressure with the downstream side pump 42*i*, and setting the pressure in the upstream side chamber 42*a* to negative pressure with the upstream side pump 42*h* with the inside of the downstream side chamber 42*e* opened to the atmospheric pressure by the downstream-side atmosphere relief valve 42*k*.

As explained above, the downstream side pump 42*i* switches the positive pressure and the negative pressure on the basis of a control signal from the control unit 90 (switching of the pressure states). To prevent pressure fluctuation in the downstream side chamber 42*e* from propagating to the head 31 and affecting printing performance, it is desirable to perform the switching when the head 31 is not performing printing operation.

Specific timing for switching the positive pressure and the negative pressure in the downstream side pump 42*i* is timing when the head 31 is located between a first recording medium and a second recording medium following the first recording medium (a so-called paper interval).

The control unit 90 (the pressure control unit) can also cause the downstream side pump 42*i* to switch the positive pressure and the negative pressure, for example, in a period in which the head 31 is located between the first recording medium and the second recording medium (the paper interval) expanded than usual by the control unit 90 (the conveyance control unit), in a period in which maintenance operation for cleaning, for sheet conveyance, the nozzle surfaces of the head 31, or during reading operation for an original document.

The control unit 90 according to this embodiment can perform not only the switching of the positive pressure and the negative pressure in the pumps but also switching of a system for supplying ink to a head not performing printing (a color head during printing in a monochrome printing mode in which only a black ink is used) or a head for black not in use during printing in a color printing mode (switching of the pressure states only for a head not performing ejecting operation).

In an image forming apparatus of an ink jet system, in some case, for the purpose of preventing flapping of a sheet and securing image density, pretreatment liquid (equivalent to the ejection liquid) is applied to the recording paper P to control penetration of ink into the recording medium P. In this case, unlike the ink, since the colorless and transparent pretreatment liquid is invisible on the recording medium P, the influence of foreign matters or the like in a head less easily appears. Therefore, the control unit 90 can also perform control for reducing a circulating flow rate or circulating pressure for a head configured to eject the pretreatment liquid compared with other heads for inks and reducing the number of times of the circulating direction switching operation (the number of times of switching per unit time).

In this way, it is possible to circulate and supply the ink to the head while preventing the ink from being deteriorated and preventing pulsation of the pumps from affecting an image quality. It is possible to secure long circulating time when new ink is supplied to the head following a decrease in an amount of ink in the head due to ink ejection. Further, it is possible to minimize the influence on an image quality due to pressure fluctuation that occurs during switching of the circulating operation.

Figure 30:
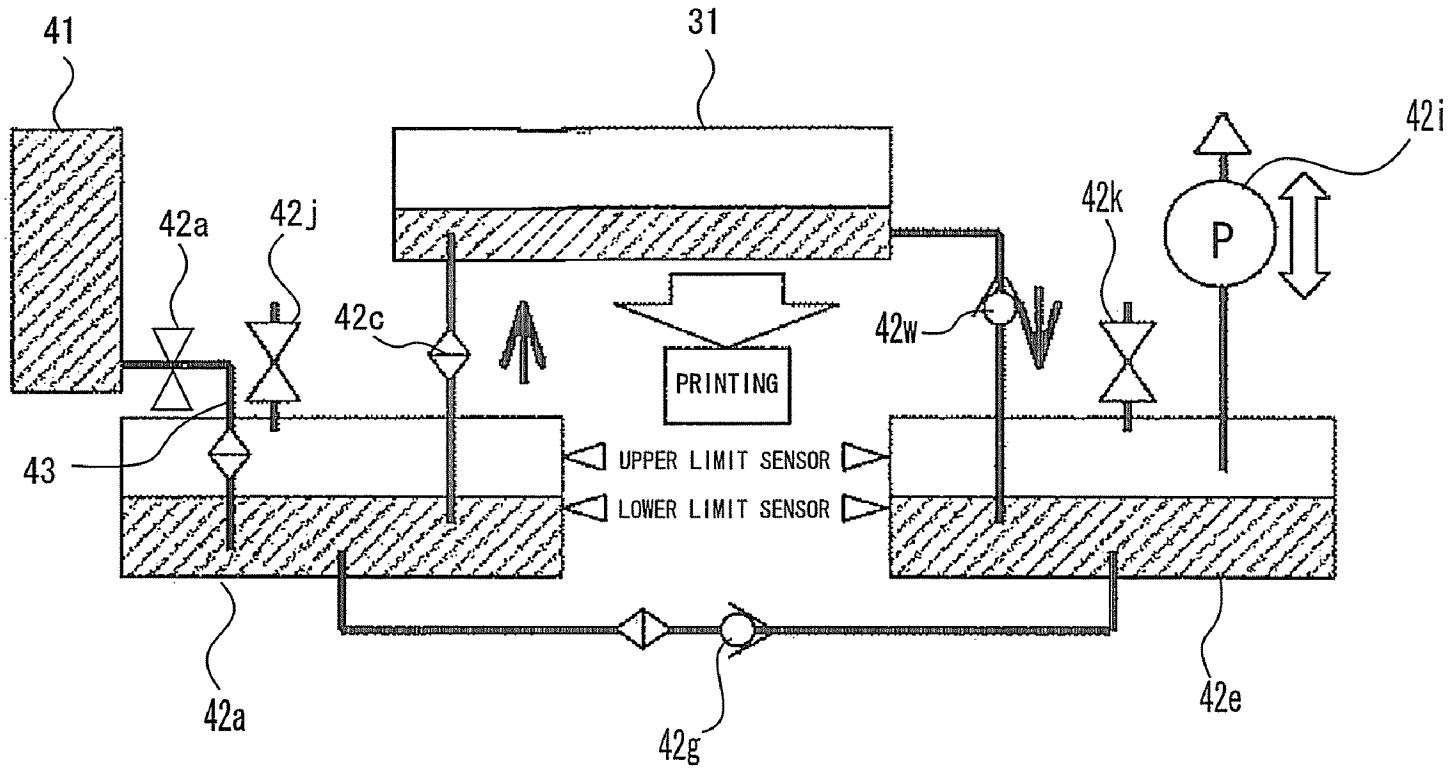
FIG. 30 is a diagram for explaining another configuration example of the ink supplying system configured to supply ink to the head 31.
Figure 31:
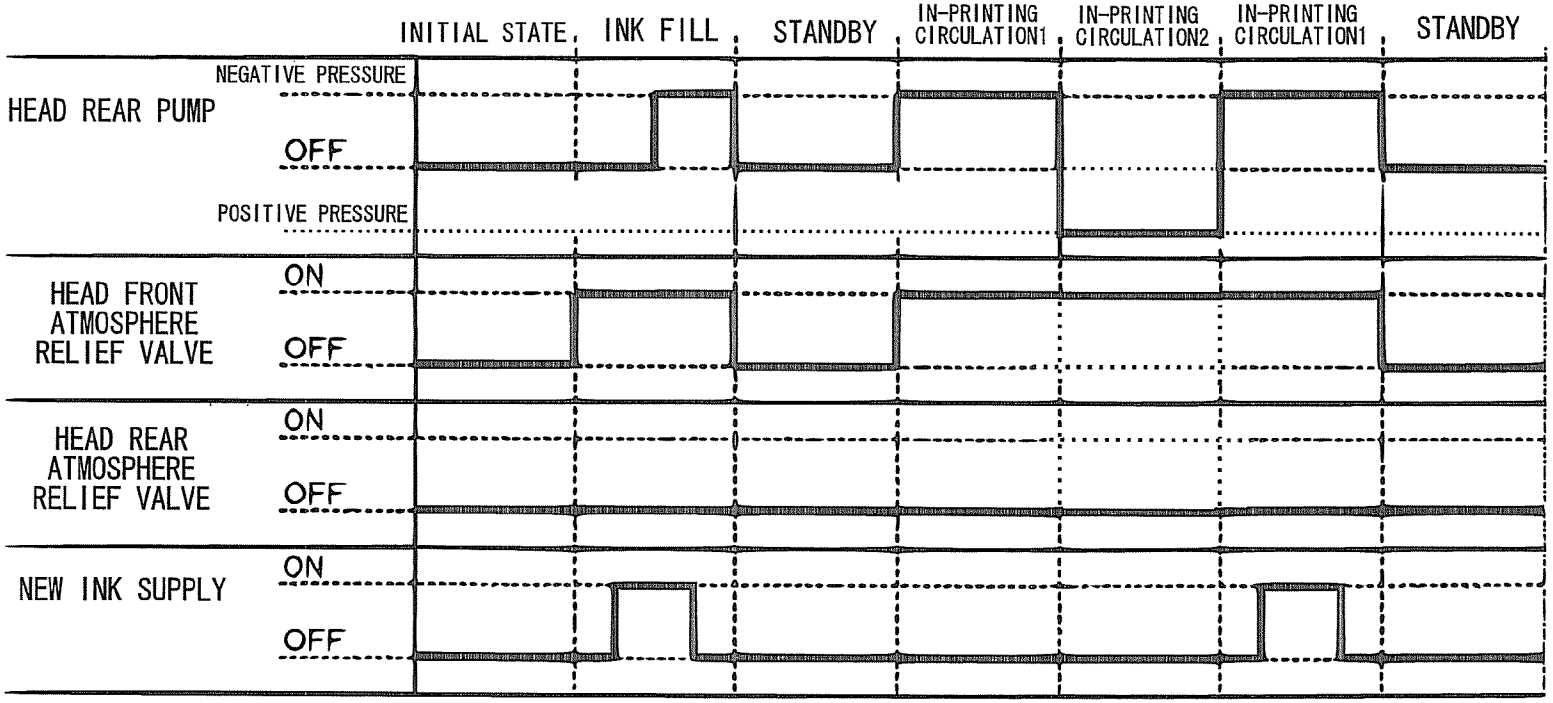
FIG. 31 is a diagram for explaining the other configuration example of the ink supplying system configured to supply ink to the head 31.

In FIGS. 20 and 21, the configuration example of the ink supplying system in the image forming apparatus according to this embodiment is shown. However, the present invention is not limited to this. FIG. 30 is a diagram of an ink supplying block having a configuration different from the example shown in FIG. 20. FIG. 31 is a timing chart of operation in an ink supplying system having the configuration shown in FIG. 30.

In the configuration shown in FIG. 30, the pump for adjusting pressure is not connected to the upstream side chamber 42*a* located on the upstream side of the head 31. The collection of the ink from the head 31 and the circulation and supply of the ink to the head 31 are basically performed by the reversible downstream side pump 42*i* connected to the downstream side chamber 42*e*.

As shown in FIG. 31, in the ink supplying system having the configuration shown in FIG. 30, first, the control unit 90 causes the ink supply valve 43*a* to open and, with the pressure in the upstream side chamber 42*a* opened to the atmosphere by the upstream-side atmosphere relief valve 42*j*, causes the downstream side pump 42*i* to set the pressure in the downstream side chamber 42*e* to negative pressure. In this way, the control unit 90 supplies the ink into the head 31 (ink filling).

After the elapse of predetermined standby time, following the start of printing operation, the control unit 90 causes the downstream side pump 42*i* to set the pressure in the downstream side chamber 42*e* to negative pressure with the pressure in the upstream side chamber 42*a* relieved to the atmosphere by the upstream-side atmosphere relief valve 42*j* and perform stable ink supply to the head 31 (in-printing circulation 1).

Subsequently, the control unit 90 causes the downstream side pump 42*i* to set the pressure in the downstream side chamber 42*e* to positive pressure with the pressure in the upstream side chamber 42*a* kept relieved to the atmosphere by the upstream-side atmosphere relief valve 42*j* and feed the ink in the downstream side chamber 42*e* into the upstream side chamber 42*a* (in-printing circulation 2).

The control unit 90 opens the ink supply valve 43*a* with the pressure in the upstream side chamber 42*a* kept relieved to the atmosphere by the upstream-side atmosphere relief valve 42*j* and causes the downstream side pump 42*i* to set the pressure in the downstream side chamber 42*e* to negative pressure (in-printing circulation 1).

Thereafter, the control unit 90 returns to an initial state through a standby state.

The configuration of the ink supplying system is not limited to the configurations of the ink supplying systems illustrated in FIGS. 20 and 21 and FIGS. 30 and 31. It goes without saying that a configuration for realizing, without using pumps but using a water head difference, a part of the operation carried out by the pumps in the configurations shown in FIGS. 20 and 30 can be adopted.

Figure 32:
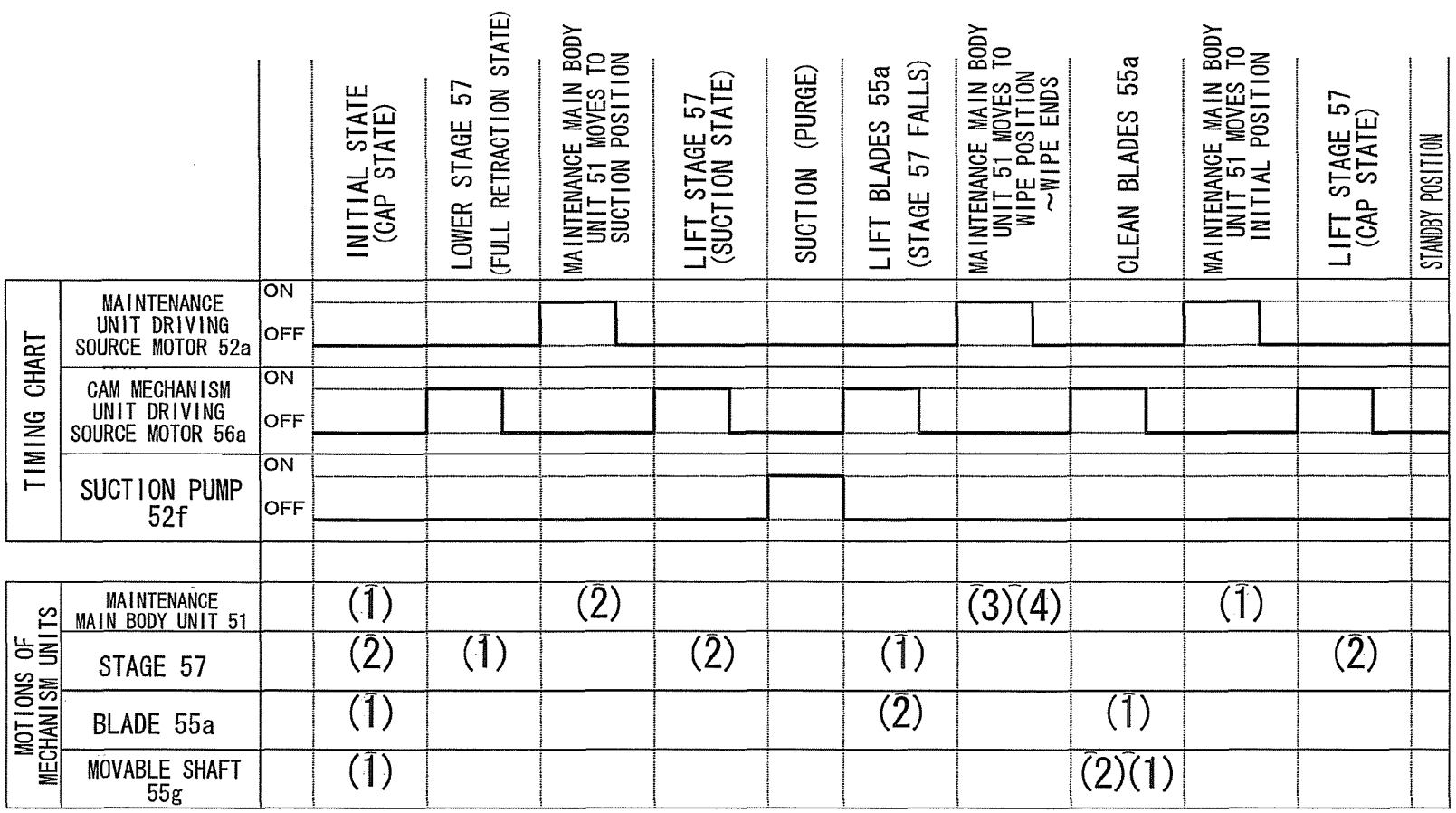
FIG. 32 is a timing chart of operation in a maintenance unit 50.

FIG. 32 is a timing chart of the operation in the maintenance unit 50.

Operation in this embodiment is as explained below.

Usually, in the standby state (the initial state), the ink ejection surface of the head 31 is capped ("cap state" in FIG. 32). When an instruction for starting maintenance operation is given from the control unit 90, first, the maintenance unit 50 drives the driving source motor 56*a* in the cam mechanism unit 56 (equivalent to the contact and separation mechanism) to lower the stage 57 ("full retraction state" of (3) of the maintenance main body unit 51 in FIG. 32). Consequently, the maintenance main body unit 51 can horizontally move along the linear shaft 52*b* in a state in which the maintenance main boy unit 51 is retracted from the head ejection surface. With such a function of the contact and separation mechanism, it is possible to relatively move the cap unit 53 and suction unit 54 and the nozzle surfaces of the head 31 to be capable of coming into contact with and separating from each other.

Subsequently, the control unit 90 drives the driving source motor 52*a* to move the maintenance main body unit 51 to a suction position ("move to suction position" in FIG. 32). Then, the control unit 90 drives the driving source motor 56*a* to lift the stage 57 and presses the rubber unit for suction 54*a* against the head ejection surface ("suction state" in FIG. 32). During purge operation in the head 31 or after the purge operation, the control unit 90 actuates the pump 52*f* to execute suction processing ("suction" in FIG. 32). Sucked waste ink accumulates in the waste ink tank 2*e* through the tube 54*e*.

At this point, in the suction operation, the control unit 90 (the maintenance-necessity determining unit) may increase or decrease the number of times of execution (necessity of maintenance in the heads) according to a state of use (information concerning an operation state) of the head 31 that can be grasped. When only monochrome printing is performed, immediately after the monochrome printing operation, the control unit 90 (the suction control unit) causes the pump to perform suction operation only for a head that ejects black ink. Besides, the control unit 90 may cause the pump to perform the suction operation only for a head left untouched without ejecting ink for a predetermined period or more. The control unit 90 may cause the pump to perform the suction operation only for a head that performs printing operation in the predetermined period.

When the configuration for applying the pretreatment liquid is adopted as in this embodiment, an image quality is not fatally affected even if an ejection failure occurs in the head that ejects the pretreatment liquid. Therefore, the control unit 90 may perform control to set the number of times of the suction operation of the head that ejects the pretreatment liquid smaller than the number of times of the suction operation of the head that ejects ink.

When the suction operation for the heads ends, the control unit 90 drives the driving source motor 56*a* in the cam mechanism unit 56 to lift the blades 55*a* (at the same time, the stage 57 falls) ("stage 57 falls" in FIG. 32). The control unit 90 drives the driving source motor 52*a* to move the maintenance main body unit 51 to a wipe start position ("move to wipe position" of (3) of the maintenance main body unit 51 in FIG. 32). The control unit 90 drives the driving source motor 52*a* to directly move the maintenance main body unit 51 to a wipe end position to thereby wipe away waste ink on the head ejection surface ("wipe ends" of (4) of the maintenance main body unit 51 in FIG. 32).

The control unit 90 stops the maintenance main body unit 51 and drives the driving source motor 56*a* to lower the blades 55*a* with the cam mechanism unit 56. At this point, the blades 55*a* are held between the shafts 55*f* and 55*g* and rubbed by the movable unit 55*i* ("clean blade 55*a*" in FIG. 32). Waste ink is accumulated in the block 55*b*.

Subsequently, the control unit 90 lowers the suction unit 54 and moves the suction unit 54 to the next head that should be maintained. The control unit 90 applies maintenance processing to all the heads by repeating such processing.

Finally, the control unit 90 drives the driving source motor 52*a* to move the maintenance main body unit 51 to an initial position (a cap and suction position) ("move to initial position" of (3) of the maintenance main body unit 51 in FIG. 32). The control unit 90 drives the driving source motor 56*a* to set all the heads 31 in a cap state ("cap state" in FIG. 32). However, during the start of printing, the control unit 90 (the retraction control unit) moves the maintenance main body unit 51 to a retracted position and puts the maintenance main body unit 51 on standby ("standby position" in FIG. 32).

In FIG. 32, (1) of the stage 57 indicates a lifted state and (2) indicates a lowered state. (1) of the blades 55*a* indicates a lowered state and (2) indicates a lifted state. (1) of the movable shaft 55*g* indicates an opened state between the movable shaft 55*g* and the fixed shaft 55*f* and (2) indicates a closed state.

Usually, the head 31 is fixedly arranged not to move relatively to the image forming apparatus main body. However, for example, when maintenance and inspection of the image forming apparatus such as replacement work for the head 31 is performed, it is necessary to draw out the head mounting unit 30 to a position where maintenance of the head mounting unit 30 is possible (a position other than the printing position and the standby position) (the head moving mechanism). As an example, it is assumed that the "head moving mechanism" includes the driving source motor 52*a*, the maintenance main boy unit 51, the linear shaft 52*b*, and the driving belt 52*c*.

Figure 33:
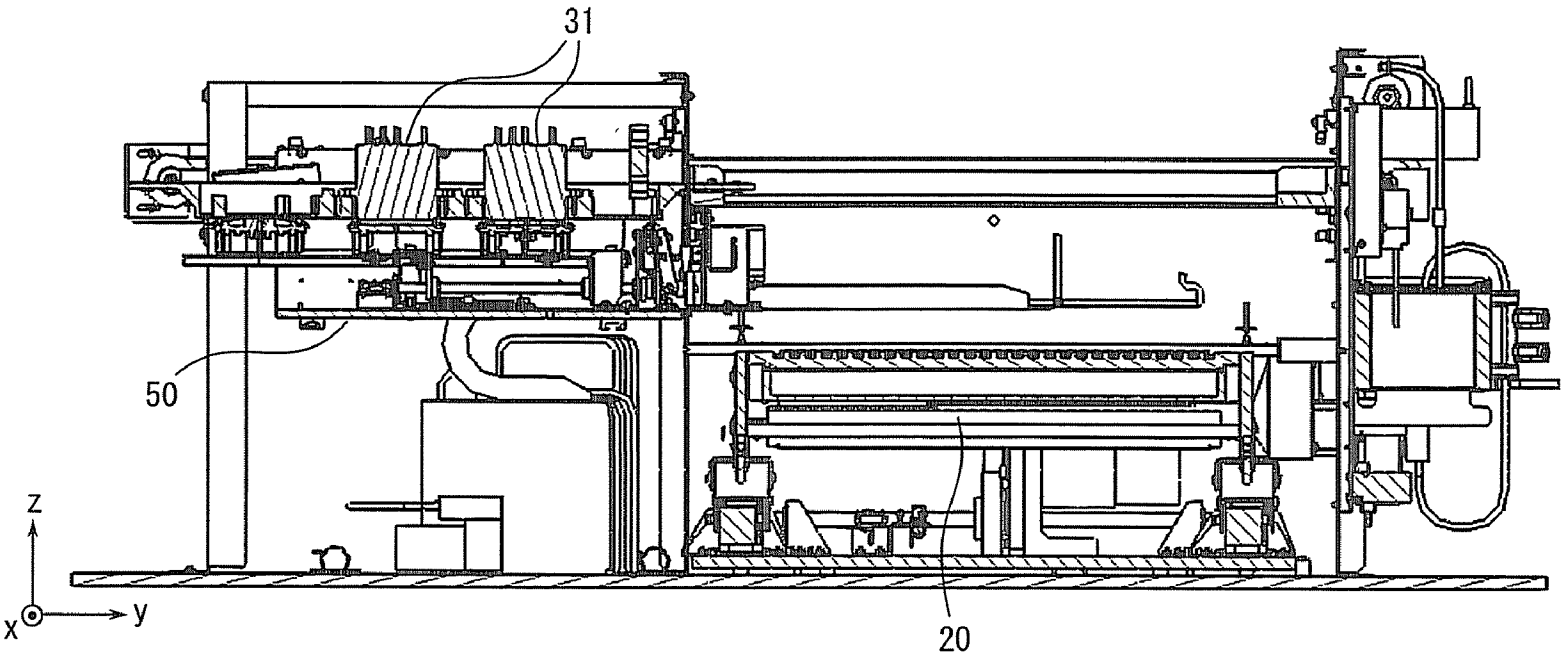
FIG. 33 is a sectional view of a state in which heads 31 are drawn out to a position where maintenance of the heads 31 is possible.
Figure 34:
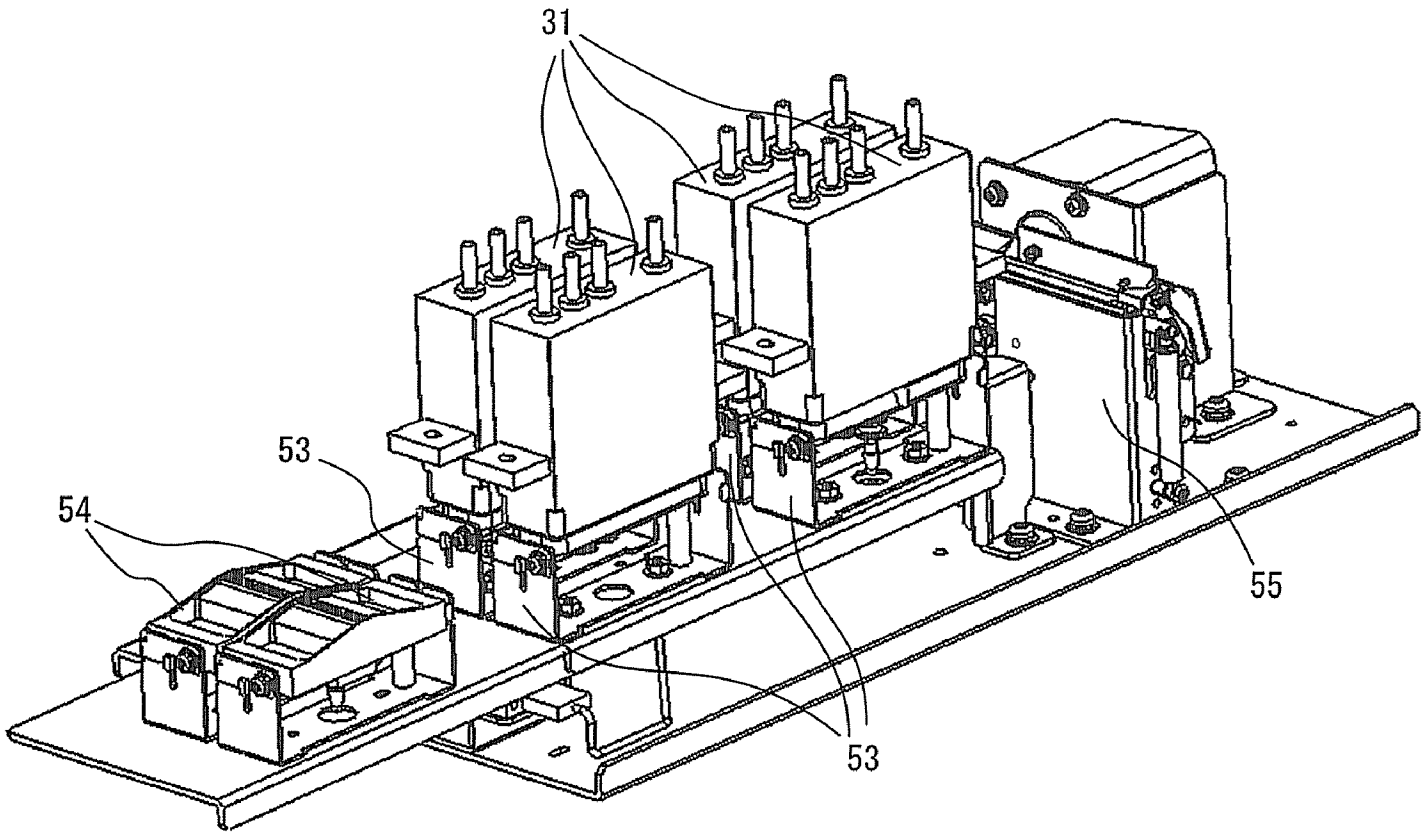
FIG. 34 is a schematic sectional view of a state in which the heads 31 and cap units 53 are integrated.

FIG. 33 is a sectional view of a state in which the heads 31 are drawn out to a position where maintenance of the heads 31 is possible. FIG. 34 is a schematic diagram of a state in which the heads 31 and cap units 53 are integrated. In this way, in this embodiment, all the nozzle surfaces of the plural heads 31 can be simultaneously capped by the plural cap units 53.

In the image forming apparatus according to this embodiment, during standby when the image forming operation is not performed, the maintenance main body unit 51 is in the cap state. The cap units 53 close the nozzle surfaces of the heads 31. In this embodiment, when the heads 31 are drawn out to the position where maintenance of the heads 31 is possible, the cap units 53 move integrally with the maintenance main body unit 51 along the linear shaft 52*b* keeping on adhering to the nozzle surfaces of the heads 31. In this way, the control unit 90 (the retraction control unit) can retract the cap units 53 from the nozzle surfaces of the heads 31 with the contact and separation mechanism only when the printing operation is executed by the heads 31.

In this embodiment, as an example, the maintenance main body unit 51 mounted with the cap units 53 is moved integrally with the heads 31 by the contact and separation mechanism. However, the present invention is not limited to this. It goes without saying that it is possible to adopt a configuration in which the cap units 53 alone are moved integrally with the heads 31 by the function of the contact and separation mechanism.

Figure 35:
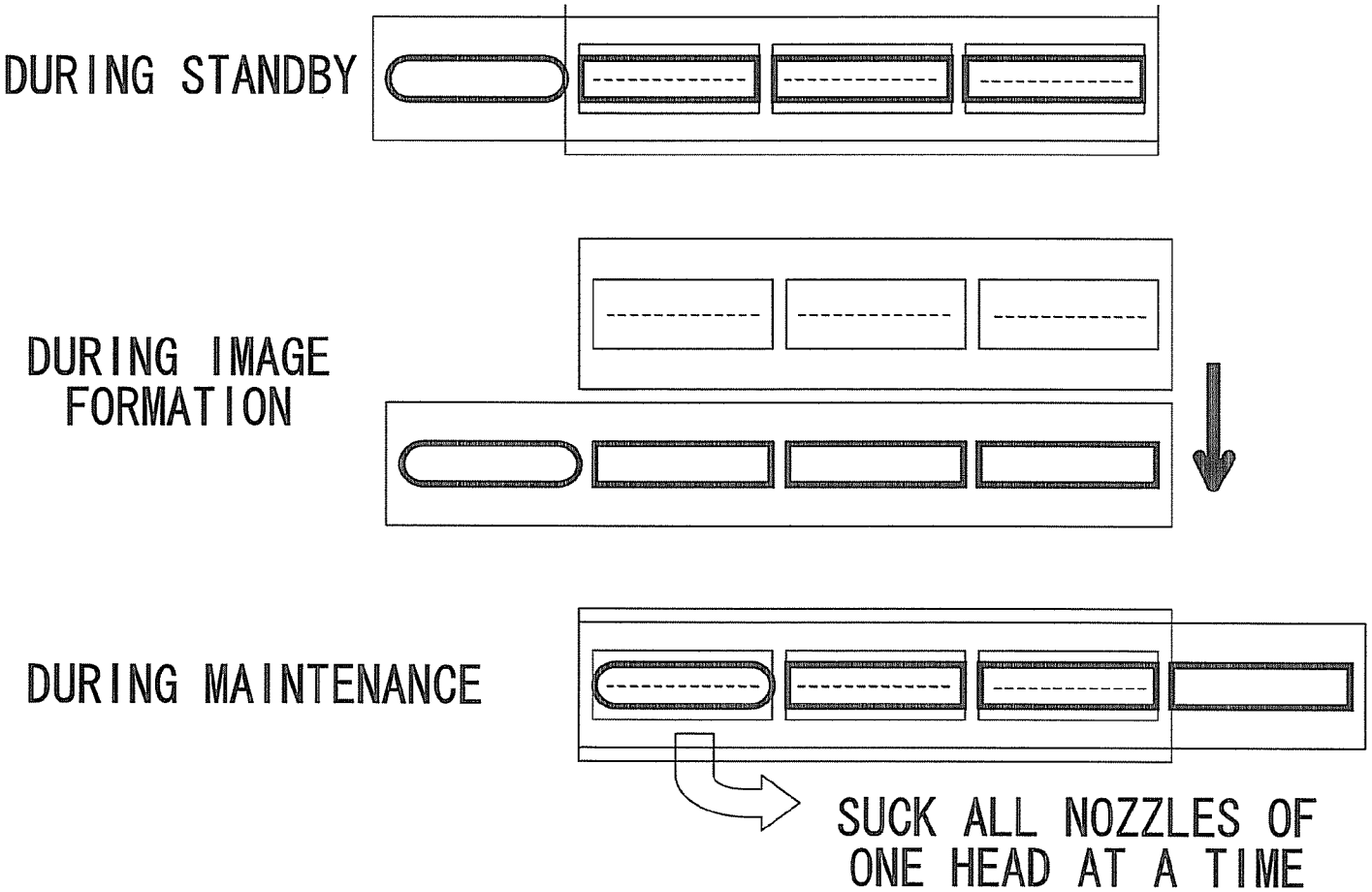
FIG. 35 is a diagram of an example of maintenance operation of the heads in the embodiment.
Figure 36:
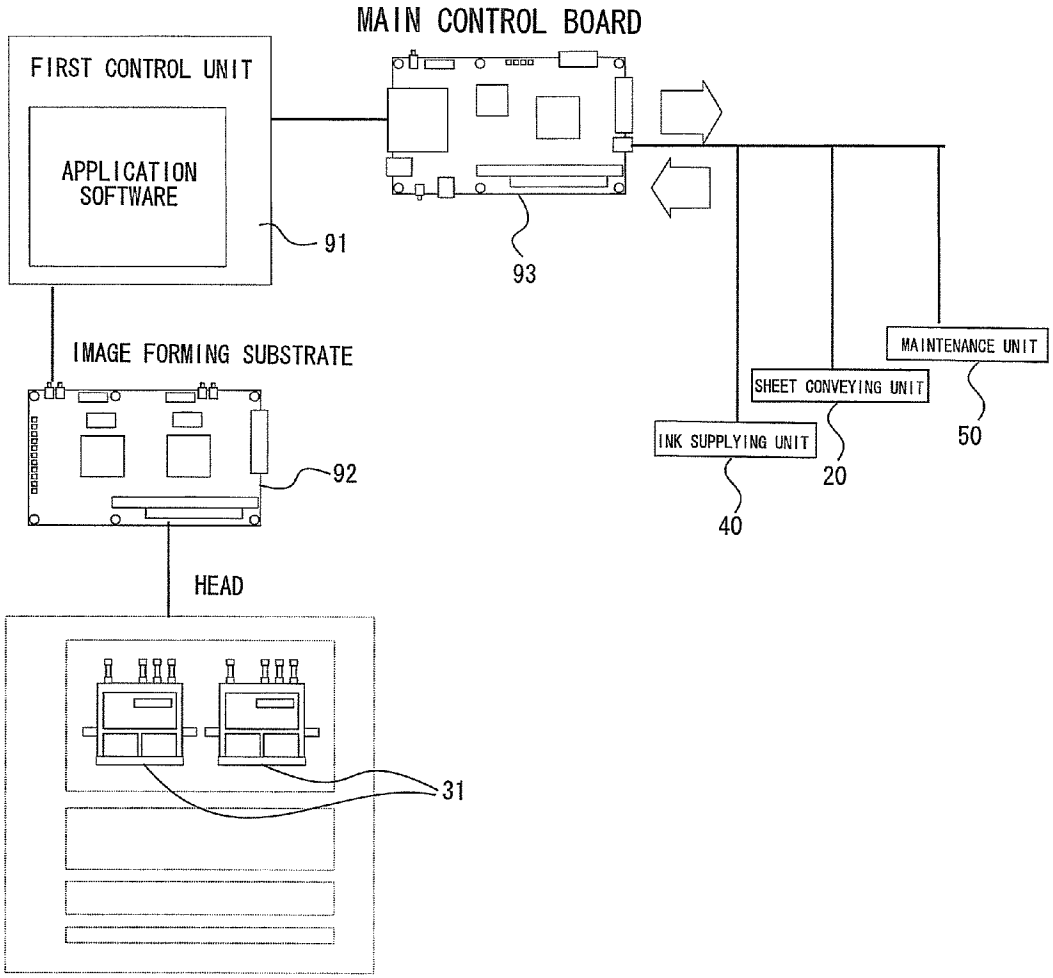
FIG. 36 is a diagram for explaining the configuration of a control unit 90.
Figure 37:
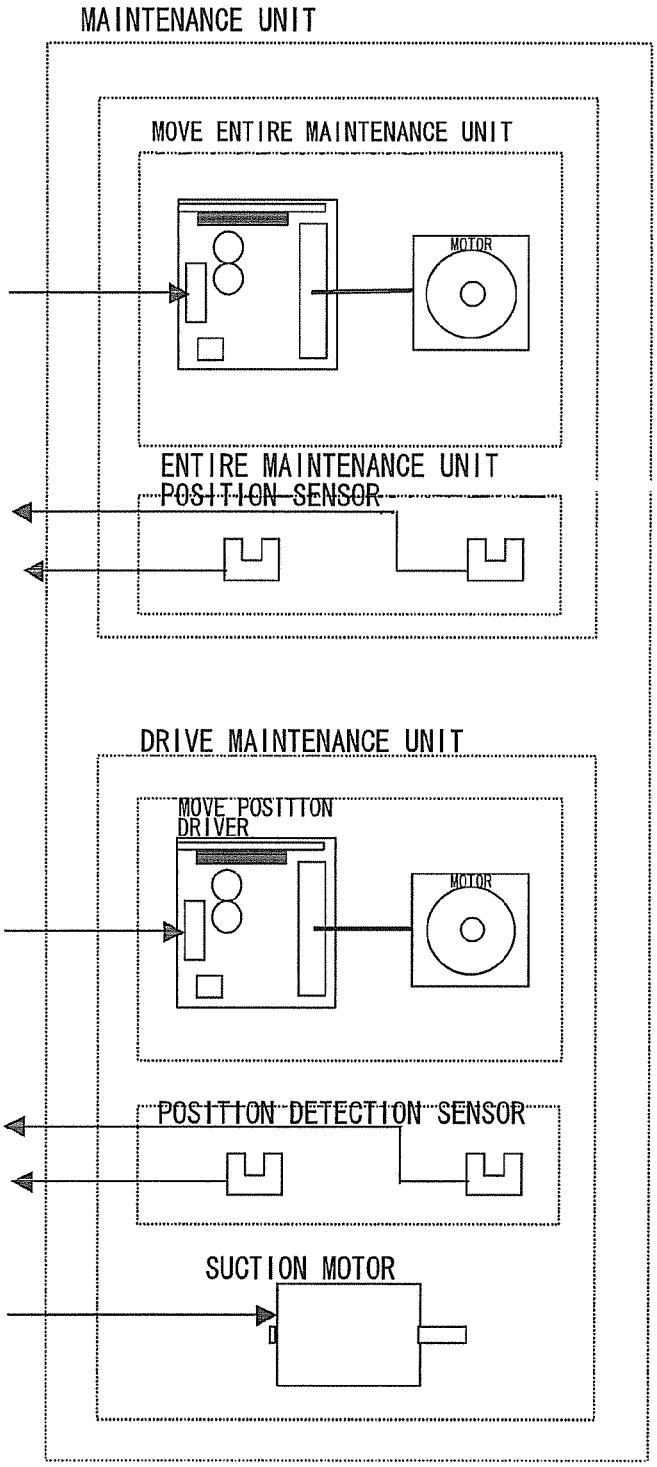
FIG. 37 is a diagram for explaining the configuration of the control unit 90.
Figure 38:
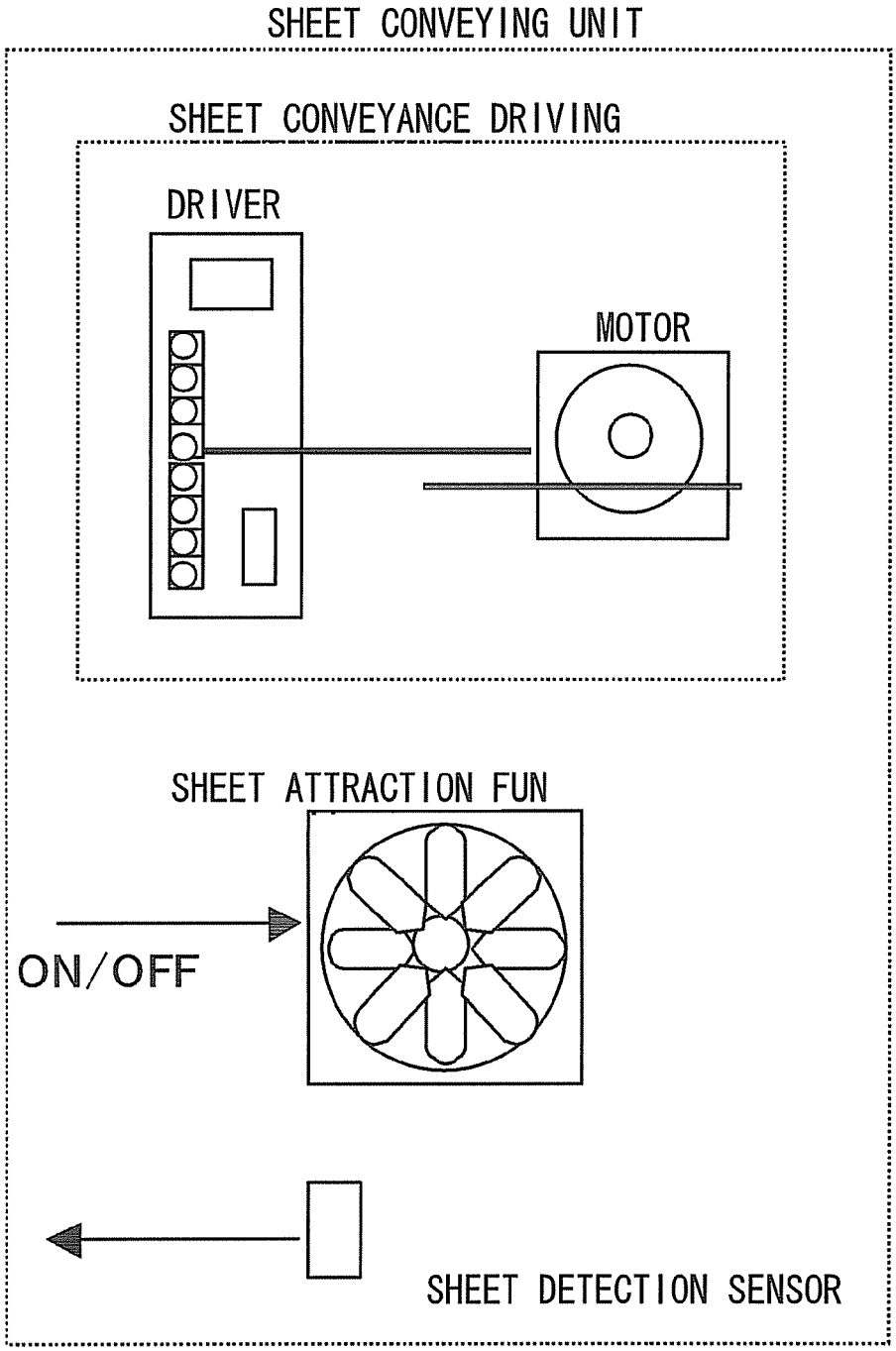
FIG. 38 is a diagram for explaining the configuration of the control unit 90.
Figure 39:
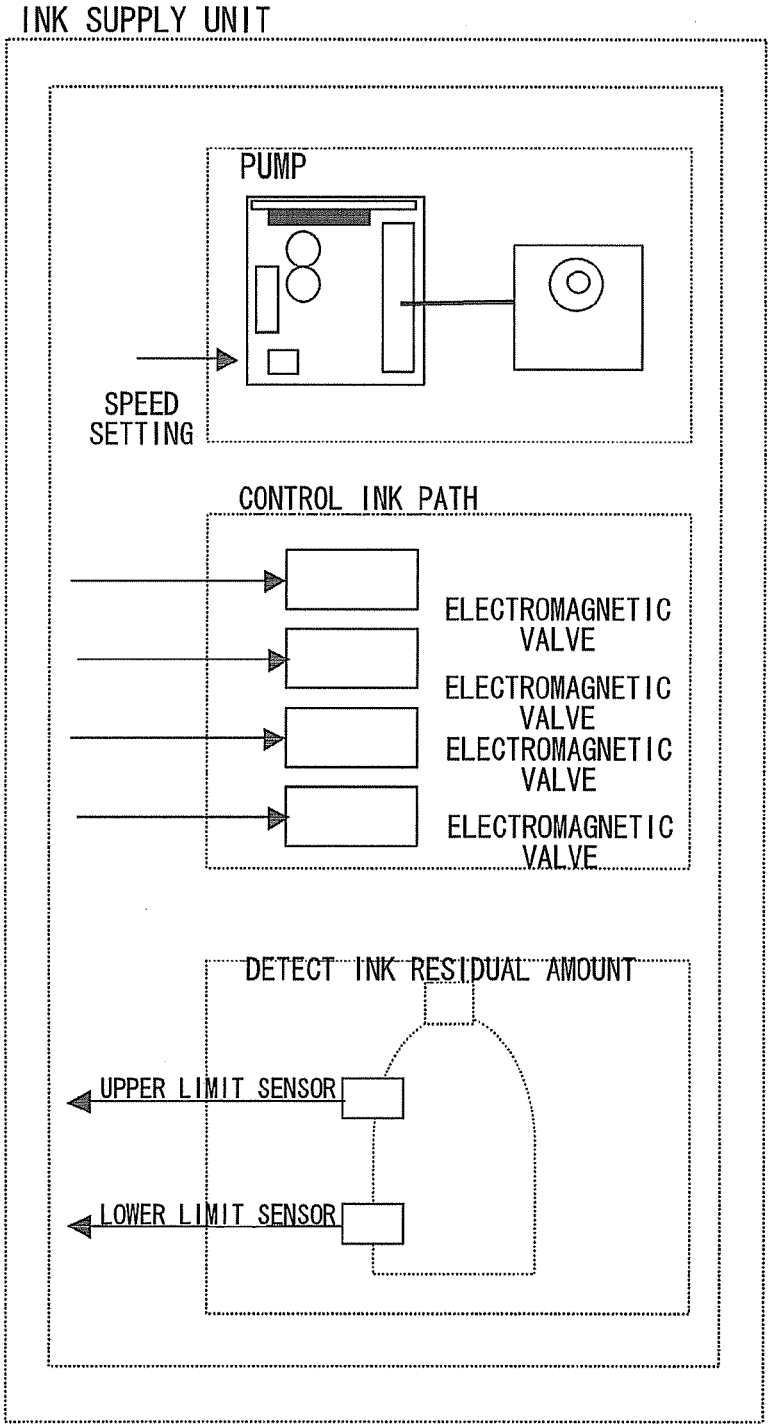
FIG. 39 is a diagram for explaining the configuration of the control unit 90.

FIG. 35 is a diagram of an example of head maintenance operation in this embodiment.

As shown in FIG. 35, a suction nozzle included in the image forming apparatus according to this embodiment can simultaneously suck all plural nozzle holes forming nozzles of a head. Specifically, according to this embodiment, since it is unnecessary to scan the plural nozzle holes of the head, a surface in which the nozzle holes are formed in the head is not scratched. Compared with suction operation by a suction nozzle in the past that can suck only a part of holes among plural nozzle holes at a time, it is possible to complete the suction operation in a short time.

In the image forming apparatus according to this embodiment, highly efficient maintenance operation is realized with a minimum configuration by adopting a configuration with high space efficiency in which only cap units for preventing drying of nozzle surfaces are arranged in a number same as the number of heads. The heads can be moved to the maintenance position with the nozzles of the heads capped by the cap units during maintenance. It is possible to execute the maintenance operation without drying the nozzle surfaces.

The configuration of the control unit 90 is explained with reference to FIGS. 36 to 39. The control unit 90 includes a first control unit 91 configured to control an operation sequence in the image forming apparatus according to this embodiment, an image forming unit 92 as an image forming substrate configured to generate image data, which should be formed as an image on the recording medium P, and transmit the image data to the heads 31, and a main control unit 93 configured to perform driving control for a motor configured to drive various mechanism systems included in the image forming apparatus according to this embodiment. The first control unit 91 performs, for example, control of operation sequences in the image forming unit 92 and the main control unit 93 as a main control board and transmission control for image data.

The image forming unit 92 converts image data transmitted thereto into a print signal for controlling printing operation in the heads 31 and transmits the print signal to the heads 31. The heads 31 are driven on the basis of the print signal transmitted from the image forming unit 92 and forms an ink image on the recording medium P. The main control unit 93 is connected to motors and sensors included in the image forming apparatus according to this embodiment and performs operation for causing the units included in the image forming apparatus to perform desired operation. The main control unit 93 also includes a power supply unit and a driver used for driving the motors. Motors and sensors as components of the maintenance unit 50, the media conveying unit 20, and the ink supplying unit 40 are connected to the main control unit 93.

Capping Mechanism

Details of the configuration of the cap unit 53 in the image forming apparatus according to this embodiment are explained below.

In the image forming apparatus according to this embodiment, a capping mechanism including the cap unit 53 for shielding the nozzles from the outside air is adopted to protect the nozzles from clogging due to drying of ink in the nozzles of the heads and clogging due to dust.

FIGS. 40 to 45 are diagrams for explaining the configuration of the head 31 and the cap unit 53 (a cap device) in the maintenance main body unit 51.

Figure 40:
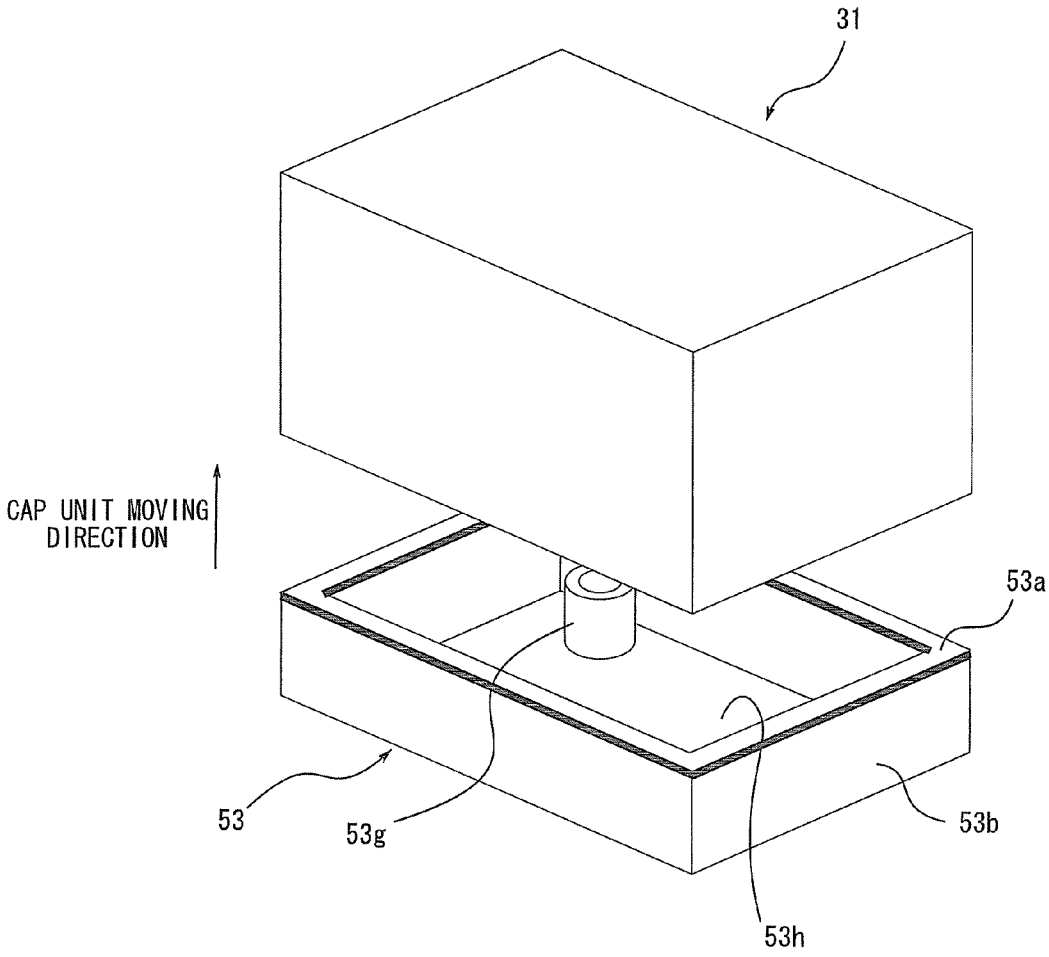
FIG. 40 is a diagram for explaining the configuration of the head 31 and the cap unit 53 in a maintenance main body unit 51.

FIG. 40 is a schematic perspective view of the configuration of the head 31 and the cap unit 53.

Specifically, the cap unit 53 includes the rubber unit 53*a* set in contact with the head 31, the main body unit 53*b* to which the rubber unit 53*a* is fixed, an atmosphere communication hole unit 53*g*, and a moisture retaining material 53*h*.

The cap unit 53 slides in an arrow direction to protect the nozzle orifices of the head 31 (drying prevention, etc.) and adheres to the lower surface of the head (capping), for example, when maintenance operation ends, when the maintenance operation is put on standby, and when printing operation ends.

The main body unit 53*b* is a box-like member. In the main body unit 53*b*, an opening is formed on a side (an upper side) opposed to the nozzles of the head 31 when the nozzles are capped. The atmosphere communication hole unit 53*g* configured to cause the inside of the cap unit 53 and the atmosphere to communication each other in a capped state of the nozzles is formed on a wall surface thereof.

The rubber unit 53*a* (the cap unit) is provided on the side on which the opening of the main body unit 53*b* is formed, set in contact with the periphery of the nozzles of the head 31 when the nozzles are capped, and closes the nozzles in cooperation with the main body unit 53*b*.

The atmosphere communication hole unit 53*g* projects in a tubular shape from the wall surface of the main body unit 53*b* to the inside of the cap unit 53. Water repellent treatment is applied to at least a part of at least any one of the outer circumferential surface and the end face of the tubular shape section.

Figure 41:
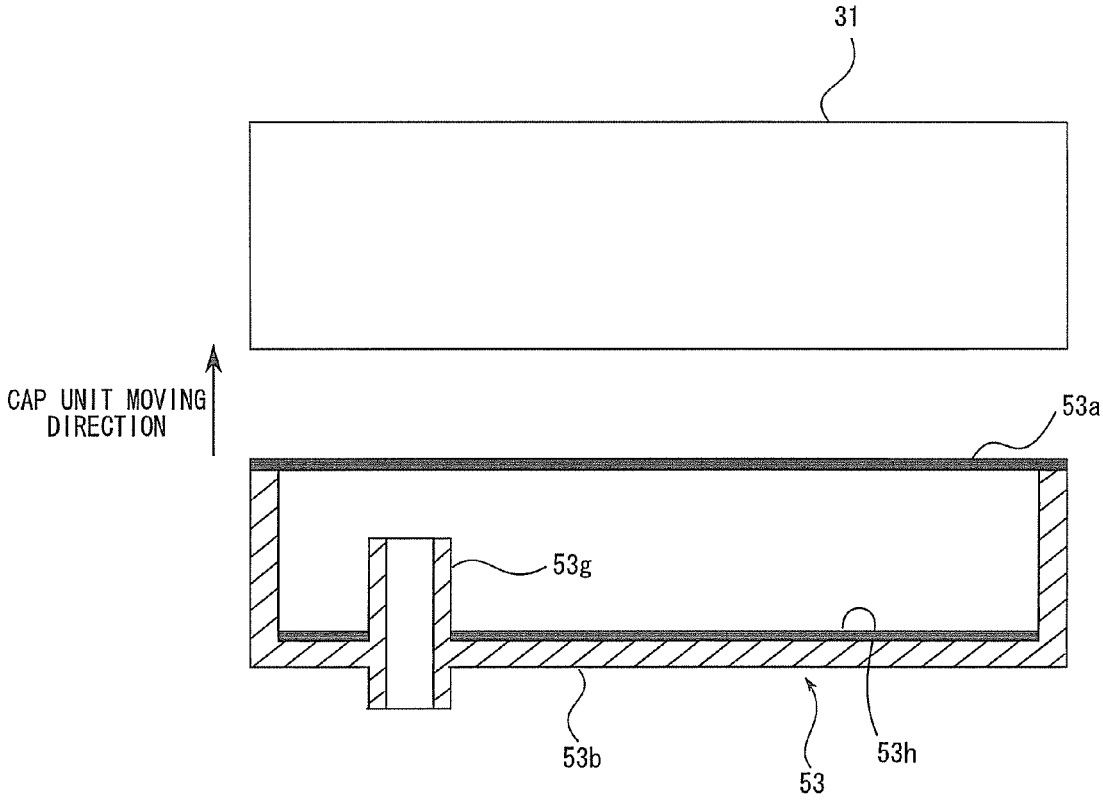
FIG. 41 is a diagram for explaining the configuration of the head 31 and the cap unit 53 in the maintenance main body unit 51.
Figure 42:
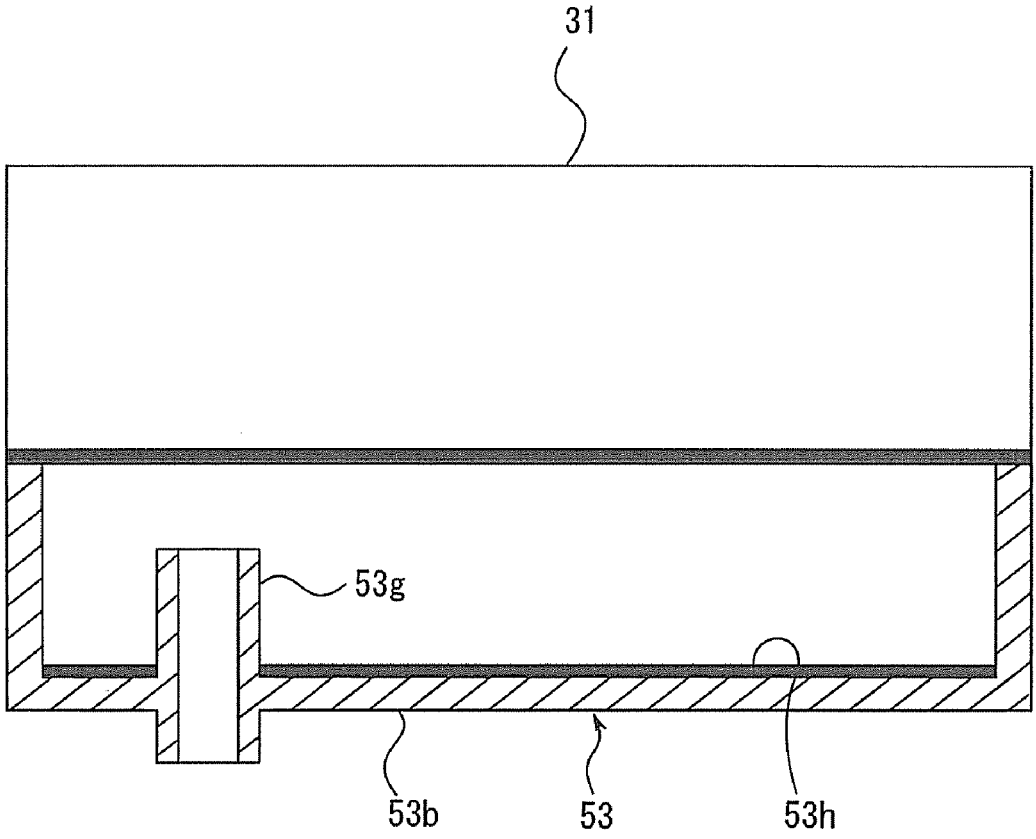
FIG. 42 is a diagram for explaining the configuration of the head 31 and the cap unit 53 in the maintenance main body unit 51.

FIG. 41 is a longitudinal sectional view in a state in which the head 31 and the cap unit 53 are separated from each other. FIG. 42 is a longitudinal sectional view in a state in which the head 31 and the cap unit 53 adhere to each other.

For example, as shown in FIG. 41, the outer circumferential upper edge of the atmosphere communication hole unit 53*g* is formed in a position higher than the bottom surface of the inside of the main body unit 53*b*. As it is seen from FIGS. 44 and 45, at least a part of the outer circumferential surface of the tubular shape section of the atmosphere communication hole unit 53*g* may be formed integrally with the wall surface of the main body unit 53*b*.

Figure 43:
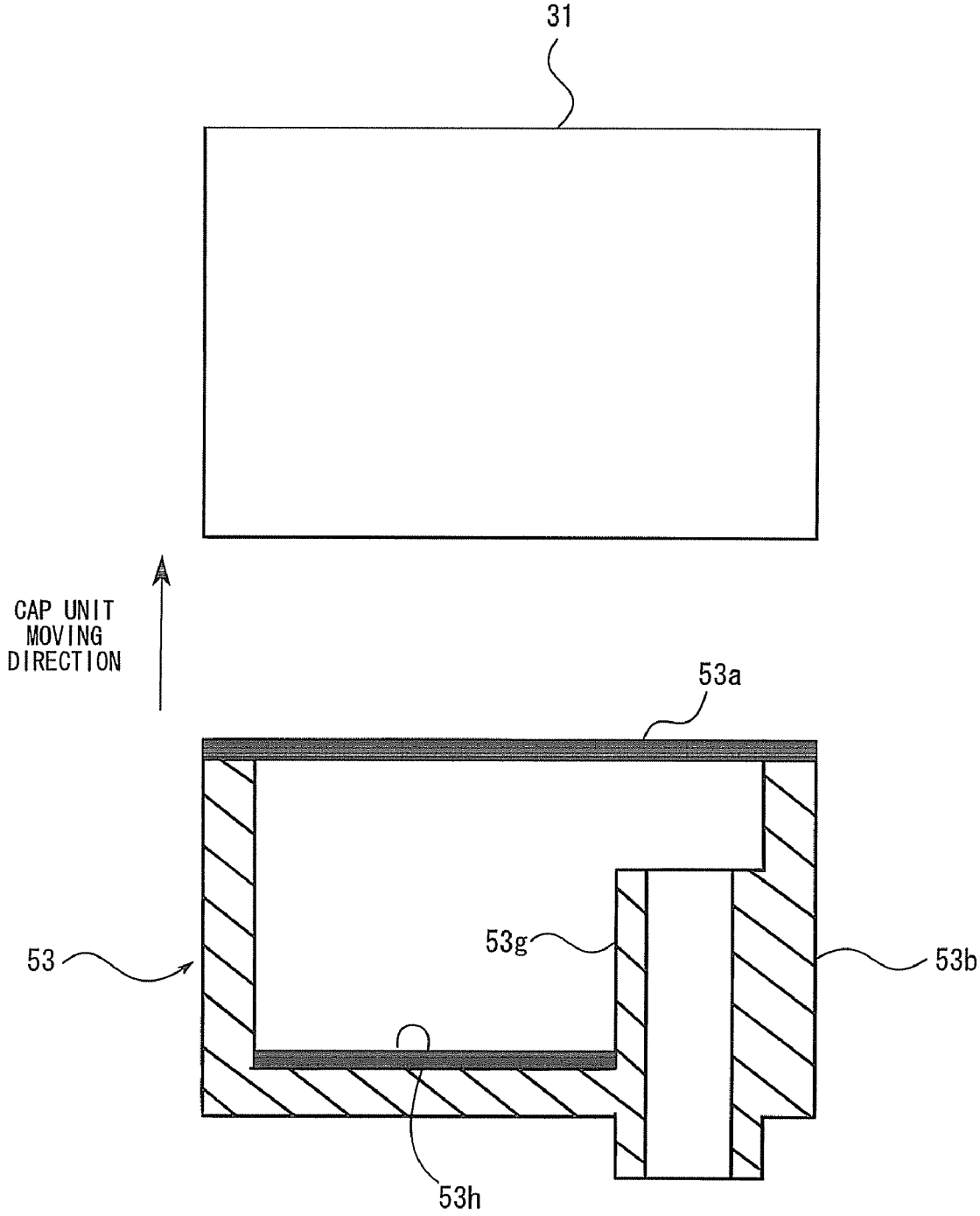
FIG. 43 is a diagram for explaining the configuration of the head 31 and the cap unit 53 in the maintenance main body unit 51.
Figure 44:
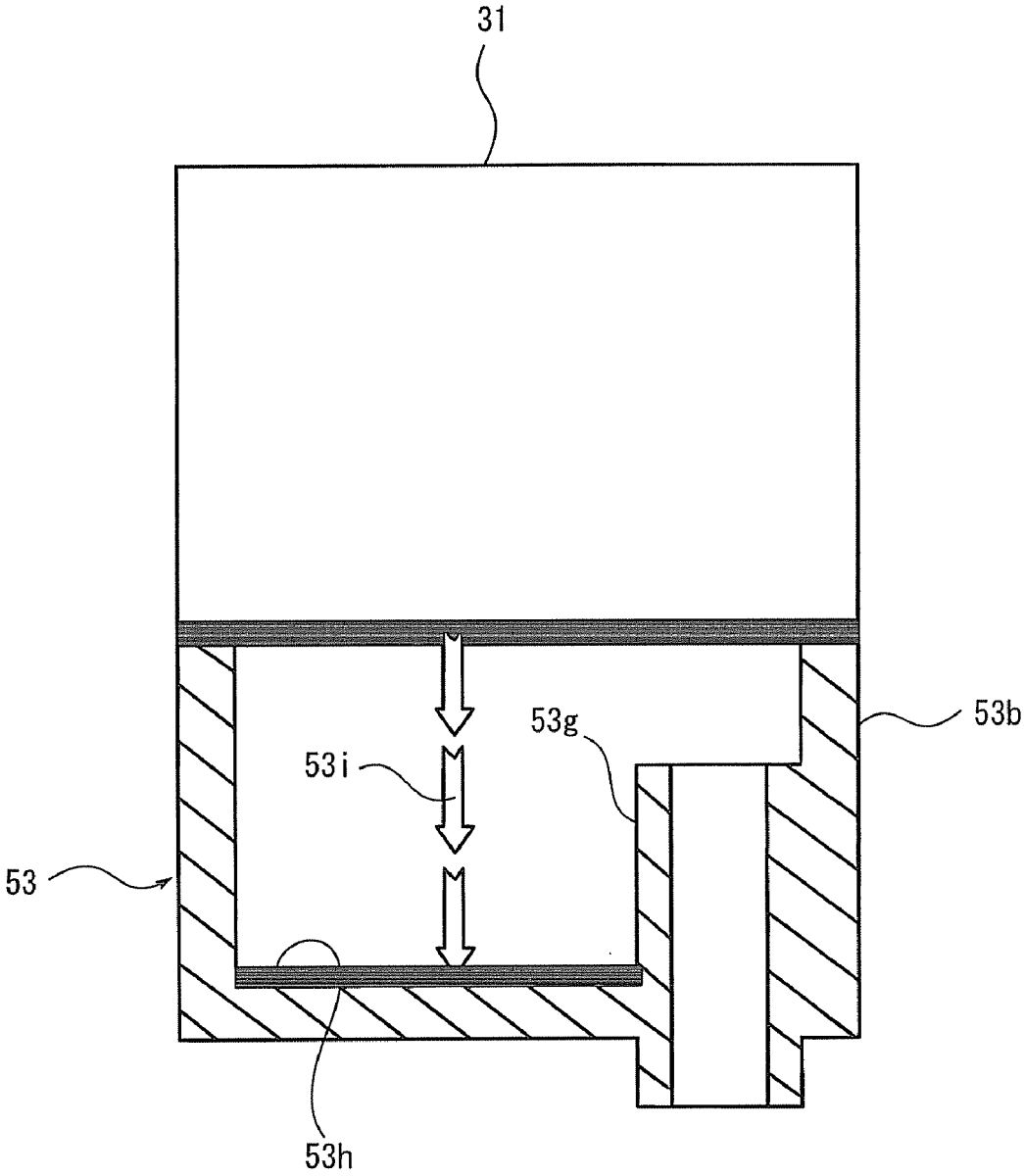
FIG. 44 is a diagram for explaining the configuration of the head 31 and the cap unit 53 in the maintenance main body unit 51.

As shown in FIG. 43, the atmosphere communication hole unit 53*g* is formed to be located in a position different from an ink ejection position 53*i* on a plane orthogonal to an ejecting direction of ink ejected from the nozzles of the head 31. A sheet-like moisture retaining material 53*h* for preventing drying of the nozzle orifices is laid on the bottom surface in the inside of the main body unit 53*b*. As the sheet-like moisture retaining material 53*h*, sponge having high liquid absorptivity or a sheet formed by impregnating a moisture regaining agent such as glycerin or ethylene glycol in unwoven fabric can be adopted.

Water repellent treatment is applied to the surface and the inner surface of the atmosphere communication hole unit 53*g* to repel water-based ink. Examples of a method of improving the water repellency of the atmosphere communication hole unit 53*g* include a method of molding the atmosphere communication hole unit 53*g* with a material having high water repellency and a method of depositing a water repellent membrane on the surface and the inner surface of the section of the atmosphere communication hole unit 53*g* of the cap unit 53 formed by molding ABS, acrylic, or the like. Examples of a material of the water repellent membrane include silicon oil, fluorine resin, polyimide resin, fullerene compound, and silicon-acryl block copolymer. However, the material is not limited to these materials. Any material that can show the same water repellent effect can be adopted.

The sheet-like moisture retaining material 53*h* (equivalent to a moisture retaining sheet) for preventing drying of the nozzle orifices is laid in at least a part of an area where the atmosphere communication hole unit 53*g* is not formed (at least around the atmosphere communication hole unit 53*g*). As the sheet-like moisture retaining material 53*h*, sponge having high liquid absorptivity or a sheet formed by impregnating a moisture retaining agent such as glycerin or ethylene glycol in unwoven fabric can be adopted.

Figure 45:
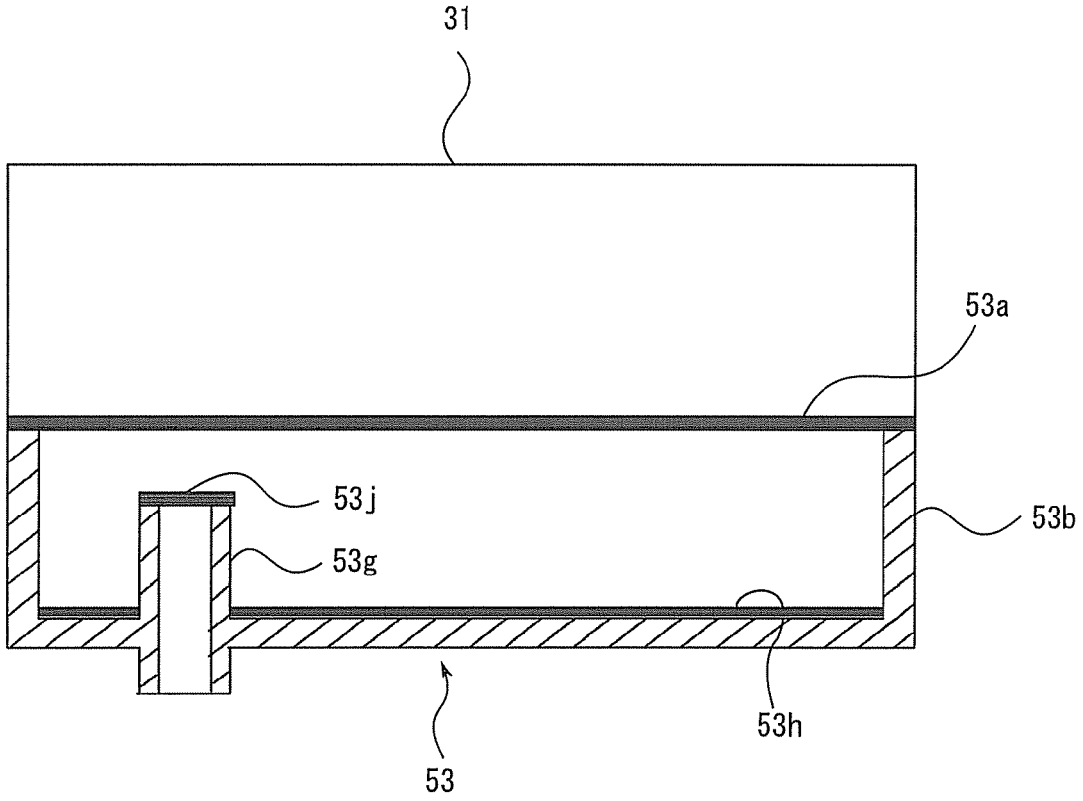
FIG. 45 is a diagram for explaining the configuration of the head 31 and the cap unit 53 in the maintenance main body unit 51.

In the configuration of the cap unit 53 shown in FIG. 45, an atmosphere communication hole gas permeable membrane 53*j* is provided to close an vent hole of the atmosphere communication hole unit 53*g* on the inner side of the main body unit 53*b*.

The atmosphere communication hole gas permeable membrane 53*j* is formed by applying water repellent treatment for repelling moisture of water-based ink or the like thereto. Specifically, the atmosphere communication hole gas permeable membrane 53*j* means a membrane that does not let moisture through and lets the air through and is formed of a material often used in a degassing membrane module or the like.

As the atmosphere communication hole gas permeable membrane 53*j*, for example, a membrane having "MHF three-layer composite hollow fiber membrane" manufactured by Mitsubishi Rayon Engineering Co., Ltd. (registered trademark) formed on the surface thereof, "ultrahigh-molecular-weight polyethylene porous film SUNMAP" manufactured by Nitto Denko Corporation (registered trademark), "MONOTRAN-FILM" manufactured by Nac Corporation (registered trademark), and "XCR (registered trademark)" manufactured by Japan Gore-Tex Inc. (registered trademark) can be adopted. However, the material of the atmosphere communication hole gas permeable membrane 53*j* is not limited to these materials. Any material can be adopted as long as the same effect can be obtained. It is also conceivable to impart water repellent performance to the surface of the atmosphere communication hole gas permeable membrane 53*j* when necessary.

With the capping mechanism in this embodiment, even when the nozzle surfaces of the head 31 are capped and ejection ports of the nozzles of the head 31 are closed, the pressure in the head 31 is opened to the outside by the atmosphere communication hole unit 53*g*. Therefore, when the nozzle surfaces of the head 31 are capped and the ejection ports of the nozzles of the head 31 are closed, an inconvenience that meniscuses held by small negative pressure on gas-liquid interfaces of the ejection ports are broken does not occur.

According to this embodiment, the sheet-like moisture retaining material 53*h* is laid over the bottom surface in the inside of the cap unit 53. Therefore, it is possible to prevent drying on the gas-liquid interfaces in the orifices of the head 31.

The edge surface of the entire circumference of the atmosphere communication hole unit 53*g* located higher than the inner bottom surface of the cap unit 53 is subjected to the water repellent treatment to repel water-based ink. Therefore, it is possible to suppress fog-like ink scattering in the cap unit 53 from entering the hole of the atmosphere communication hole unit 53*g*.

The water repellent treatment is applied to the vicinity of the inlet in the upper surface section of the atmosphere communication hole unit 53*g* to cap the inlet. Therefore, there is also an effect that it is possible to suppress mist-like ink scattering in the cap unit 53 from entering the hole of the atmosphere communication hole unit 53*g*.

The cap unit 53 of the maintenance unit 50 is configured as explained above. Therefore, even when ink scattering or accidentally dripping from the vicinity of the nozzles of the head 31 adheres to the outer circumferential surface or the like of the atmosphere communication hole unit 53*g* formed on the bottom surface in the inside of the cap unit 53, the ink is repelled by the surface having water repellency. Consequently, an ink pool does not occur in the cap unit 53 and intrusion of the ink into the atmosphere communication hole unit 53*g* can be prevented. Therefore, it is possible to prevent a situation in which the atmosphere communication hole unit 53*g* is blocked by the ink and does not communicate with the atmosphere.

The nozzles closed by the cap unit 53 can always maintain a high-humidity environment and always communicate with the atmosphere. Therefore, meniscuses as the gas-liquid interfaces in the orifices of the nozzles of the head 31 are not broken by a pressure change in the cap unit 53 due to a temperature change or the like. Inclusion of air bubbles, dripping of ink, or the like in the nozzles of the head 31 does not affect the next ejecting operation. Therefore, it is possible to provide an ink-jet recording apparatus excellent in intermittent ejection performance and continuous ejection performance.

Head-position Adjusting Mechanism

An adjusting mechanism for head positions in an image forming apparatus according to this embodiment is explained in detail below.

Figure 46:
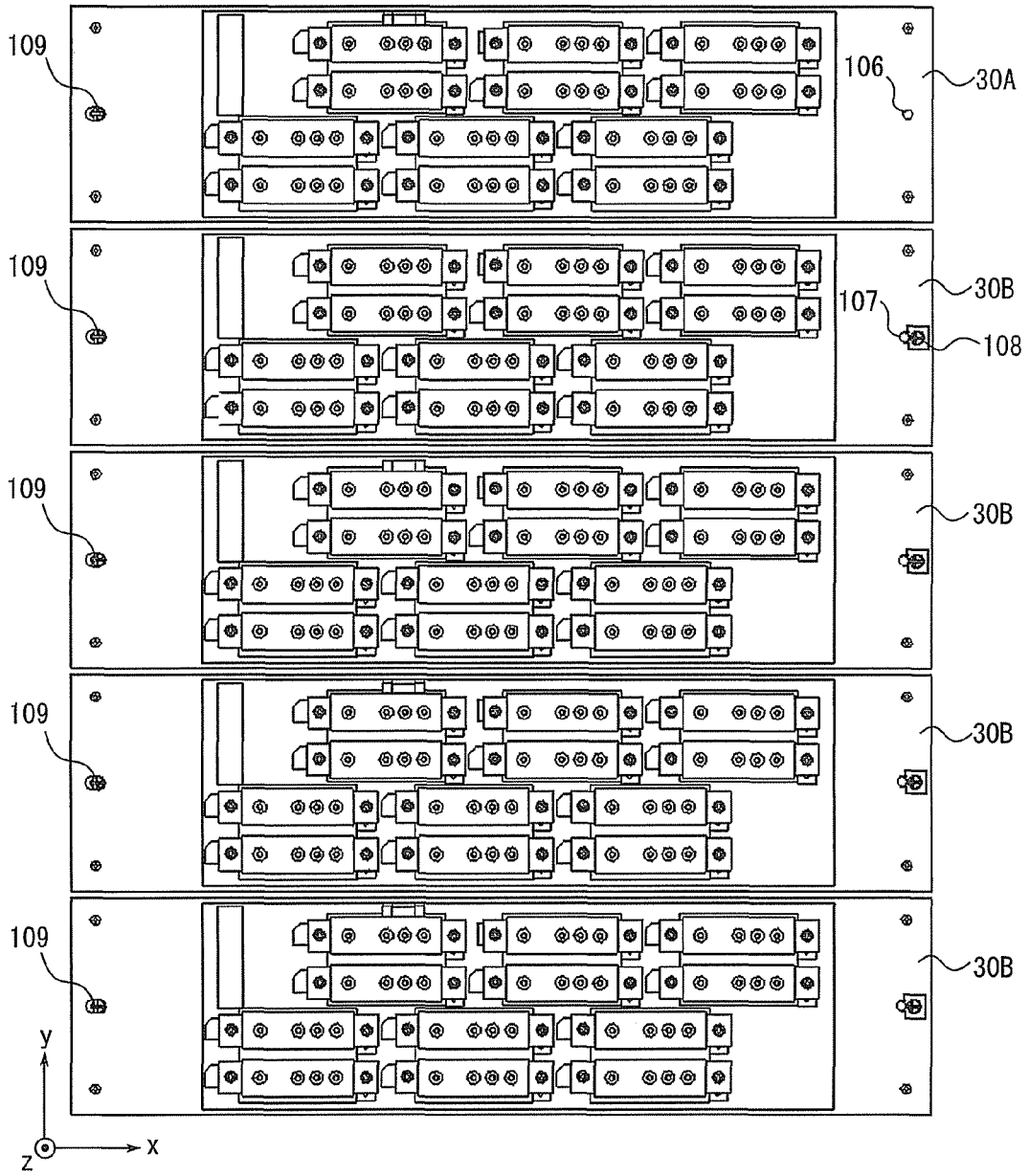
FIG. 46 is a diagram for explaining the arrangement of heads and a position adjusting mechanism for the heads in the image forming apparatus according to the embodiment.
Figure 47:
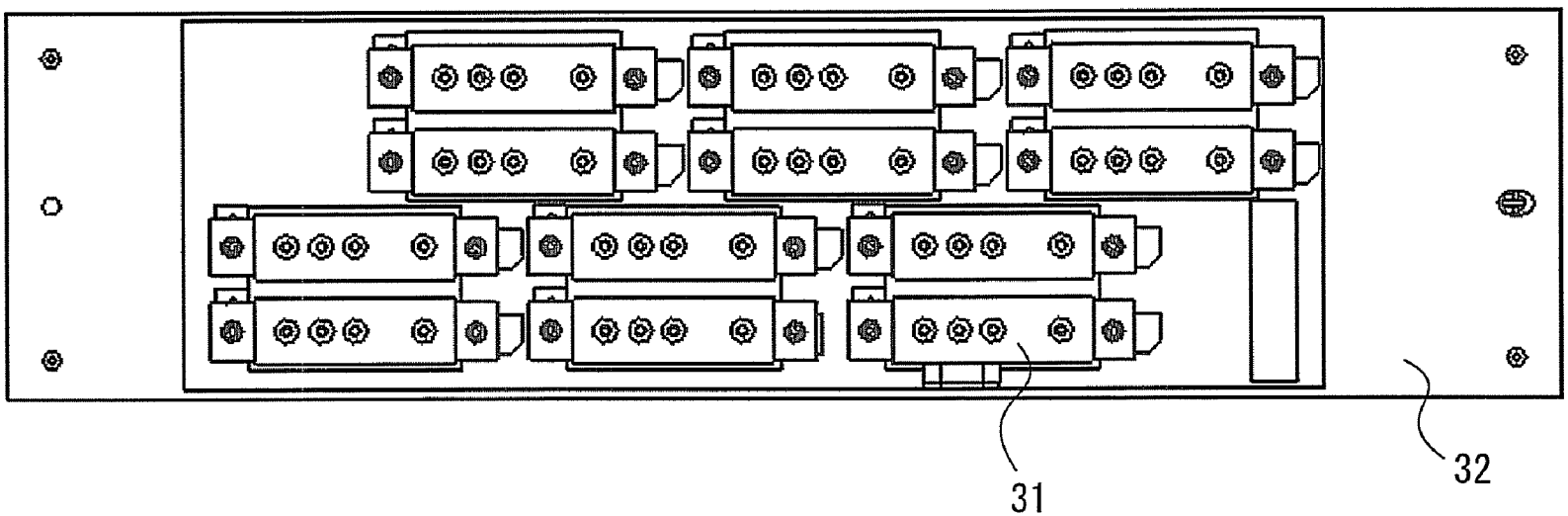
FIG. 47 is a diagram for explaining the arrangement of the heads and the position adjusting mechanism for the heads.
Figure 48:
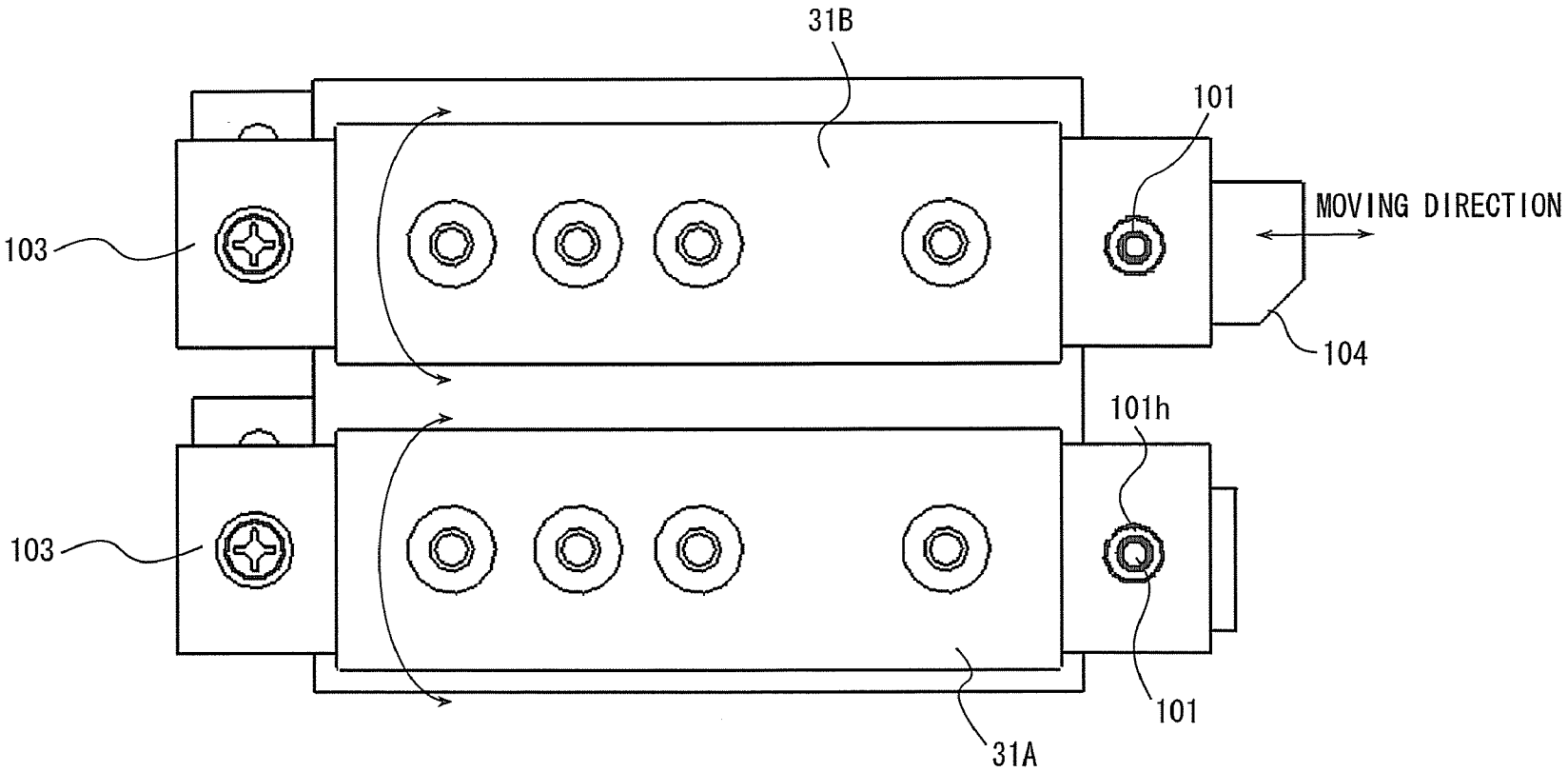
FIG. 48 is a diagram for explaining the arrangement of the heads and the position adjusting mechanism for the heads.

FIGS. 46 to 48 are diagrams for explaining the arrangement of heads and a position adjusting mechanism for the heads in the image forming apparatus according to this embodiment.

The heads 31 are arranged on the head base 32 such that the nozzles are arranged in parallel to a main scanning direction (a direction orthogonal to a direction in which the recording medium P is conveyed). Since a range in which an image is formed on the recording medium P is wider than the width of the head 31, it is necessary to arrange the plural heads 31 in the main scanning direction.

To prevent an area in which an image cannot be printed from being formed between the heads 31 adjacent to each other, the plural heads 31 are arranged to overlap by a predetermined number of nozzles in a nozzle direction of the heads 31.

In this embodiment, as shown in FIG. 46, to improve the resolution of an image formed on the recording medium P, the heads 31 having the same shape are arrayed to be shifted in positions by one dot in the main scanning direction (so-called zigzag array). At least one of the plural heads 31 arrayed on the head base 32 is set as a reference head serving as a reference for performing positioning or the like of the heads 31 on the head base 32.

As position adjustment for the heads 31 on the head base 32, the tilt with respect to the conveying direction of the recording medium P, the relative tilts among the heads 31, and the relative positions among the heads 31 in the main scanning direction are adjusted.

As an example of a procedure of the position adjustment for the heads 31, a procedure explained below is performed.

First, the heads 31 are provisionally fixed on the head base 32 with the positions thereof generally adjusted by using a jig or the like according to an adjustment center position (a head positioning section) on the head base 32. Subsequently, the tilt of the reference head 31A is adjusted with respect to the conveying direction of the recording medium P or a reference hole formed in the head base 32 (a head-angle adjusting mechanism). The position of the reference head 31A with respect to the head base 32 in the main scanning direction is determined by inserting and fitting a fixing pin 101 (equivalent to a reference head positioning section) provided on the head base 32 into a fitting hole 101*h* (equivalent to a positioning hole section and a positioned section) formed in the reference head 31A. In other words, the positioning in the main scanning direction of the reference head 31A is not adjusted. In the fixing pin 101, a screw hole is opened in the center. The head 31 is fixed to the head base 32 by fixing a screw (not shown) in the screw hole.

An adjustment jig is brought into contact with or fit with a positioning section 103 of the reference head 31A and the reference head 31A is pivoted around the fixing pin 101 to adjust the angle (the tile with respect to the main scanning direction) of the reference head 31A in the horizontal plane orthogonal to the ink ejecting direction.

The position in the main scanning direction of another head 31B is adjusted with respect to the reference head 31A. In a head other than the reference head 31A, the fixing pin 101 is fixed to an adjusting member 104 that can be moved with respect to the head base 32. The adjusting member 104 can be moved in a direction in which nozzle holes of the head are arrayed (the head-position adjusting mechanism).

First, the adjusting member 104 is moved with the adjustment jig (not shown) set in contact with the adjusting member 104 to perform head position adjustment in the main scanning direction. Thereafter, tilt adjustment with respect to the reference head 31B is performed (a head-angle adjusting mechanism). The tilt adjustment is performed by a method same as the method for the tilt adjustment with respect to the reference head 31A.

If a reference position in the main scanning direction deviates in this adjustment, work for adjusting the main scanning direction position and the tilt again is repeated. At a point when the position of the head 31B reaches a desired position, the head 31B is fixed to the head positioning section on the head base 32 by using a screw or the like. In this way, in this embodiment, a section where the reference head 31A should be mounted (the reference-head positioning section) cooperates with the positioned section of the reference head 31A to position the reference head 31A with a degree of adjustment freedom lower than that of the other head 31B.

When positioning accuracy between the nozzle holes formed in the head 31 and the member for positioning the head 31 on the head base 32 can be sufficiently secured, it is also possible to fix the head 31 to the head base 32 by performing only mechanical positioning by a pin or the like and without performing tilt adjustment concerning the tilt of the reference head 31A with respect to the conveying direction of the recording medium P. In this embodiment, the head base 32 is provided as a separate member in the head mounting unit 30. However, the head base 32 is not limited to this and may be formed integrally with the head mounting unit 30. In this embodiment, both the head base and the head mounting unit can be equivalent to a "head base" or a "reference head base" in claims.

To form a color image, the image forming apparatus according to this embodiment includes a plurality of the head mounting units 30 mounted with the plural heads 31. Therefore, position adjustment among the head mounting units 30 is necessary. Among the plural head mounting units 30, a head mounting unit as a reference (a head mounting unit 30A) is determined. In the same manner as the positioning for the head 31, position adjustment and tilt adjustment among the other plural head mounting units 30B in the main scanning direction is performed with reference to the reference head mounting unit 30A (equivalent to a reference head base in claims). The reference head mounting unit 30A is positioned with respect to the image forming apparatus main body by inserting and fitting a positioning pin 106 (a reference-head-base holding section) fixed to the image forming apparatus main body into a fitting hole 106*h* (a base-side positioned section or a positioning hole section) formed in the reference head mounting unit 30A. The tilt with respect to the conveying direction of the recording medium P of the reference head mounting unit 30A is adjusted by a cam 109 (a base-angle adjusting mechanism).

Concerning the other head mounting unit 30B, the pin fixed to the image forming apparatus main body is not only used for simple positioning but also used as a pivoting center 107 for the tilt adjustment for the heads. The pin set in the pivoting center 107 has structure for adjusting the position in the main scanning direction with a cam 108 (a base-position adjusting mechanism).

Concerning the head mounting unit 30, similarly, when positioning accuracy can be sufficiently secured by inserting the positioning pin 106 fixed to the image forming apparatus main body into the hole formed in the head mounting unit 30, it is also possible to fix the head mounting unit 30 to the image forming apparatus main body by performing only mechanical positioning by the positioning pin 106 or the like without performing tile adjustment concerning the tile of the reference head mounting unit 30A with respect to the conveying direction of the recording medium P.

The positioning for the heads and the head mounting units is realized by the configuration explained above. Therefore, even when strong impact is applied to the image forming apparatus, since the reference head is positioned to the head mounting unit by the pin, deviation of head positions does not occur. When it is desired to adjust the head positions and the positions of the head mounting units again, adjustment matched to the head and the head mounting unit as references only has to be performed. Therefore, the readjustment can be easily performed.

In this embodiment, as the example, the fitting holes are formed in the heads, the head bases, and the head mounting units and the positioning pins are formed on the head bases and the image forming apparatus main body side. However, the present invention is not limited to this. Pins can be provided on the heads, the head bases, and the head mounting units and fitting holes for positioning (positioning hole sections) can be formed on the head bases and the image forming apparatus main body side.

As explained above, according to this embodiment, it is possible to provide an image forming apparatus having a configuration explained below.

(1) An image forming apparatus including:

a media conveying unit configured to convey a recording medium;

a head configured to eject election liquid from nozzles formed on a side opposed to the media conveying unit onto the recording medium conveyed by the media conveying unit; and a regulating member arranged in a position near a downstream side of the head in a conveying direction of the recording medium by the media conveying unit and closer to the media conveying unit than the nozzles of the head and configured to regulate a warp extending from the media conveying unit side to the nozzle side of the recording medium.

(2) The image forming apparatus described in (1), wherein the head is mounted on a head base that can hold a predetermined positional relation with respect to the media conveying unit, and the regulating member is mounted on the head base.

(3) The image forming apparatus described in (1), wherein the regulating member regulates the warp extending from the media conveying unit side to the nozzle side of the recording medium while point-contacting with respect to the recording medium configured to convey the media conveying unit.

(4) The image forming apparatus described in (3), wherein the regulating member includes a star wheel rotatably supported around a rotating shaft provided in a direction orthogonal to the conveying direction of the recording medium by the media conveying unit.

Separation and Collection of Waste Liquid from the Heads

A mechanism for separating and collecting waste liquid of ink in the image forming apparatus according to this embodiment is explained below in detail.

In the image forming apparatus employing the ink jet system, it is conceivable to store waste ink or the like caused in the maintenance of the heads in a predetermined tank.

However, when not only the ink but also the pretreatment liquid is collected from the heads, the ink and the pretreatment liquid are solidified if mixed. Therefore, in the image forming apparatus according to this embodiment, the problem is solved by configurations explained below.

FIRST EXAMPLE

Figure 49:
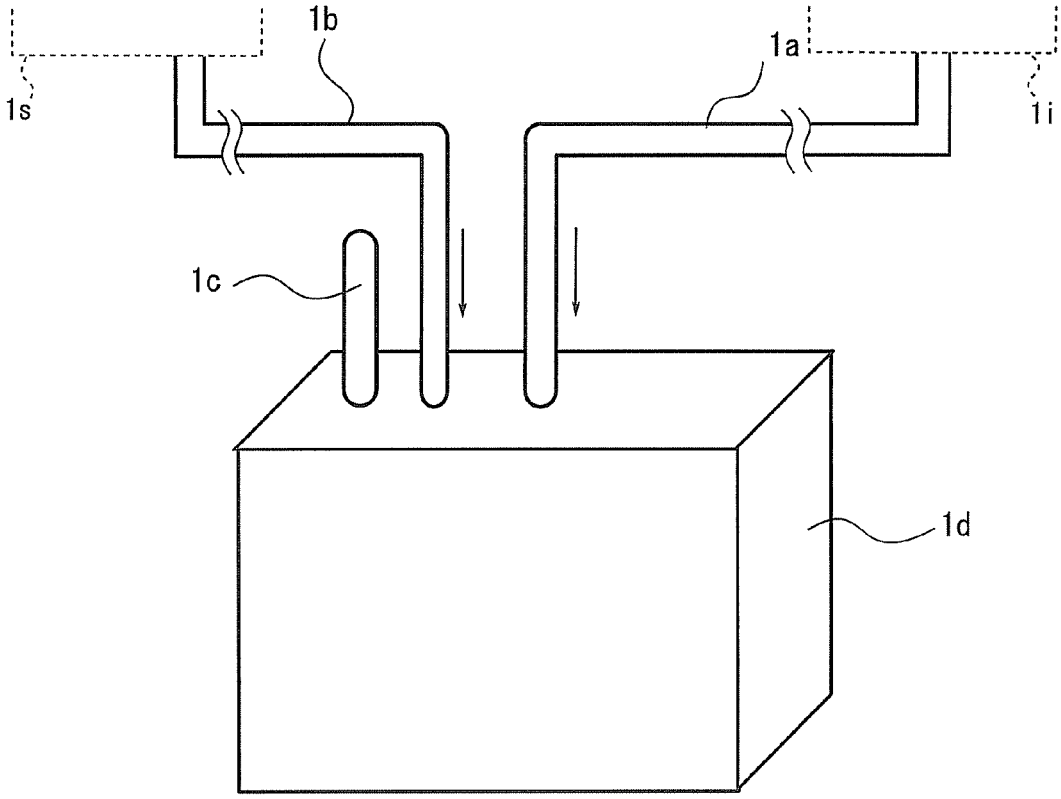
FIG. 49 is a diagram for explaining a first example of a waste liquid separating mechanism for ink in the embodiment.

First, a first example of a waste-liquid separating mechanism for ink in this embodiment is explained. FIG. 49 is a diagram for explaining the first example of the waste-liquid separating mechanism for ink in this embodiment.

The image forming apparatus according to this embodiment includes a waste ink reservoir 1*i* near the head 31. The image forming apparatus receives, with the waste ink reservoir 1*i*, ink discarded according to maintenance operation for the head 31 (waste ink). Specifically, the waste ink reservoir 1*i* receives ink or the like sucked from the head 31 by suction operation by the suction unit 54*a*.

An ink collection path 1*a* is connected to the waste ink reservoir 1*i*. The waste ink discharged to the waste ink reservoir 1*i* is discharged to a waste liquid tank 1*d* through the ink collection path 1*a*.

The image forming apparatus according to this embodiment includes a waste pretreatment liquid reservoir 1*s* near the head 31. The image forming apparatus receives, with the waste pretreatment liquid reservoir 1*s*, pretreatment liquid discarded (waste pretreatment liquid) according to the maintenance operation for the head 31.

A waste pretreatment liquid collection path 1*b* is connected to the waste pretreatment reservoir 1*s*. The waste pretreatment liquid discharged to the waste pretreatment liquid reservoir 1*s* is discharged to the waste liquid tank 1*d* through the waste pretreatment liquid collection path 1*b*.

The waste liquid tank 1*d* in this example includes a pressure relief valve 1*c* to maintain proper internal pressure at which the waste ink and the waste pretreatment liquid can be received.

With such a configuration, the waste ink collected through the ink collection path 1*a* and the waste pretreatment liquid collected through the waste pretreatment liquid collection path 1*b* are stored from separate storage ports. Therefore, the waste ink and the waste pretreatment liquid do not come into contact with each other until reaching the waste liquid tank 1*d*. It is possible to prevent occurrence of a situation in which the waste ink and the waste pretreatment liquid come into contact with each other to be solidified in a collection path and the collection path is clogged.

SECOND EXAMPLE

Figure 50:
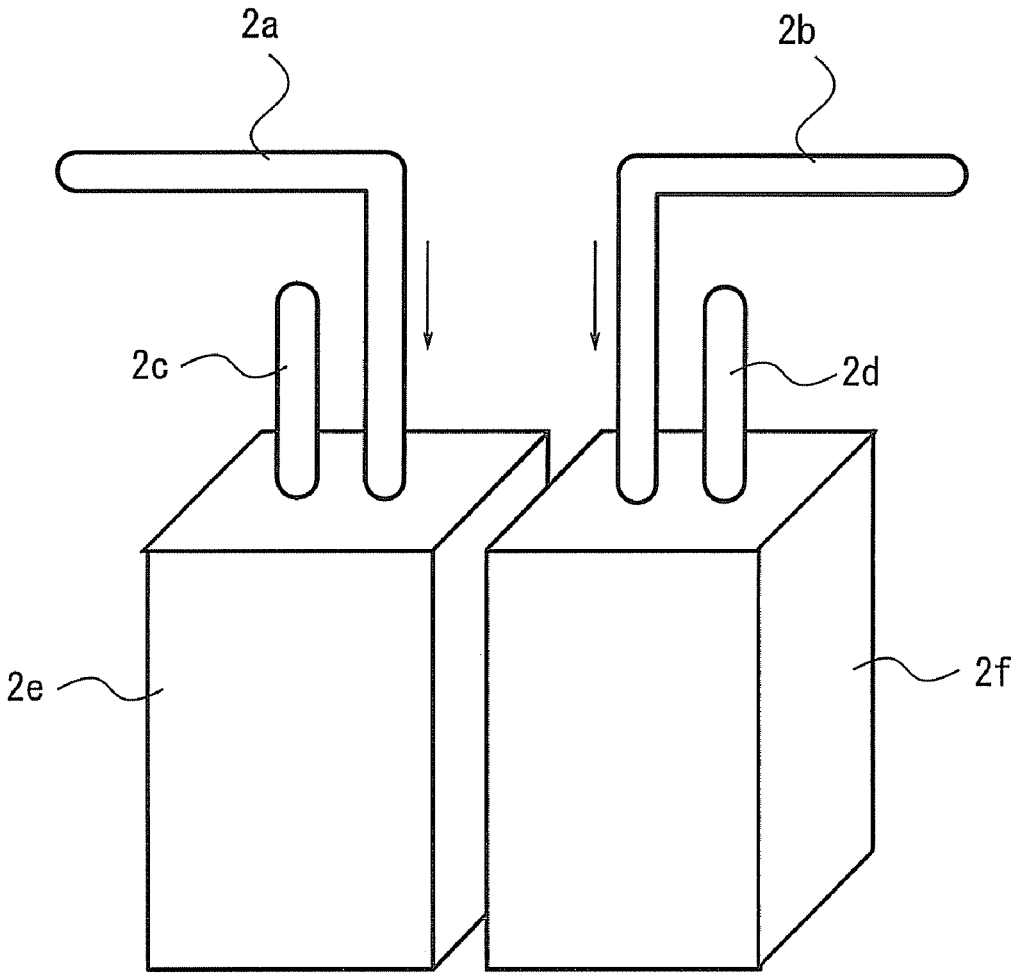
FIG. 50 is a diagram for explaining a second example of the waste liquid separating mechanism for ink in the embodiment.

A second example of the waste-liquid separating mechanism for ink in this embodiment is explained below. FIG. 50 is a diagram for explaining the second example of the waste-liquid separating mechanism for ink in this embodiment. Components having functions same as those in the first example are denoted by the same reference numerals and signs and explanation of the components is omitted.

In the image forming apparatus according to the second example, unlike the first example, the waste ink tank 2*e* configured to receive waste ink from the waste ink reservoir 1*i* and the waste pretreatment liquid tank 2*f* configured to receive waste pretreatment liquid from the waste pretreatment liquid reservoir 1*s* are separately prepared.

Specifically, in the second example, an ink collection path 2*a* is connected to the waste ink reservoir 1*i*. The waste ink discharged to the waste ink reservoir 1*i* is discharged to the waste ink tank 2*e* through the ink collection path 2*a*.

A waste pretreatment liquid collection path 2*b* is connected to the waste pretreatment reservoir 1*s*. The waste pretreatment liquid discharged to the waste pretreatment liquid reservoir 1*s* is discharged to the waste pretreatment liquid tank 2*f* through the waste pretreatment liquid collection path 2*b*.

The waste ink tank 2*e* and the waste pretreatment liquid tank 2*f* in this example respectively include a pressure relief valve 2*c* and a pressure relief valve 2*d* to maintain proper internal pressure at which the waste ink and the waste pretreatment liquid can be received.

With such a configuration, an effect same as that in the first example can be obtained. The waste ink and the waste pretreatment liquid are respectively received in the separate exclusive tanks. Therefore, it is possible to prevent a situation in which the waste ink and the waste pretreatment liquid are mixed and solidified in a tank.

The waste ink and the waste pretreatment liquid are respectively collected in the separate tanks. Therefore, it is also possible to reuse the collected waste ink and waste pretreatment liquid in the following image formation processing by circulating and supplying the waste ink and the waste pretreatment liquid to the heads again via a filter or the like.

THIRD EXAMPLE

Figure 51:
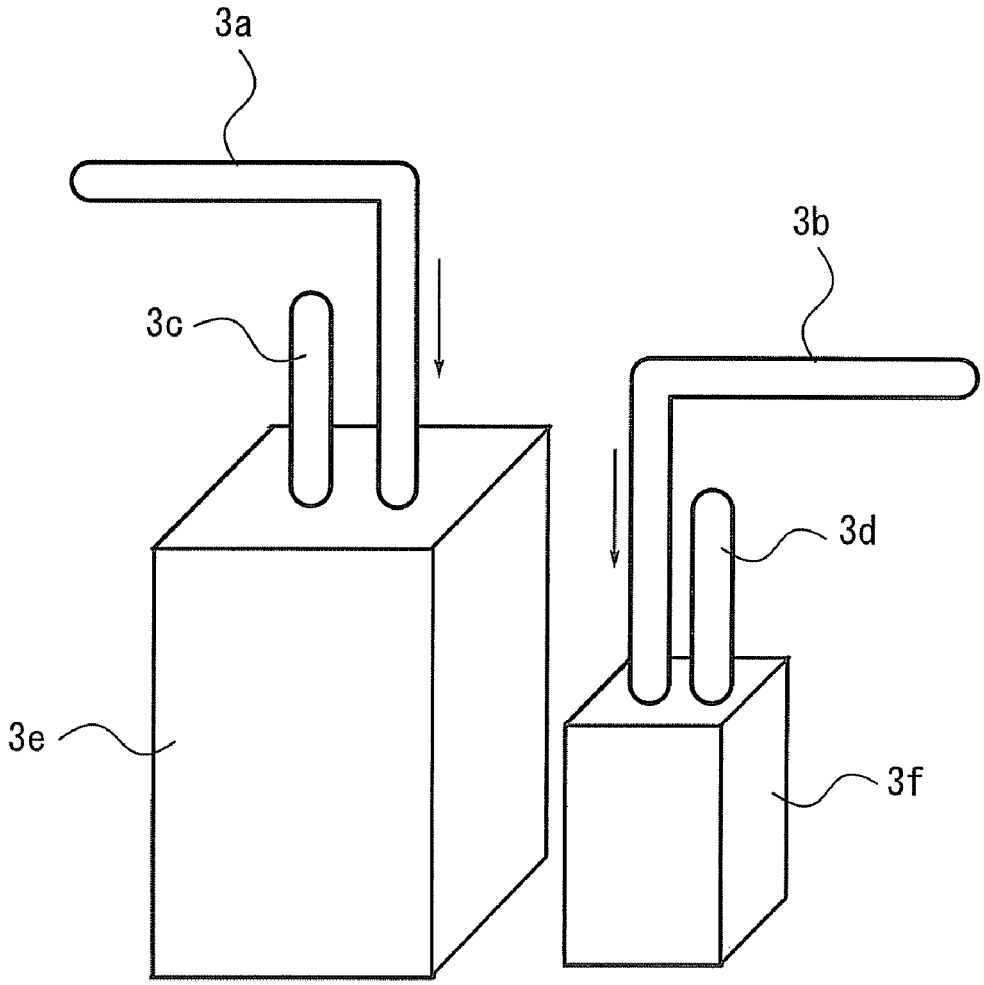
FIG. 51 is a diagram for explaining a third example of the waste liquid separating mechanism for ink in the embodiment.

A third example of the waste-liquid separating mechanism for ink in this embodiment is explained below. This example is a modification of the second example. FIG. 51 is a diagram for explaining the third example of the waste-liquid separating mechanism for ink in this embodiment. Components having functions same as those in the second example are denoted by the same reference numerals and signs and explanation of the components is omitted.

In the image forming apparatus according to this example, unlike the second example, a receivable capacity of waste ink in a waste ink tank 3*e* and a receivable capacity of waste pretreatment liquid in a waste pretreatment liquid tank 3*f* are different.

Since recording heads configured to eject inks of respective colors of cyan (C), magenta CM), yellow (Y), and black (K) form images, the heads discharge a large amount of waste ink compared with an amount of waste pretreatment liquid discharged from a head for pretreatment liquid.

For example, when colors of images that can be formed by the heads are four colors of C, N, Y, and K, an amount of waste ink is about four times as large as an amount of waste pretreatment liquid. In this case, it is desirable to set the capacity of the waste ink tank 3*e* four times as large as the capacity of the waste pretreatment liquid tank 3*f* (set the capacity of the waste pretreatment liquid tank 3*f* smaller than the capacity of the waste ink tank 3*e*).

As explained above, according to this example, a ratio of the capacity of the waste ink tank 3*e* and the waste pretreatment liquid tank 3*f* is set the same as a ratio of an amount of waste ink and an amount of waste pretreatment liquid. Therefore, in addition to the effect realized by the configuration of the second example, it is possible to set replacement timings for the waste ink tank 3*e* and the waste pretreatment liquid tank 3*f* in substantially the same periods. There is also an effect that replacement frequencies of the waste ink tank 3*e* and the waste pretreatment liquid tank 3*f* can be reduced.

FOURTH EXAMPLE

Figure 52:
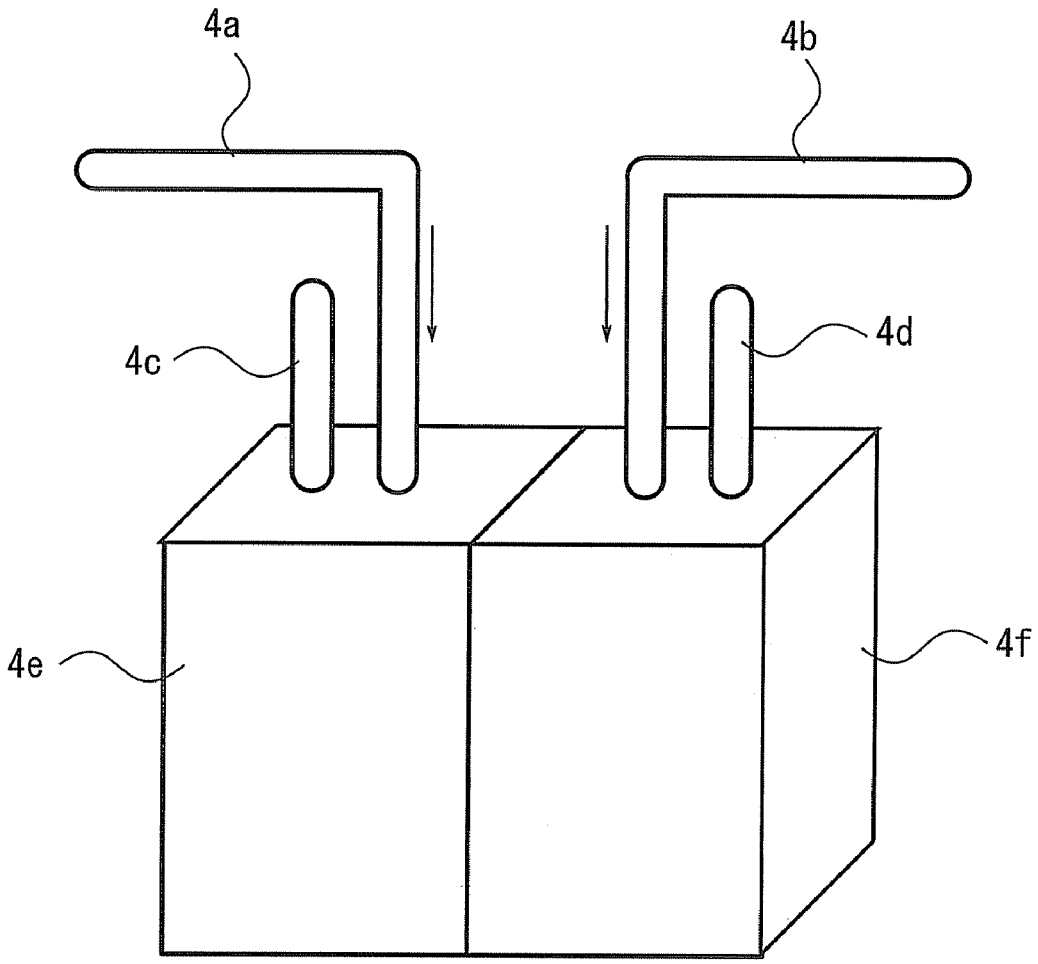
FIG. 52 is a diagram for explaining a fourth example of the waste liquid separating mechanism for ink in the embodiment.

A fourth example of the waste-liquid separating mechanism for ink in this embodiment is explained below. FIG. 52 is a diagram for explaining the fourth example of the waste-liquid separating mechanism for ink in this embodiment. Components having functions same as those in the second example are denoted by the same reference numerals and signs and explanation of the components is omitted. This example is a modification of the second example.

In the image forming apparatus according to the fourth example, as in the second example, a waste ink tank 4*e* configured to receive waste ink from the waste ink reservoir 1*i* and a waste pretreatment liquid tank 4*f* configured to receive waste pretreatment liquid from the waste pretreatment liquid reservoir 1*s* are separately prepared.

The waste ink tank 4*e* and the waste pretreatment liquid tank 4*f* in this example respectively include a pressure relief valve 4*c* and a pressure relief valve 4*d* to maintain proper internal pressure at which waste ink and waste pretreatment liquid can be received.

By adopting such a configuration, in addition to the effect by the second example, the waste ink tank 4*e* and the waste pretreatment liquid tank 4*f* are integrally formed without communicating with each other. Therefore, there is an effect that it is possible to simultaneously perform replacement of the waste ink tank 4*e* and replacement of the waste pretreatment liquid tank 4*f*.

In these examples, it is also possible to arrange a heat source (a heat source unit) such as a heater in the image forming apparatus and arrange a waste liquid tank near the heat source to evaporate waste liquid in the waste liquid tank earlier than evaporation under the room temperature and secure a capacity of the waste liquid tank.

Cover Opening and Closing Mechanism

The cover opening and closing mechanism of the image forming apparatus according to this embodiment is explained below.

In the image forming apparatus in the past employing the ink jet system, when heads are maintained or when a recording medium is conveyed near the nozzles, a maintenance unit, a conveying unit, or the like is moved in the apparatus body.

Specifically, in the image forming apparatus according to this embodiment, the maintenance unit 50, the media conveying unit 20, and the like are configured to be movable according to an operation mode executed in the image forming apparatus. Besides the operation mode of the apparatus, when an error such as a paper jam occurs, to eliminate the error, it is also conceivable to move at least the head 31 or the media conveying unit 20 to secure a work space.

In the image forming apparatus according to this embodiment, an image can be printed on the entire range in the direction orthogonal to the conveying direction of the recording medium P (the width direction) at a time by the entire head group arrayed in a line shape in the width direction. A size in the width direction of the entire head group in such a configuration is a size same as a maximum print target range in the width direction of the recording medium P. It is difficult for a user to insert a hand into a narrow space in the apparatus and manually move such a large unit. Even when a configuration for automatically moving the unit is adopted, if a cover is opened while the unit is moving, an interlock operates and the moving unit 20*b* stops in the middle of the movement. It is difficult to maintain the unit that stops in the middle of the movement. It is likely that the hand is stained if the user unreasonably performs work in that state.

In view of such problems, a configuration explained below is adopted in the image forming apparatus according to this embodiment.

Details of the cover opening and closing mechanism in this embodiment are explained with reference to FIGS. 53 to 57.

In the image forming apparatus according to this embodiment, a fixed cover 100 and a movable cover 101, which form an outer wall of the image forming apparatus, cover the apparatus main body.

The movable cover 101 is configured to be openable and closable for, for example, maintenance and inspection and elimination of a paper jam in the apparatus. The movable cover 100 is fixed to the image forming apparatus main body.

A lock mechanism U for locking the movable cover 101 to the image forming apparatus main body to prevent the movable cover 101 from opening is provided between the movable cover 101 and the apparatus main body.

The lock mechanism U rotates, with a solenoid Ua (or a mechanism component equivalent thereto) controlled by the control unit 90, an engaging member Ub around a predetermined rotating shaft. In this way, the lock mechanism U switches a lock state in which the engaging member Ub is engaged with a section to be engaged Uc provided in the movable cover 101 and an unlocked state in which the engagement is released. The lock mechanism U may take other forms without departing from the scope of the present invention.

Figure 54:
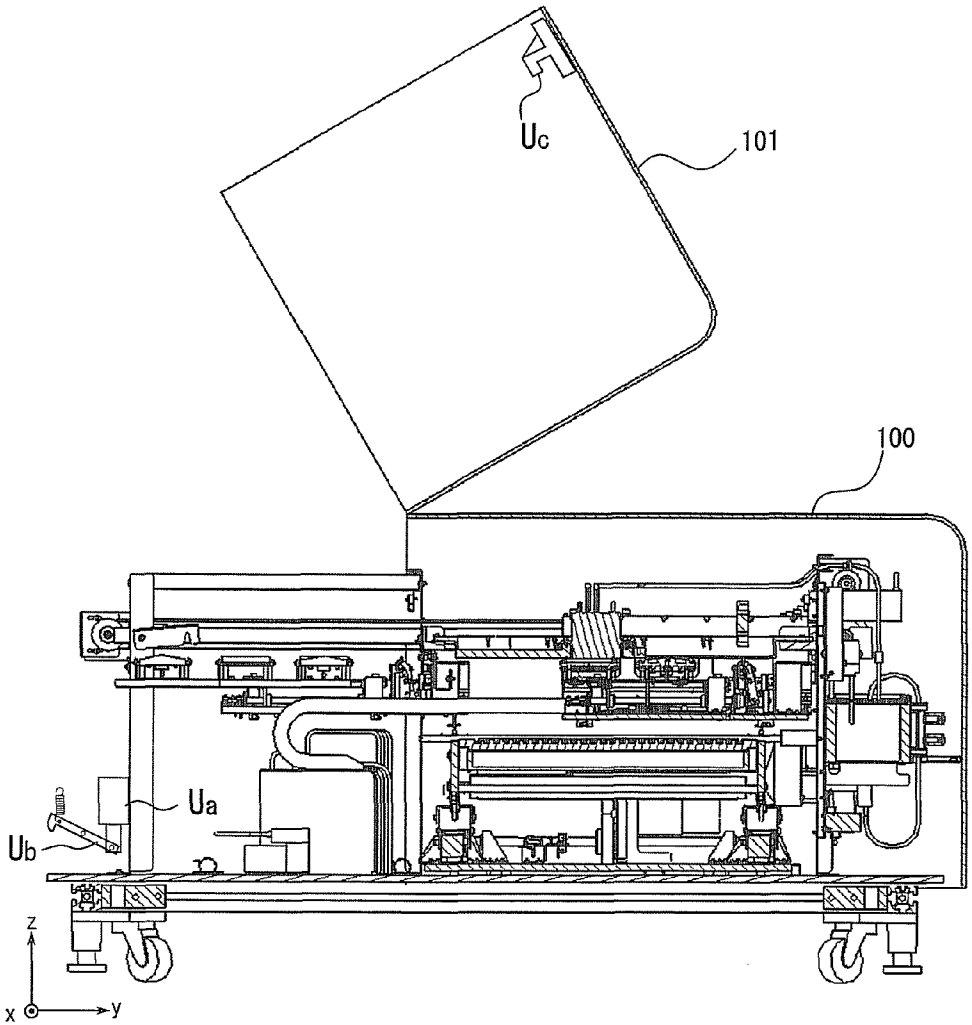
FIG. 54 is a diagram for explaining the details of the cover opening and closing mechanism in the embodiment.

Usually, the media conveying unit 20 is located in one of a "printing position" and a "standby position". Since the fixed cover 100 is not locked in that state, the user can open the cover 100 at will (FIG. 54).

Figure 53:
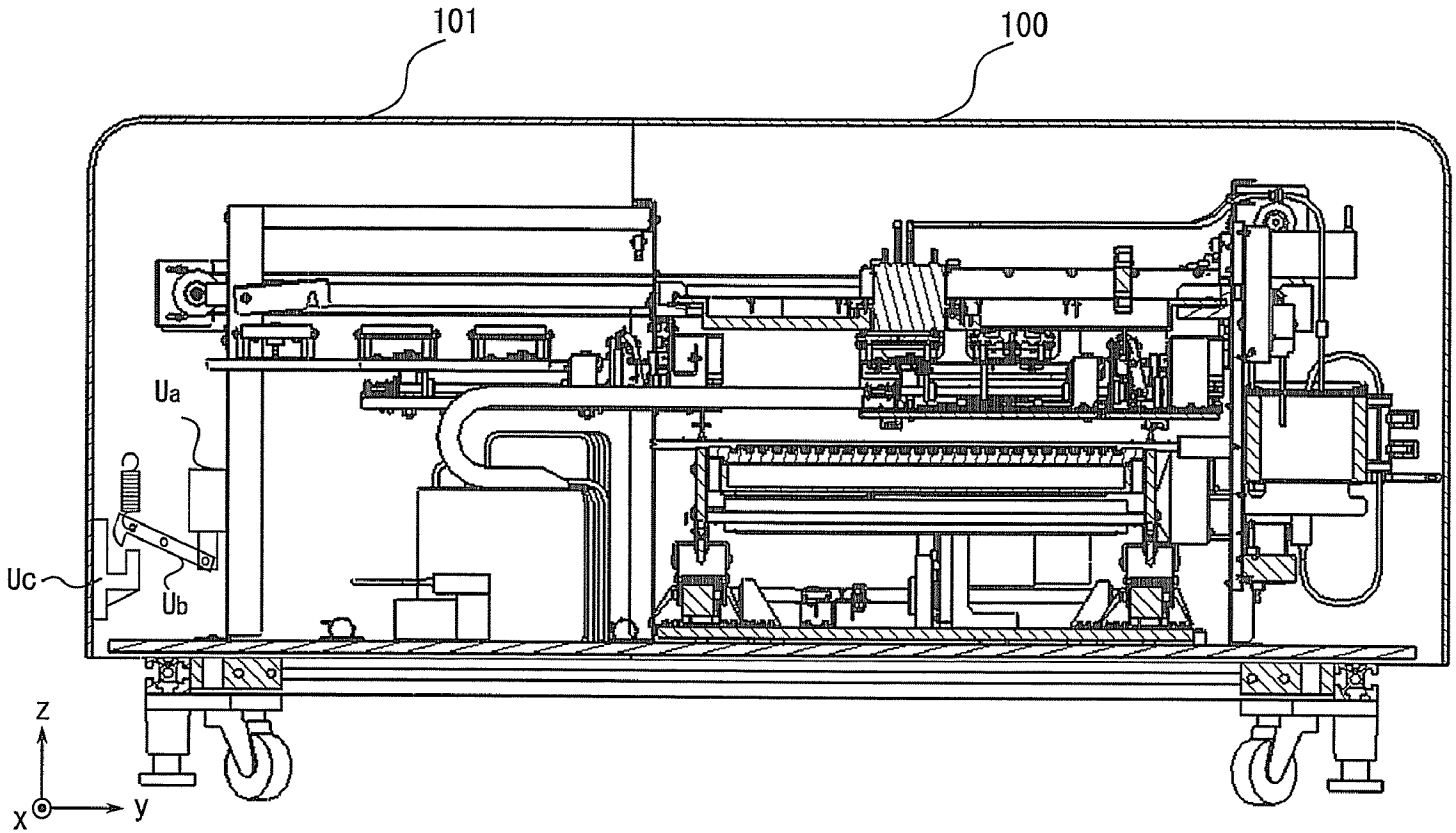
FIG. 53 is a diagram for explaining details of a cover opening and closing mechanism in the embodiment.

On the other hand, in a transient state in which the media conveying unit 20 is transitioning from the "printing position" to the "standby position" or from the "standby position" to the "printing position", a cover lock signal is transmitted from the control unit 90 and the movable cover 101 is locked (FIG. 53).

Figure 57:
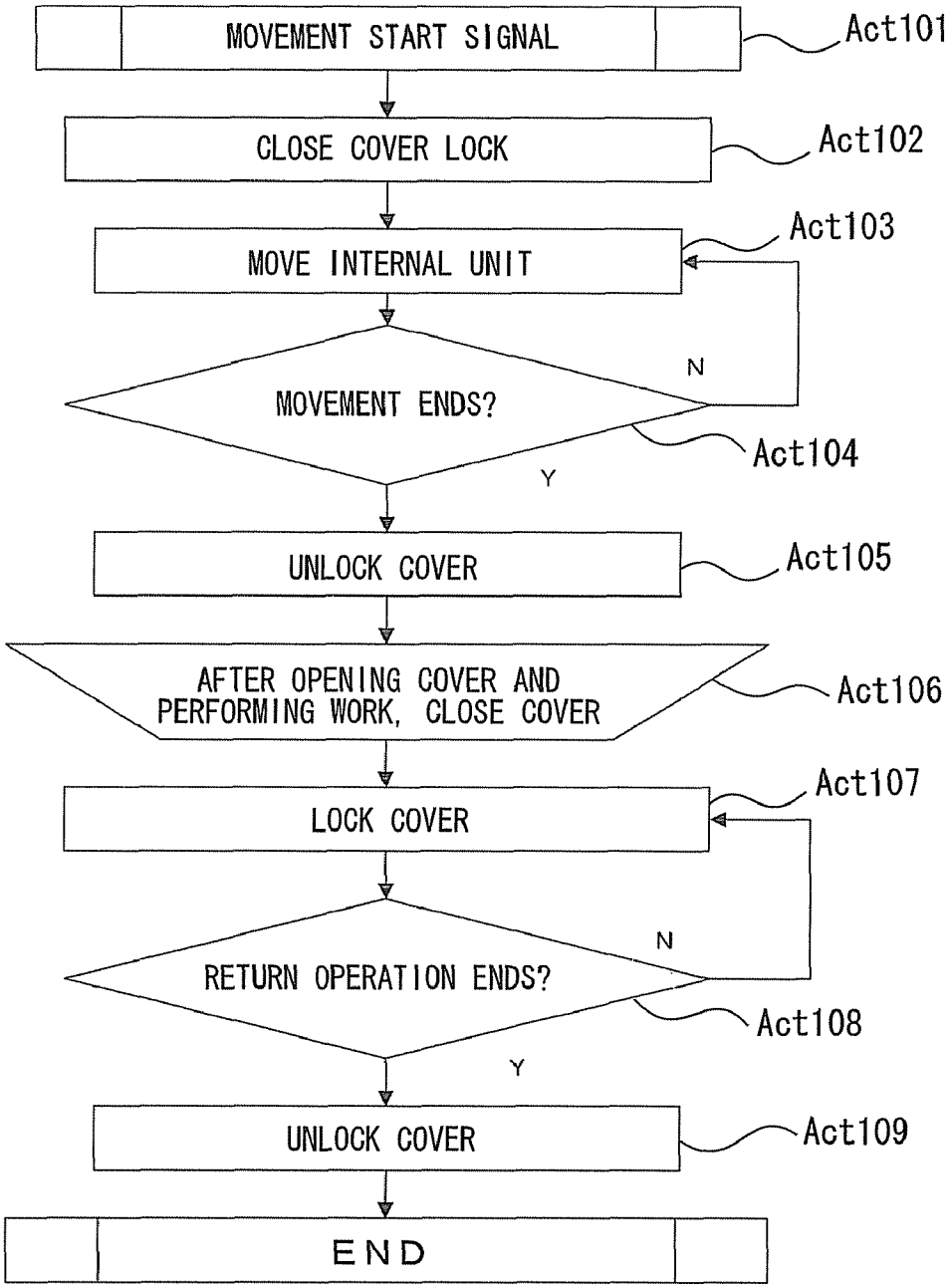
FIG. 57 is a diagram for explaining the details of the cover opening and closing mechanism in the embodiment.

A flowchart for explaining the operation of the cover opening and closing mechanism of the image forming apparatus according to this embodiment is shown in FIG. 57.

First, the lock mechanism of the movable cover 101 operates on the basis of a signal indicating the start of movement of an internal unit such as the media conveying unit 20 or the maintenance unit 50 (Act 101) to prevent the movable cover 101 from opening (Act 102).

If the movement of the internal unit (Act 103) ends (Y in Act 104), the movable cover 101 is unlocked (Act 105) and can be opened.

The user or the like opens the movable cover 101 and performs work. Thereafter, the cover opening and closing mechanism detects that the movable cover 101 is closed again (Act 106). The internal unit moves to return to the standby state. While the internal unit moves, the movable cover 101 continues to be locked in the same manner as explained above (Act 107). At a point when the movable cover 101 returns to the standby state (Y in Act 108), the movable cover 101 is unlocked (Act 109).

Figure 56:
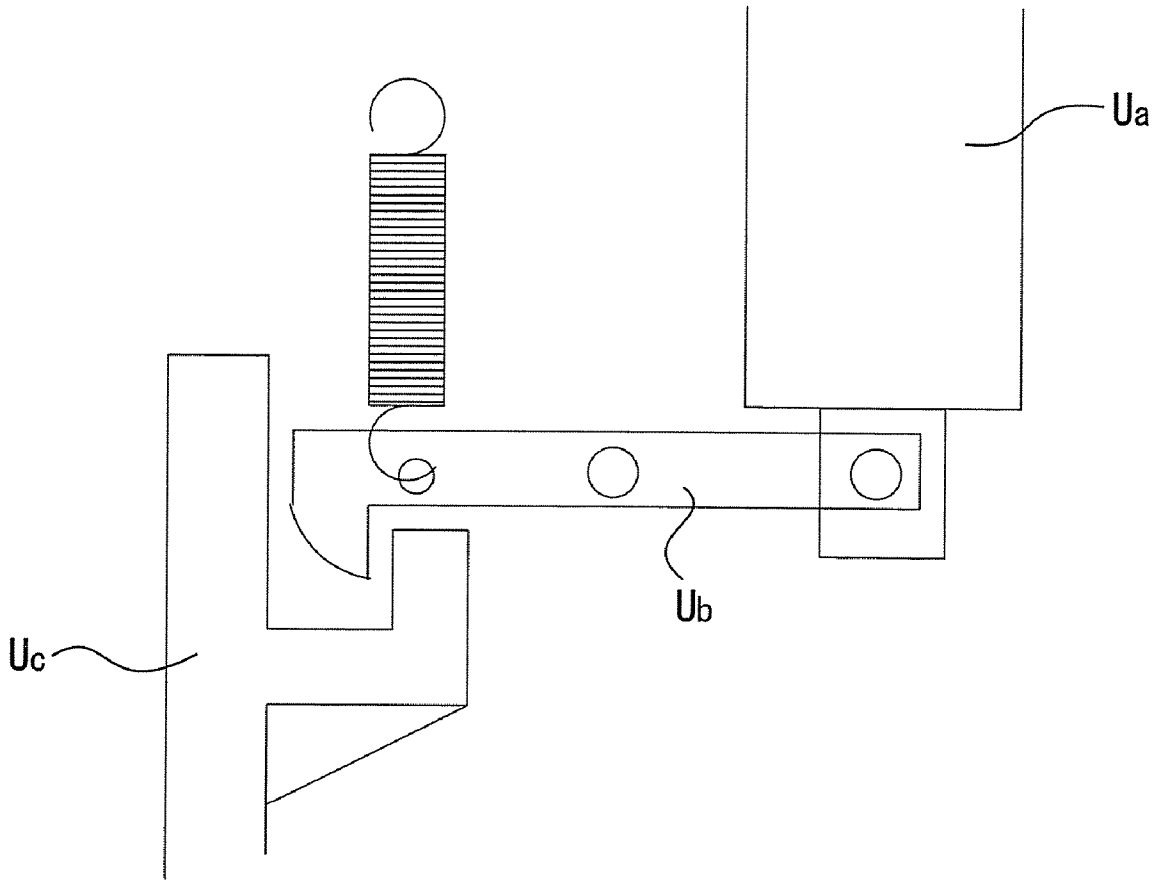
FIG. 56 is a diagram for explaining the details of the cover opening and closing mechanism in the embodiment.

As a specific example of the series of operation in this embodiment, when a paper jam occurs, the media conveying unit 20 falls to secure a work space for removing the recording medium P. While the media conveying unit 20 falls, the movable cover 101 is locked. Therefore, the user cannot access the inside of the apparatus (FIG. 56).

Figure 55:
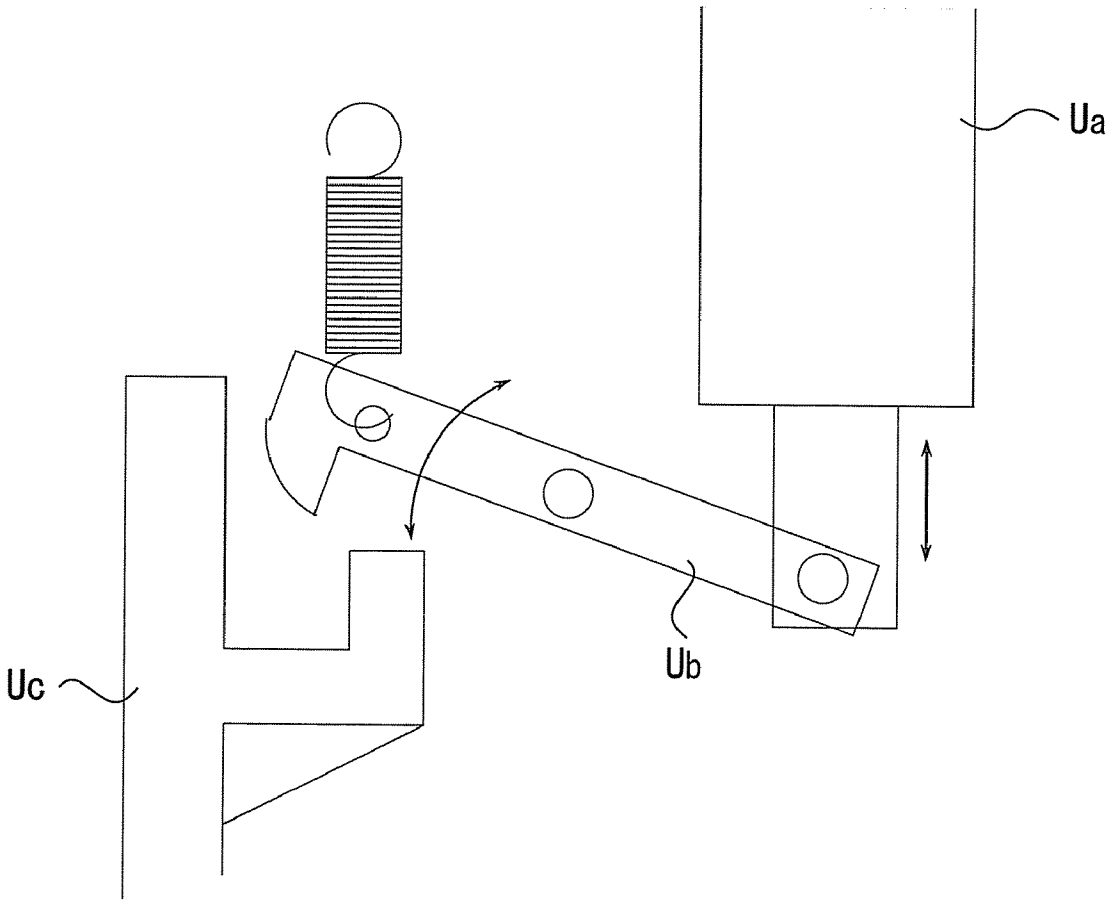
FIG. 55 is a diagram for explaining the details of the cover opening and closing mechanism in the embodiment.

At a point when the media conveying unit 20 completely falls and the work space is safely secured, the movable cover 101 is unlocked and the user can remove the recording medium P. At a point when the error is eliminated and the media conveying unit 20 reaches the "standby position" or the "printing position", the movable cover 101 is unlocked (FIG. 55).

The movable cover 101 is locked to the apparatus main body until the media conveying unit 20 reaches the "initial position" or the "retracted position" and stops. This makes it possible to prevent the user from touching the maintenance unit 50 soiled by ink while the maintenance unit 50 is in a halfway position.

In the example explained in this embodiment, only the movable cover 101 is a section where the apparatus cover can be opened and closed. However, the present invention is not limited to this. Plural covers may be provided to make it possible to open and close plural sections. In this case, the user may be allowed to selectively open and close the movable cover suitable for maintenance work according to the present position of the moving unit 20*b* in the apparatus or a position to which the maintenance unit 50 (the moving unit 20*b*) should move soon. Information concerning the position to which the maintenance unit 50 should move soon can be acquired by the control unit 90 (the information acquiring unit).

As explained above, according to this embodiment, the movable cover 101 is locked not to open until the movement of the media conveying unit 20 or the maintenance unit 50 is completed. Consequently, even when such a unit is forcibly stopped during the movement in the apparatus and stops in a position where the unit should not originally stop, it is possible to prevent a situation in which the user inserts a hand into the apparatus, touches the head, the maintenance unit 50, or the like to which ink adheres, and stains the hand with the ink.

As explained above, according to this embodiment, it is possible to provide an image forming apparatus having a configuration explained below.

(1) An image forming apparatus configured to form an image on a recording medium with ejection liquid ejected from plural heads, the image forming apparatus including:

a moving unit configured to be movable in the image forming apparatus;

a fixed cover configured to fixedly cover a part of a main body of the image forming apparatus including the moving unit;

an opening and closing cover configured to openably and closably cover at least a part of a section not covered by the fixed cover of the image forming apparatus main body including the moving unit;

a lock unit configured to be capable of locking the opening and closing cover not to be opened; and a lock control unit configured to cause the lock unit to lock the opening and closing cover not to be opened while the moving unit is moving.

(2) The image forming apparatus described in (1), wherein the moving unit is a media conveying unit configured to move the recording medium with respect to the heads.

(3) The image forming apparatus described in (1), wherein the moving unit is a maintenance unit for maintaining the heads.

(4) The image forming apparatus describe in (1), wherein the opening and closing cover includes plural covers configured to cover plural different sections of the image forming apparatus main body, the lock unit is separately provided in each of the plural covers, the image forming apparatus further includes an information acquiring unit configured to acquire information concerning a position to which the moving unit should move, and the lock control unit unlocks, on the basis of the information acquired by the information acquiring unit, a cover associated with the acquired information among the plural covers.

(5) The image forming apparatus described in (1), wherein the position to which the moving unit should move is a standby position where the moving unit should be located when a recording medium jams or a standby position where the moving unit should be located during maintenance and inspection.

It is possible to carry out the present invention in various other forms without departing from the spirit or the main characteristics thereof. Therefore, the embodiment described above is merely an illustration in every aspect and should not be limitedly interpreted. The scope of the present invention is indicated by the scope of claims and by no means is limited by the text of the specification. Further, all alterations, various improvements, substitutions, and modifications belonging to a range of equivalents of the scope of claims are included in the scope of the present invention.

As explained above in detail, according to embodiments of the present invention, in an image forming apparatus configured to form an image on a recording medium with heads to which ejection liquid is circulated and supplied, it is possible to provide a technique for circulating and supplying the ejection liquid to the heads while minimizing the influence of pump operation on ejection performance of the heads.

What is claimed is:

1. An image forming apparatus comprising:

a head configured to eject supplied ejection liquid onto a recording medium;

a circulating path configured to collect the ejection liquid remaining in the head and circulate and supply the ejection liquid to the head again;

an upstream side chamber arranged further on an upstream side with respect to an ink flowing direction than the head in the circulating path and configured to temporarily store the ejection liquid that should be supplied to the head through the circulating path;

a downstream side chamber arranged further on a downstream side than the head and further on the upstream side than the upstream side chamber in the circulating path and configured to temporarily store the ejection liquid collected from the head; and a pressure-difference adjusting mechanism configured to select a first pressure state in which pressure in the downstream side chamber is lower than pressure in the upstream side chamber and a second pressure state in which the pressure in the upstream side chamber is lower than the pressure in the downstream side chamber.

2. The apparatus according to claim 1, wherein the pressure-difference adjusting mechanism includes:

an upstream-side atmosphere relief valve configured to relieve the pressure in the upstream side chamber to atmosphere;

a head-downstream-side-backflow preventing mechanism arranged further on the downstream side than the head and further on the upstream side than the downstream side chamber in the circulating path and configured to allow only a flow from the head to the downstream side chamber;

a downstream-side positive-pressure applying unit configured to apply positive pressure into the downstream side chamber;

a downstream-side negative-pressure applying unit configured to apply negative pressure into the downstream side chamber;

an inter-chamber-backflow preventing mechanism arranged between the downstream side chamber and the upstream side chamber in the circulating path and configured to allow only a flow from the downstream side chamber to the upstream side chamber; and a backflow suppressing mechanism arranged between the upstream side chamber and the head in the circulating path and configured to allow a flow from the upstream side chamber to the head and suppress a flow from the head to the upstream side chamber.

3. The apparatus according to claim 1, further comprising:

an upstream-side positive-pressure applying unit configured to apply positive pressure into the upstream side chamber; and a pressure control unit configured to cause the upstream-side positive-pressure applying unit to apply the positive pressure into the upstream side chamber in that case causing the head to purge the ejection liquid.

4. The apparatus according to claim 1, wherein the pressure-difference adjusting mechanism includes:

a downstream-side negative-pressure applying unit configured to apply negative pressure into the downstream side chamber;

an upstream-side atmosphere relief valve configured to relieve pressure in the upstream side chamber to atmosphere;

a backflow suppressing mechanism arranged between the upstream side chamber and the head in the circulating path and configured to allow a flow from the upstream side chamber to the head and suppress a flow from the head to the upstream side chamber;

an upstream-side negative-pressure applying unit configured to apply negative pressure into the upstream side chamber;

an inter-chamber-backflow preventing mechanism arranged between the downstream side chamber and the upstream side chamber in the circulating path and configured to allow only a flow from the downstream side chamber to the upstream side chamber;

a backflow suppressing mechanism arranged between the upstream side chamber and the head in the circulating path and configured to allow a flow from the upstream side chamber to the head and suppress a flow from the head to the upstream side chamber; and a downstream-side atmosphere relief valve configured to relieve pressure in the downstream side chamber to the atmosphere.

5. The apparatus according to claim 1, further comprising a pressure control unit configured to prevent, in a period in which the ejection liquid is ejected to the recording medium by the head, the pressure-difference adjusting mechanism from performing the switching of the pressure states.

6. The apparatus according to claim 1, further comprising a pressure control unit configured to cause, in a period in which the ejection liquid is not ejected to the recording medium by the head, the pressure-difference adjusting mechanism to perform the switching of the pressure states.

7. The apparatus according to claim 1, wherein the image forming apparatus executes a maintenance mode for maintaining the head, and the apparatus further comprises a pressure control unit configured to cause, in a period in which maintenance processing for the head is executed, the pressure-difference adjusting mechanism to perform the switching of the pressure states.

8. The apparatus according to claim 1, further comprising a conveyance control unit configured to expand an interval of plural recording media, which are caused to continuously pass the head, if the switching of the pressure states by the pressure-difference adjusting mechanism is performed.

9. The apparatus according to claim 1, wherein the image forming apparatus includes plural heads, and the apparatus further comprises a pressure control unit configured to cause the pressure-difference adjusting mechanism to perform the switching of the pressure states only for a head that is not performing operation for ejecting the ejection liquid to the recording medium.

10. The apparatus according to claim 9, wherein a part of the plural heads performs monochrome printing and the other heads among the plural heads perform color printing, and the apparatus further includes a pressure control unit configured to cause, in a period in which a head used for one of monochrome printing and color printing is ejecting the ejection liquid to the recording medium, the pressure-difference adjusting mechanism to perform the switching of the pressure states only for a head used for the other of the monochrome printing and the color printing.

11. The apparatus according to claim 1, further comprising:

an image reading unit configured to read an image of an original document; and a pressure control unit configured to cause, during execution of document reading operation by the image reading unit, the pressure-difference adjusting mechanism to perform the switching of the pressure states.

12. The apparatus according to claim 1, further comprising:

the apparatus includes a head configured to eject predetermined pretreatment liquid that should be ejected onto the recording medium before ejecting ink onto the recording medium; and a head configured to eject the ink, wherein a number of times of switching per unit time of the pressure states by the pressure-difference adjusting mechanism is smaller in the head configured to eject the pretreatment liquid than in the head configured to eject the ink.

13. The apparatus according to claim 1, further comprising an ejection-liquid supplying unit configured to supply the ejection liquid to at least one of the upstream side chamber and the downstream side chamber in synchronization with operation for switching the pressure states by the pressure-difference adjusting mechanism.

14. The apparatus according to claim 13, further comprising an upstream-side atmosphere relief valve configured to relieve pressure in the upstream side chamber to atmosphere, wherein the ejection-liquid supplying unit performs the supply of the ejection liquid in a period in which the pressure in the upstream side chamber is relieved to the atmosphere by the upstream-side atmosphere relief valve.

15. An ejection liquid circulating method in an image forming apparatus for temporarily storing ejection liquid that should be supplied to a head through a circulating path and temporarily storing the ejection liquid collected from the head in a downstream side chamber arranged further on a downstream side than the head in the circulating path and on an upstream side than an upstream side chamber, the head being configured to eject supplied ejection liquid to a recording medium, the circulating path being configured to collect the ejection liquid and remaining in the head and circulate and supply the ejection liquid to the head again, and the upstream side chamber being arranged further on the upstream side with respect to an ink flowing direction than the head in the circulating path, the method including: forming a first pressure state in which pressure in the downstream side chamber is lower than pressure in the upstream side chamber and the head; and forming a second pressure state in which the pressure in the upstream side chamber is lower than the pressure in the downstream side chamber.

16. The method according to claim 15, wherein the forming the second pressure state includes setting the pressure in the downstream side chamber to positive pressure with a downstream-side positive-pressure applying unit configured to apply the positive pressure into the downstream side chamber.

17. The method according to claim 15, further comprising performing switching of the pressure states in a period in which the ejection liquid is not ejected to the recording medium by the head.

18. The method according to claim 15, further comprising expanding an interval of plural recording media, which are caused to continuously pass the head, if switching of the pressure states is performed.

19. The method according to claim 15, wherein the image forming apparatus further includes an image reading unit configured to read an image of an original document, and the method further comprises performing switching of the pressure states during execution of document reading operation by the image reading unit.

20. The method according to claim 15, further comprising supplying the ejection liquid to at least one of the upstream side chamber and the downstream side chamber in synchronization with operation for switching the pressure states.

* * * * *